US008151535B1

(12) United States Patent
Thompson

(10) Patent No.: US 8,151,535 B1
(45) Date of Patent: Apr. 10, 2012

(54) RIGHT-TRIANGULAR GUSSET AND BUILDING FRAMING MEMBERS

(76) Inventor: Thomas C Thompson, Makakilo, HI (US)

( * ) Notice: Subject to any disclaimer, the term of this patent is extended or adjusted under 35 U.S.C. 154(b) by 0 days.

(21) Appl. No.: 12/460,553

(22) Filed: Aug. 5, 2009

(51) Int. Cl.
*E04B 1/38* (2006.01)

(52) U.S. Cl. ..... 52/715; 52/712

(58) Field of Classification Search ..... 52/712, 52/715; 403/231
See application file for complete search history.

(56) References Cited

U.S. PATENT DOCUMENTS 3,194,527 A * 7/1965 Gruss ..... 248/235
3,446,071 A * 5/1969 Vanyo et al. ..... 73/861.12
H1795 H * 7/1999 Leek ..... 52/712
7,520,474 B1 * 4/2009 Condon ..... 248/56
7,658,356 B1 * 2/2010 Nehls ..... 248/300

* cited by examiner

*Primary Examiner* — Jeanette E Chapman
*Assistant Examiner* — Daniel Kenny

(57) ABSTRACT

A novel, triangular connector containing intersecting triangles and tabs. Triangles are connected along their longest sides by a bend. Tabs are connected to the sides of the triangles opposite the longest sides. The tabs have nail holes for attaching to intersecting structural members on a building. When fastened to the structural members, the connector forms a gusset with multiple intersecting triangles. These provide multi-angles of stiffness. The connector helps prevent movement of the structural members during seismic events. The connector can be retrofitted to vertical and horizontal beams on a building to help prevent earthquake and hurricane damage.

1 Claim, 57 Drawing Sheets

RIGHT-TRIANGULAR GUSSET AND BUILDING FRAMING MEMBERS

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to triangular-shaped, retrofit, gusset connectors that permanently attach intersecting structural members to make a building resistant to wind and earthquakes.

2. Prior Art

During an earthquake, the floor, wall, and roof diaphragms undergo shearing and bending. The outside sheathing provides lateral stability to the walls, preventing racking. The sheathing also absorbs and transfers earthquake forces by becoming a shear wall. This invention helps prevent the wall studs from moving, thus helping prevent the outside sheathing from pulling away from the wall during earth movements.

Steel connectors, between different components of a wood-frame building's superstructure, provide continuity so that the building will move as a unit in response to seismic activity. This invention ties the walls securely together and to the foundation, so the house will move as one unit.

Previous steel connectors used a right angle bend to brace intersecting structural members. Some used multiple bends. Some used a triangle, which is known to be strong in multiple angles. Some had to be attached to two or three sides of a structural member to provide bracing and strength. This invention can be installed on just one side of each structural member to provide great strength to the connection. This connector uses multiple triangles, and bends. It also forms multiple triangles when it is fastened to intersecting structural members.

Recent studies of hurricane damage on wood-frame buildings indicate that extensive damage was generated to a house by strong winds, when the walls moved away from the foundation, and adjacent walls moved away from each other. This invention helps prevent the wall sheathing from detaching from the wall during strong winds, by preventing the wall from bending, twisting, and moving.

Triangular gussets have been around since the middle ages where they were used to reinforce areas of clothing. Triangular gussets are still used to reinforce under the arms of suits, in the crotch of certain pants, and in the heels of socks.

Triangular wood gussets have been used in furniture-making to reinforce wood legs to the table top. Triangular metal gussets have been used to reinforce motorcycle frames, and as motor mounts and suspension frames in automobiles. Most of these triangular gussets were single triangles.

Where two triangles have been used, they are usually spaced apart. Grizzly Inc. has a cast-iron slotted angle plate (G9577), consisting of a right angle bracket with a triangular gusset at either end.

A gusset is defined as a plate or bracket for strengthening an angle in framework. The Simpson Strong-Tie Company, a leading manufacturer of construction connectors, has several gussets listed in their 2009-2010 catalog. They have many connectors with right angles, but only a few with triangles. Page 134 shows a TBE, Truss Bearing Enhancer, that has two triangular gussets on either end of a plate.

Simpson's page 138 shows a GBC, Gable Brace Connector, that has a broad gusset pushed up in the center of the bend between the horizontal and vertical members. Page 143 shows a HGAM10, Hurricane Tie, that also has a broad gusset pushed up in the center of the bend between the horizontal and vertical members.

Simpson's page 169 shows a SBV/CF-R, Shelf Brackets/Concrete Form Angles, that consist of triangles with tabs on two sides. Page 180 shows an HL, Heavy Angles & Gussets, that consists of an angle iron with an optional triangular gusset in the middle.

Inoue's torsion-beam suspension, U.S. Pat. No. 7,284,765, uses a triangular gusset on his suspension. McCraney's water heater restraint, U.S. Pat. No. 5,487,518, uses triangles to help hold a cylindrical water heater. Wood's flexible side gusset square bottom bags, U.S. Pat. No. 5,165,799, uses connected triangles to make a flexible bag. Box's heavy-duty full-depth beverage case, U.S. Pat. No. 4,548,320 uses molded ribs to form triangles as gussets. Fleishman's interconnecting members for enclosures, U.S. Pat. No. 4,308,698, uses gussets and struts to form triangles for a geodesic dome. Pritchart's corner gusset, U.S. Pat. No. 4,127,347, uses a triangular gusset between mitered corners.

OBJECTS AND ADVANTAGES

Accordingly, several objects and advantages of my invention are that it helps secure the walls of a building to make the building a solid unit and thus preventing it from being destroyed by earthquakes and wind storms.

This invention forms four triangles against intersecting structural members. The triangles are intersecting and connected together. The invention is adjustable, making several variations from one basic design. It can fit on different types of structural members that are at generally right angles to each other.

This invention helps prevent the wall studs from twisting during earthquakes and strong winds, thereby preventing detaching and collapse of the walls. It stiffens the wall, helping to transfer lateral, uplift, twisting and turning loads into the foundation.

This invention helps prevent the wall sheathing of a building from detaching from the wall studs during an earthquake. It helps make the wall into a stable shear-wall, transferring shear forces into the foundation and ground.

One object of this invention is to make each outside wall on a house into a shear-wall, that is, able to transfer forces without breaking or disconnecting. By preventing the wall studs from twisting and moving, the outside sheathing can stay connected to the outside wall. Therefore, the plywood can reliably transfer and dissipate shear, lateral, and uplift forces to the ground.

During an earthquake or a hurricane, a building with my invention will be a sturdy unit, resisting and transferring destructive forces into the ground.

Mounted on the wall stud and sill, my invention resists uplift, the most destructive force during an earthquake and wind storm. Mounted on the floor plate and wall stud, my invention prevents the wall from twisting and moving. Mounted on each structural member, they help absorb and transfer loads.

During an earthquake, when my gussets are mounted on the walls, they can tie each corner of a wall together. This helps turn adjacent walls into shear walls. The outside plywood will stay more secure if the wall studs are not twisting and moving, and will absorb and dissipate earth movements, without becoming detached from the underlying structural members. It will also prevent the sheathing from sliding past each other, as often occurs during earthquakes.

This would could improve the house beyond existing building codes, as sheet metal joints have been proven to perform better than plain nailed joints during hurricanes and earthquakes.

Another object of this invention is the large surface area the gusset contains. This area provides more strength in the connecting or hold-down process.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the wall studs to move.

Earth tremors and hurricanes always destroy the weakest parts of a house. The sill and wall studs are closest to forces transferred up from the ground. By tying them together with gussets, there will be less damage.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size studs, wood or metal I-beams, TJI, and glue-lams, all made from wood or metal. There may be insurance discounts for homeowners who have this invention installed on their houses.

As a retrofit, a handy homeowner can install this invention, or have it installed. An insurance agent can observe that the home is protected and give appropriate discounts. Perspective home buyers can perceive that the building is protected, so the seller has a good selling point and can ask for a better price.

Another object of this gusset is that each of the four triangles helps form a buttress. This tremendously increases resistance to thrusts. This makes the walls much stronger and able to resist more weight such as thick snow, ice, or volcanic ash, and heavy roofing material such as tile, insulated roofing, solar collectors, and satellite dishes.

Since this invention can cradle a structural member on multiple sides, any force is absorbed and transmitted into other structural members. The wide base and connection helps prevent torsional twisting of the stud, and it also helps prevent cross-grain splitting of the wood.

This invention can be applied to any structural members that meet at a general right angle. Most structural members meet at a right angle. Edges of the gusset are slightly rounded for strength, ease of handling, and avoiding stress fracturing associated with sharp corners.

Previous steel connectors used a right angle bend to brace intersecting structural members. Some used multiple bends. Some used a triangle, which is known to be strong in multiple angles. Some had to be attached to two or three sides of a structural member to provide bracing and strength. This invention can be installed on just one side of each structural member to provide great strength to the connection. This connector uses multiple triangles, and bends.

These and other objectives of the invention are achieved by simple and economical connectors that allow a builder or home owner to quickly and easily secure the weakest parts of a building against earth tremors and high winds. The weakest parts being the wall stud to sill, wall stud to floor plate, and wall corners to walls.

Advantages of each will be discussed in the description. Further objects and advantages of my invention will become apparent from a consideration of the drawings and ensuing description.

SUMMARY

A novel, right-angle, triangular connector containing tabs on the sides opposite the hypotenuse. One embodiment has two triangles connected at their hypotenuses by a bend, and tabs. Another embodiment has two triangles connected by a web. The tabs have nail holes for attaching to intersecting structural members on a building. When fastened to the structural members, the connector forms a gusset containing multiple intersecting triangles. The multiple triangles provide multi-angles of stiffness. The connector helps prevent movement of the structural members during seismic and wind events.

BRIEF DESCRIPTION OF THE DRAWINGS

FIG. 5D Top view of a channel gusset on intersecting structural members.

FIG. 5E Back view of a channel gusset.

Figure 1A:
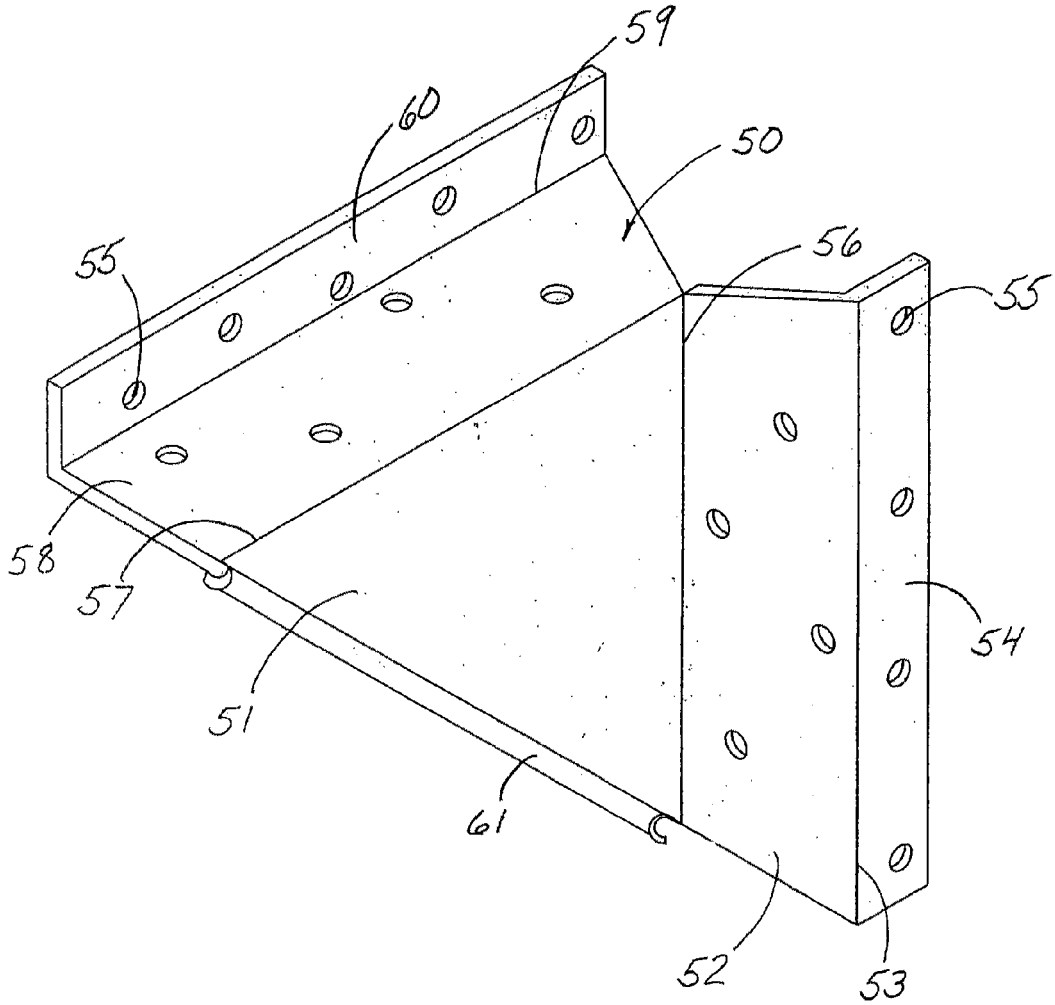
FIG. 1A Perspective view of a singular gusset.

| Reference Numerals in Drawings | |
|---|---|
| 1. | Multipurpose gusset |
| 2. | Right triangle |
| 3. | Lower right tab |
| 4. | Upper right tab |
| 5. | Nail hole |
| 6. | Center bend |
| 7. | Lower right bend |
| 8. | Upper right bend |
| 9. | Lower left tab |
| 10. | Lower left bend |
| 11. | Left triangle |
| 12. | Upper left tab |
| 13. | Upper left bend |
| 14. | Right cut |
| 15. | Left cut |

-continued

| Reference Numerals in Drawings | |
|---|---|
| 16. | Upper cut |
| 17. | Lower cut |
| 18. | Versatile gusset |
| 18A. | Long tab |
| 18B. | Short tab |
| 19. | Channel gusset |
| 20. | Right triangle |
| 21. | Left triangle |
| 22. | Channel relief |
| 23. | Nail hole |
| 24. | Right inner tab |
| 24A. | Inner tab bend |
| 25. | Left inner tab |
| 26. | Middle bend |
| 27. | Adjustable gusset |
| 27A. | Value gusset |
| 28. | First gusset bend |
| 29. | Dividing strip |
| 29A. | Lower strip tab |
| 29B. | Upper strip tab |
| 30. | Second gusset bend |
| 31. | Unequal gusset |
| 31A. | Short side |
| 31B. | Long side |
| 32. | Knee gusset |
| 33. | Post gusset |
| 34. | Wide dividing strip |
| 35. | Bottom tab |
| 35A. | Bottom tab bend |
| 36. | Top tab |
| 36A. | Top tab bend |
| 37. | Pyramid gusset |
| 38. | Right upper tab |
| 39. | Left upper tab |
| 40. | Left upper bend |
| 41. | Right upper bend |
| 42. | First middle bend |
| 43. | Second middle bend |
| 44. | Right triangle |
| 45. | Middle triangle |
| 46. | Left triangle |
| 47. | Left lower tab |
| 48. | Middle tab |
| 49. | Right lower tab |
| 50. | Singular gusset |
| 51. | Middle triangle |
| 52. | First side tab |
| 53. | First side bend |
| 54. | First side web |
| 55. | Nail hole |
| 56. | First middle triangle bend |
| 57. | Second middle triangle bend |
| 58. | Second side tab |
| 59. | Second side bend |
| 60. | Second side web |
| 61. | Rolled edge |
| 62. | Corner gusset |
| 63. | Center triangle |
| 64. | First top tab |
| 65. | First top bend |
| 66. | Nail hole |
| 67. | Bottom tab |
| 68. | Bottom bend |
| 69. | Second top tab |
| 70. | Second top bend |
| 71. | Truss gusset |
| 72. | Right top tab |
| 73. | Left top tab |
| 74. | Right top bend |
| 75. | Left top bend |
| 76. | Bottom right tab |
| 77. | Bottom left tab |
| 78. | Bottom right bend |
| 79. | Bottom left bend |
| 80. | Right triangle |
| 81. | Left triangle |
| 82. | Right triangle bend |
| 83. | Left triangle bend |

-continued

| Reference Numerals in Drawings | |
|---|---|
| 84. | Middle triangle |
| 85. | Right rafter web |
| 86. | Left rafter web |
| 87. | Roof gusset |
| 88. | Brace gusset |
| P. | Post |
| J. | Joist |
| H. | Horizontal beam |
| V. | Vertical beam |
| S. | Sheathing |
| A. | Angled board |
| R. | Rafter |
| T. | Thread |
| N. | Nail |
| B. | Brace |

DETAILED DESCRIPTION

The present invention is a sheet metal retrofit connector for joining intersecting structural members on a building, such as a wall stud and mud sill on a cripple wall. During an earthquake, the cripple wall can rack and fall down. The house then collapses.

This invention is installed between the header joist and the sill, the header joist and the joists, the sill and wall stud, or the plate and the stud. The invention can be installed on any structural member that meets another member at a right angle. One embodiment can work on roof rafters at different angles.

The invention is a gusset composed of a triangle with tabs. The triangle provides strength while the tabs have nail holes for attachment to the intersecting structural members. A single triangle is strong, but multiple triangles, at an angle to each other provide even more strength. Several different embodiments can be made from the same basic design, with only small changes to the flat pattern layout, or slight changes in the bend of the tabs.

Refer now to FIG. 1A which shows a perspective view of a singular gusset 50. A single right triangle called the middle triangle 51, has tabs 52 and 58 attached to two sides. The first side tab 52 and second side tab 58 are attached to the sides of the middle triangle 51 by right angle bends 56 and 57 respectively. Attached to the tabs 52 and 58, opposite the right angle bends 56 and 57, are side webs 54 and 60 respectively. The first side web 54 is attached to the first side tab 52 by a right-angled first side bend 53. The second side web 60 is attached to the second side tab 58 by a right-angled second side bend 59.

A rolled edge 61 along the hypotenuse of the middle triangle 51 adds strength to the unsupported edge of the middle triangle 51. Bending and rolling the edge work-hardens the metal and helps absorb and transfer tension and compression loads to either side of the middle triangle 51.

Figure 1B:
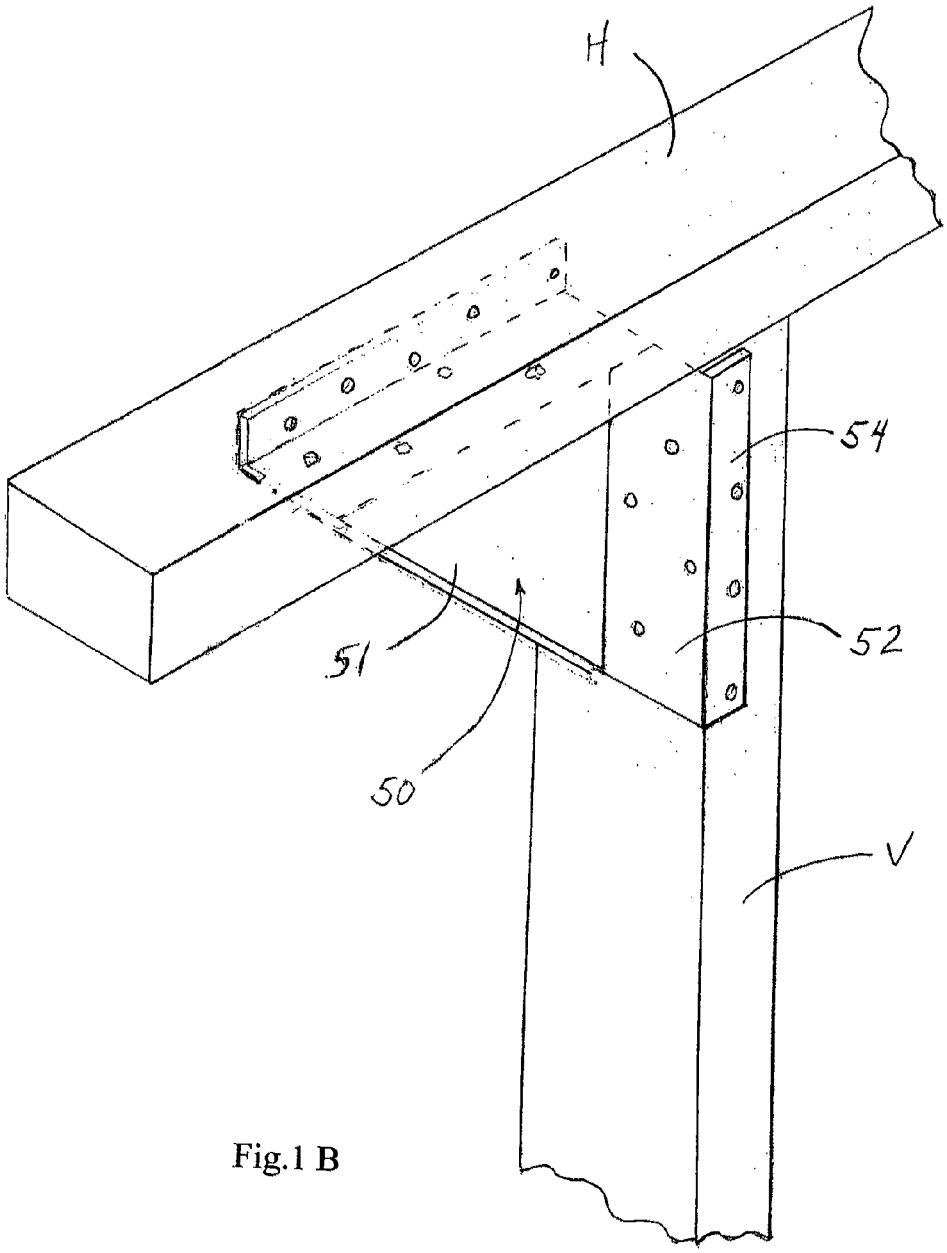
FIG. 1B Perspective view of a singular gusset on intersecting structural members.

Refer now to FIG. 1B which shows a perspective view of a singular gusset 50 installed onto intersecting structural members H and V. The singular gusset 50 is installed by placing the first side web 54 and first side tab 52 on the corner of the vertical member V and sliding the singular gusset 50 up. On the horizontal structural member H, on the side opposite the first side web and tab 52 and 54, the second side web 60 and second side tab 58 (hidden on the backside in this figure), will be placed along the corner.

After nails are driven through the nail holes 55, half of the bottom of the horizontal beam H, and half of the adjacent side of the horizontal beam H will be grasped. Also, half of the facing side of the vertical beam V, and half of the adjacent side will be grasped by the singular gusset 50. For added strength, another singular gusset 50 could be added onto the other side of the structural members. It would be mirror image, with the first side tab and web 52 and 54 on the hidden side of the vertical member V, and the second side tab and web 58 and 60 on the visible side of the horizontal member H.

The attachment of the tabs 52 and 58 and webs 54 and 60, and the middle triangle 51 help prevent twisting of the two beams; help prevent the horizontal beam from lifting, or rocking; and helps absorb and transfer wind and seismic forces into the foundation. On many buildings, there is only one or two nails driven from the top of the horizontal member H (wall plate) into the vertical member V (wall stud). A singular gusset 50 can tie both structural members tightly together to help prevent movement and absorb forces.

Figure 1C:
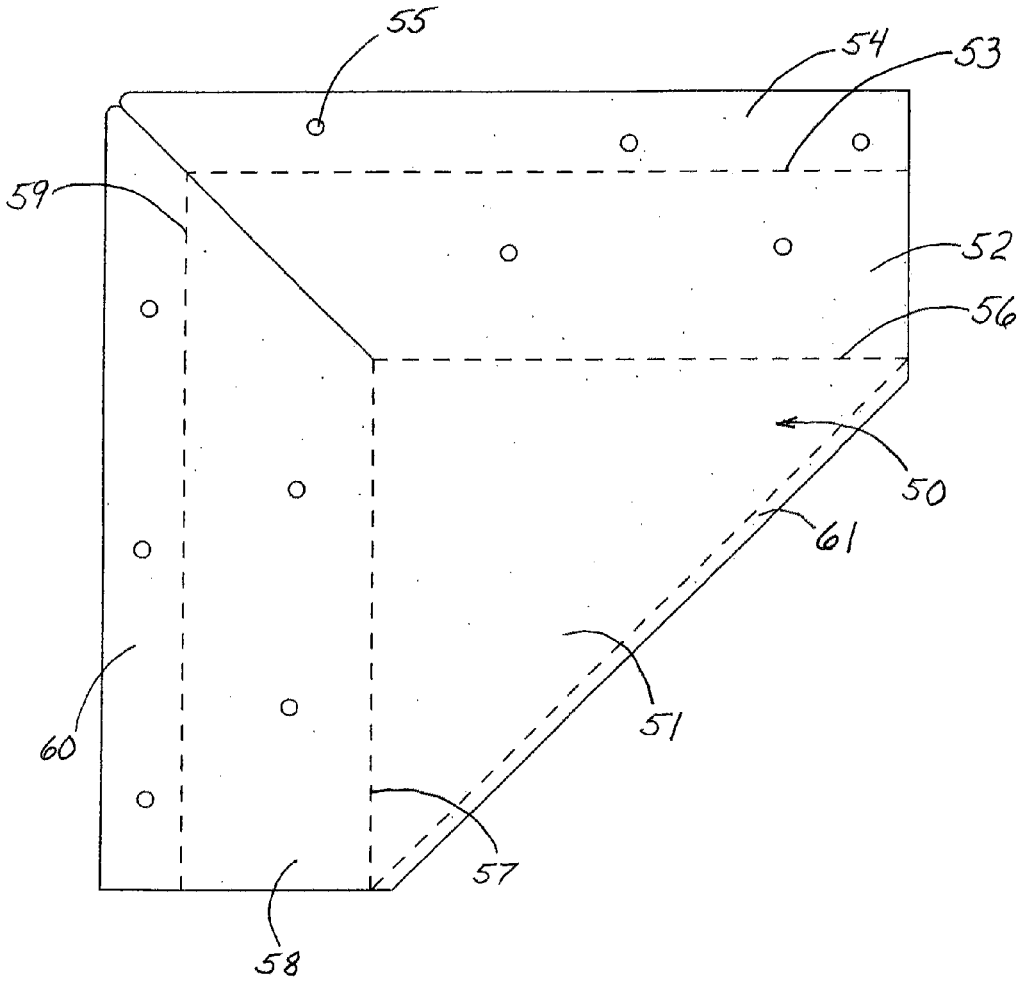
FIG. 1C Flat pattern layout of a singular gusset.

Refer now to FIG. 1C which shows a preferred flat pattern layout of a singular gusset 50 before bending along the dashed lines and cutting along the solid lines.

Figure 2A:
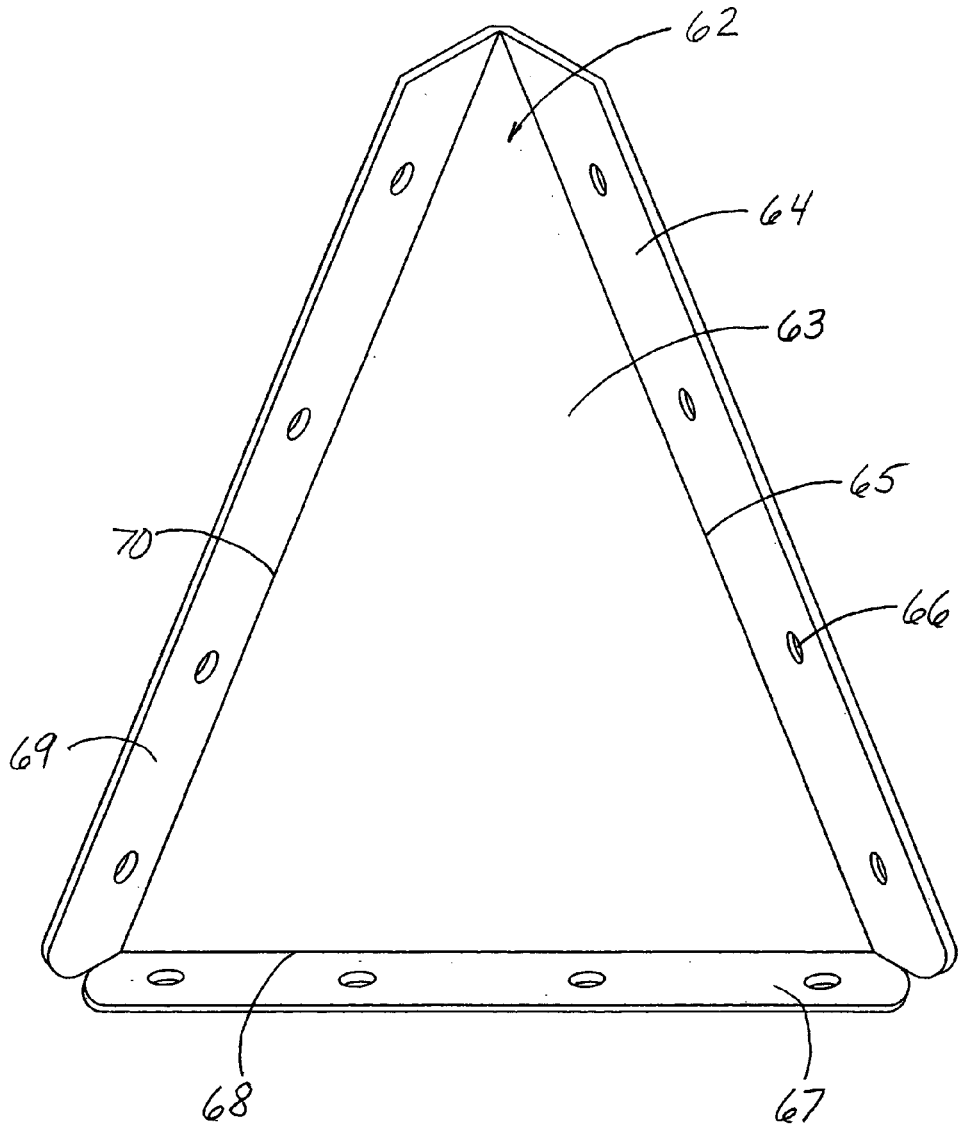
FIG. 2A Front view of a corner gusset.

Refer now to FIG. 2A which shows a front view of a corner gusset 62. The corner gusset 62 has a single triangle, like the singular gusset 50, but the corner gusset 62 has tabs on three sides of the triangle. Also, the triangle 63 on the corner gusset 62 is not a right-triangle. The three tabs 64, 67, and 69 are bent away from the triangle 63 at an acute angle, along bends 65, 68 and 70 respectively. The three tabs 64, 67, and 69 are bent perpendicular to each other.

Figure 2B:
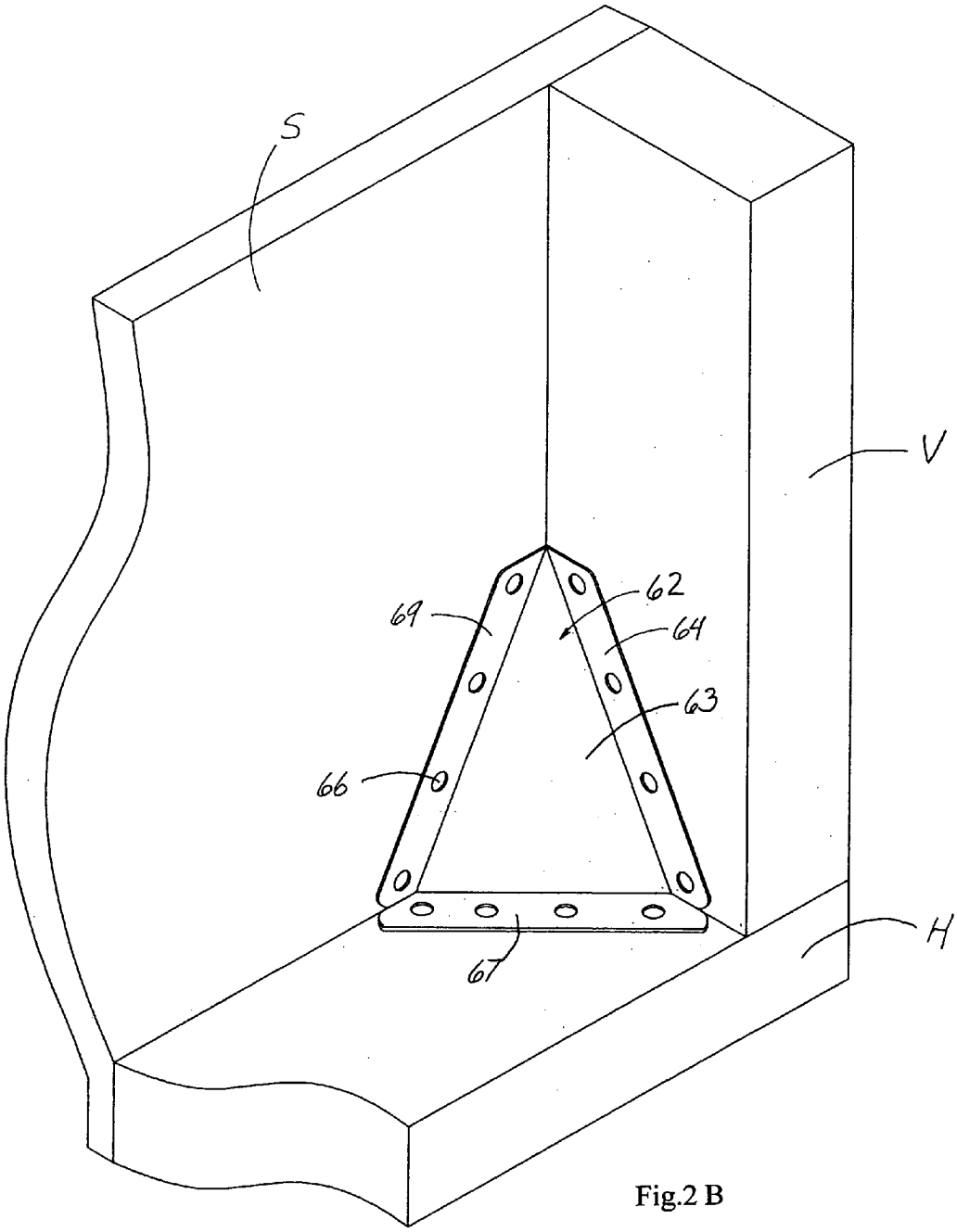
FIG. 2B Perspective view of a corner gusset on intersecting structural members.

Refer now to FIG. 2B which shows a corner gusset 62 attached to three intersecting structural members. The three members are perpendicular to each other. The corner gusset 62 is installed by sliding into a corner so the first top tab 64 and second top tab 69 are against adjacent vertical members V and S. Then the corner gusset 62 is slid down so the bottom tab 67 is against the horizontal member H.

FIG. 2B could show a sill plate H, a wall stud V, and wall sheathing S. When the corner gusset 62 is joined to the three structural members with nails through the nail holes 66, the corner gusset 62 is bracing all three structural members against movement. The wall stud V is prevented from lifting, rocking side to side, or moving away from the vertical sheathing S by the center triangle 63 and the attached tabs 64, 67, and 69. The sheathing S is prevented from lifting, moving side to side, or from detaching from the vertical stud V and horizontal plate H by the center triangle 63, and the attached tabs 64, 67, and 69.

Figure 2C:
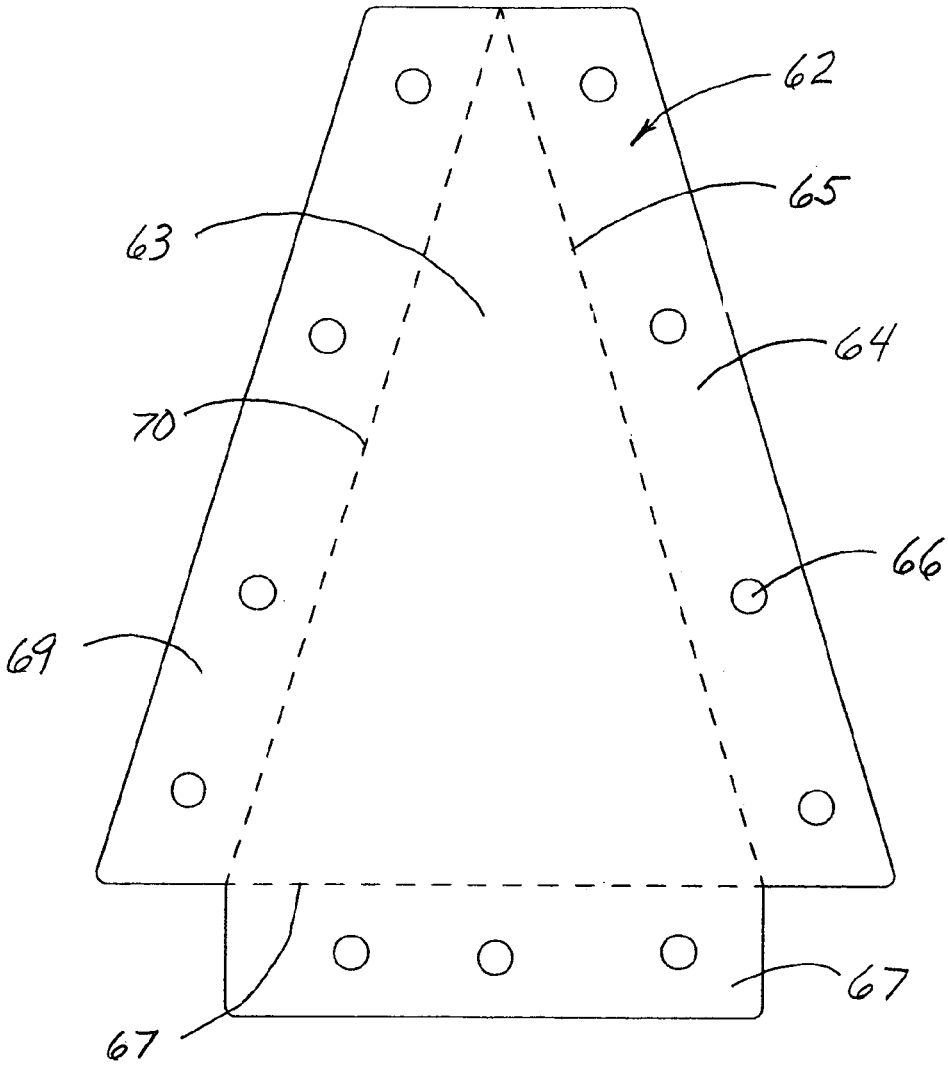
FIG. 2C Flat pattern layout of a corner gusset.

Refer now to FIG. 2C which shows a preferred flat pattern layout of a corner gusset 62 before bending on the dashed lines and cutting on the solid lines.

Figure 3A:
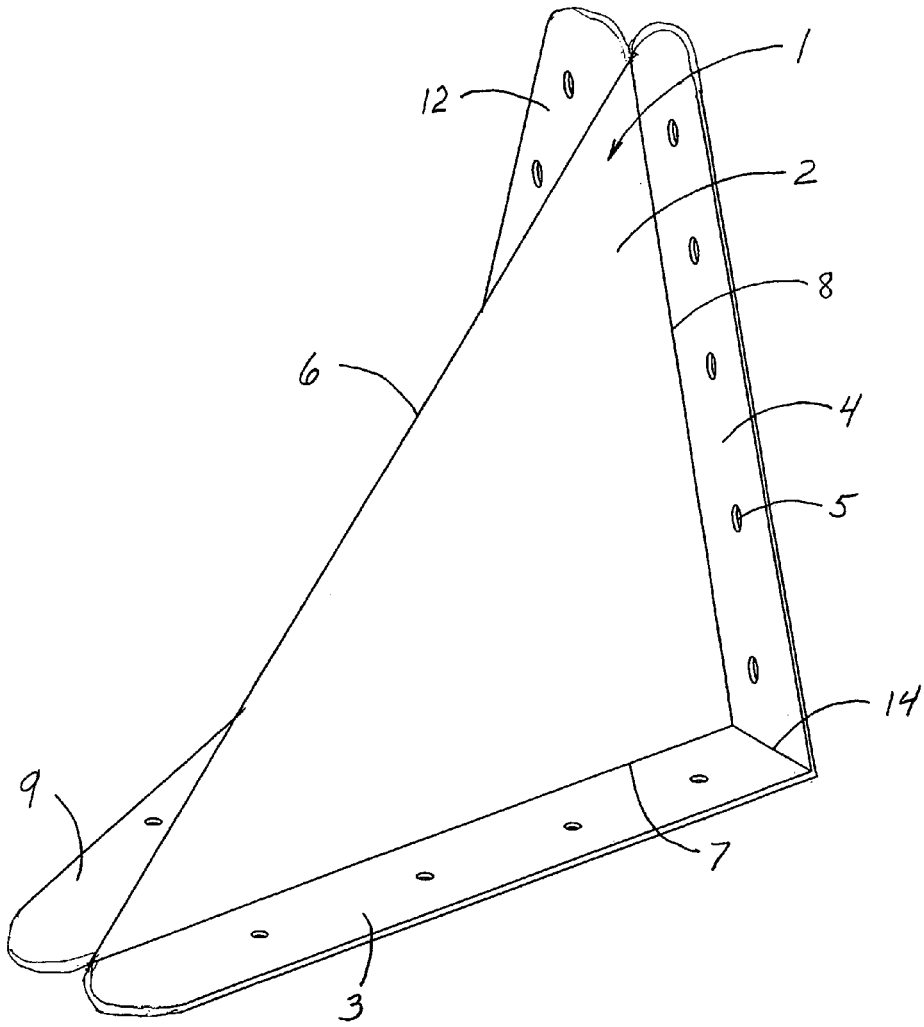
FIG. 3A Perspective view of an multipurpose gusset.

Refer now to FIG. 3A which shows a perspective view of a multipurpose gusset 1. The multipurpose gusset 1 has two triangles attached along their hypotenuses, with tabs along their sides. A triangle 2 can be seen with the long end of the triangle running from the upper right to the lower left. This long side is attached to another, similar triangle on the hidden side by a center bend 6 along both long sides. Tabs 4, 3, 9 and 12 can be seen along the shorter sides of the triangles.

Figure 3B:
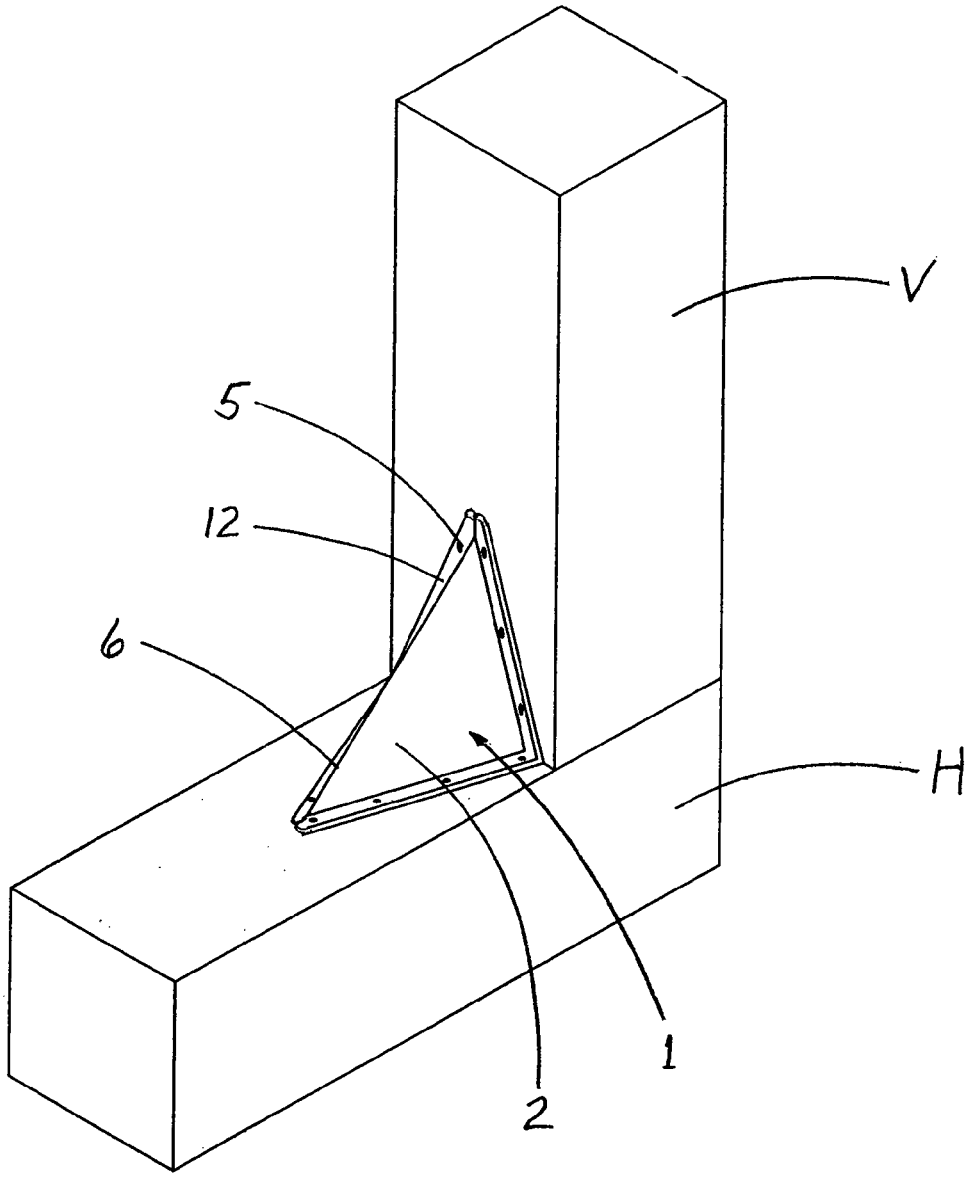
FIG. 3B Perspective view of an multipurpose gusset on intersecting structural members.

Refer now to FIG. 3B which shows a multipurpose gusset 1 attached to two intersecting structural members. The multipurpose gusset 1 is attached to the intersecting structural members by placing the right angle of the multipurpose gusset 1 against the right angle formed by the intersecting structural members. The multipurpose gusset 1 is then centered on the beams so that the tabs 3, 4, 9, and 12 are in nailing position on the members. If the members are narrower than normal, the left triangle 11 (hidden in this figure) and the right triangle 2 can be adjusted in or out at the center bend 6 so that the tabs fit onto the beams.

This view shows how the upper tabs 4 and 12 of the multipurpose gusset 1 form the top webs of a triangle against the surface of the vertical structural member V. The lower web of the triangle is the junction of the upper tabs 4 and 12, and the lower tabs 3 and 9. The junction of the two structural members H and V also form the lower web of the triangle against the vertical member V.

The lower tabs 3 and 9 form two webs of a triangle against the surface of the horizontal structural member H. The other web of the triangle is the junction of the upper tabs 4 and 12, and the lower tabs 3 and 9. The junction of the two structural members H and V also form the other web of the triangle against the horizontal member H. When the tabs 3, 4, 9, and 12 are fastened to the structural members H and V by nails through nail holes 5, the multipurpose gusset 1 forms four triangles at the intersection of the two structural members.

The four triangles at the two intersecting members prevent movement between the vertical and horizontal members H and V. There are two triangles 2 and 11 on the multipurpose gusset 1, and a triangle is formed by the upper tabs 4 and 12, and another triangle is formed by the lower tabs 4 and 12 against the intersecting line of the vertical and horizontal members. At least one triangle is preventing movement and detachment between the vertical and horizontal member.

Triangles 2 and 11 prevent the vertical member V from racking, or moving along the plane of the horizontal member. The triangle formed by upper tabs 4 and 12, and the lower tabs 3 and 9, prevent the vertical member V from moving perpendicular to the horizontal member H. All four triangles work together to help prevent twisting or lifting of the vertical member V.

The center bend 6 helps form stiffness between the right and left triangles 2 and 11, and help prevent the vertical member V from moving toward the gusset 1 or away. Any seismic or wind event that tried to twist or move the vertical member V off the horizontal member H, or to the sides, would be prevented by a multipurpose gusset 1.

If the horizontal structural member H extends beyond the vertical member V, another multipurpose gusset 1 could be attached to the opposite side of the vertical member V for added strength. If another horizontal member branched off at a right angle to the horizontal member shown H, then another multipurpose gusset 1 could be attached to it and the vertical member V. That would be three gussets 1 on three sides of the vertical member V. And a fourth gusset 1 could be added if another horizontal member was attached toward the left.

Figure 3C:
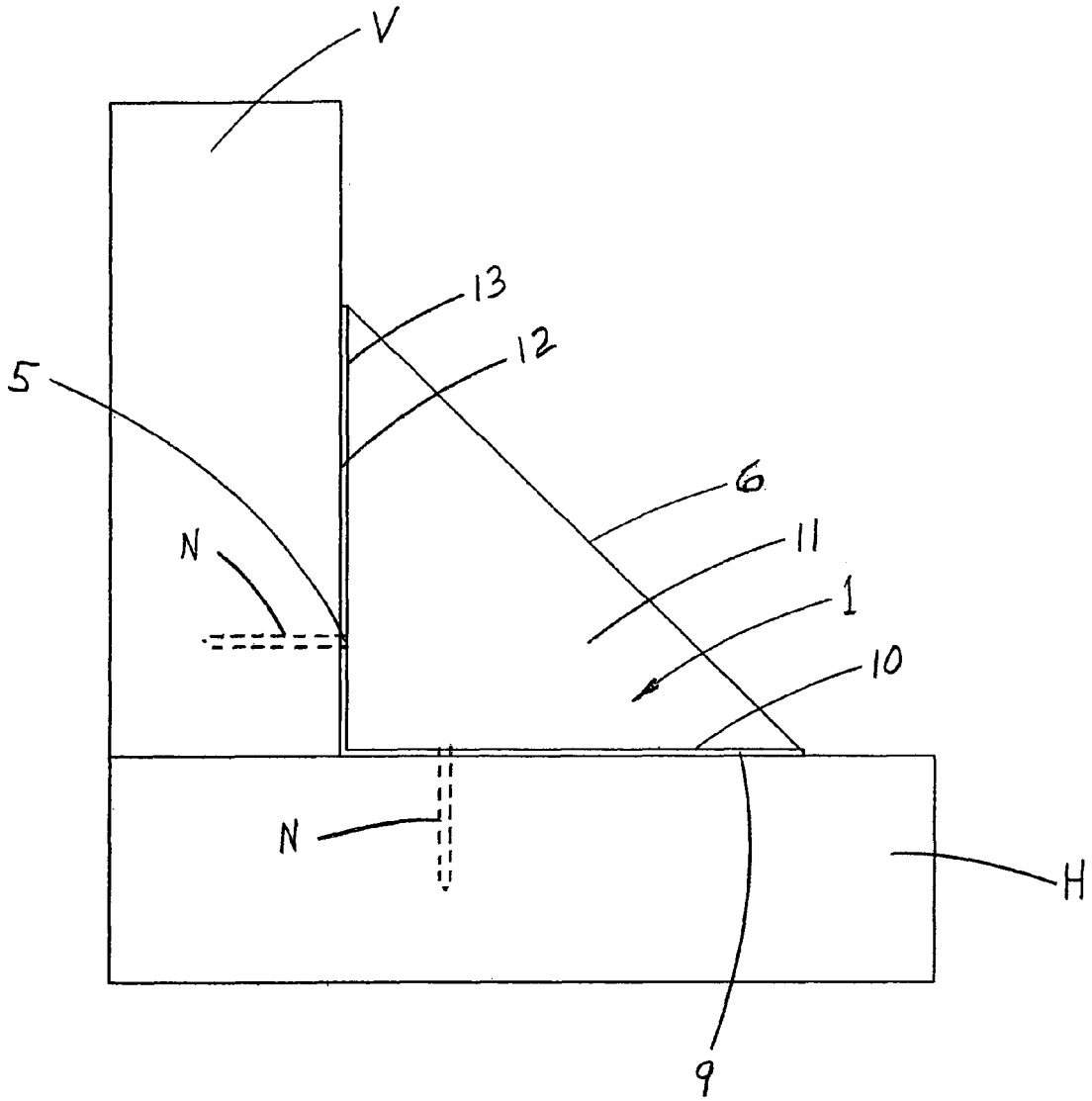
FIG. 3C Side view of an multipurpose gusset on intersecting structural members.

Refer now to FIG. 3C which shows a side view of an multipurpose gusset 1 attached to two intersecting structural members. This is a side view of the same gusset shown in FIG. 3B. But this is the side that was hidden. The center bend 6 is seen more clearly in this view, and it can be seen how it prevents the vertical member V from moving toward the horizontal member H. And the right angle of the left triangle 11 can be seen flush with the right angle of the two intersecting structural members V and H.

For clarity, only one nail or screw N is shown driven into each structural member through nail holes 5 in the lower left tab 9 and upper left tab 12 but many more can be used. The upper left bend 13 that forms the upper left tab 12, and the lower left bend 10 that forms the lower left tab 9 can be seen.

In this side view, the gusset 1 looks like a flat, triangular gusset, but as shown in FIG. 3B, the gusset 1 is very broad, mostly covering the wide part of the horizontal and vertical beams H and V. With four triangles against the attached horizontal and vertical structural members H and V, all connected and bracing each other, the attached multipurpose gusset 1 provides great strength to the connection.

Figure 3D:
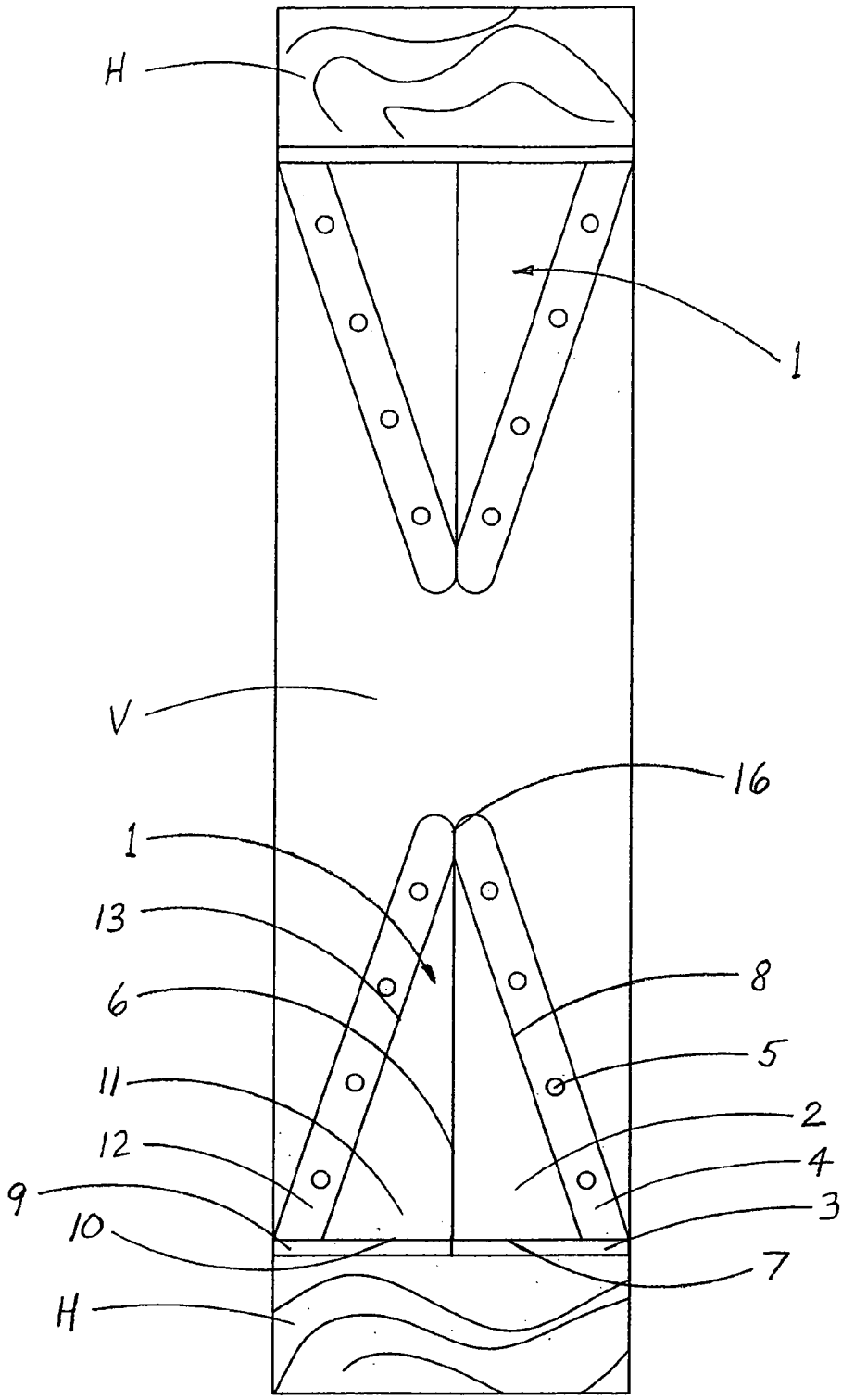
FIG. 3D Front view of two multipurpose gussets on intersecting structural members.

Refer now to FIG. 3D which shows a front view of two multipurpose gussets 1. Many homes in California are built with cripple walls, about two- to three-feet high. This creates a crawl space between the ground and the floor of the home. During an earthquake, the short, vertical studs can become disconnected from the horizontal mud sill on the bottom, and from the horizontal floor plate on the top.

FIG. 3D shows how a multipurpose gusset 1 could strengthen a cripple wall. The horizontal structural member H on the bottom could represent a wooden sill. The vertical structural member V could represent a stud. The horizontal structural member H on the top could represent a floor plate.

Looking along the center bend 6 of the lower multipurpose gusset 1, the lower right web 3 and lower left web 9 are attached to the sill H. The lower right bend 7 and lower left bend 10 form the lower webs 3 and 9 respectively. The right triangle 2 and left triangle 11 are attached to the respective lower webs 3 and 9.

The upper right web 4 and upper left web 12 are formed by the upper right bend 8 and upper left bend 13 respectively. Both webs 4 and 12 are attached to the vertical stud V by nails or screws through nail holes 5. The top multipurpose gusset 1 is attached likewise, but upside-down.

Both multipurpose gussets 1 have two triangles 2 and 11. And each forms a triangle against the stud V, as can be seen in FIG. 3D. Each gusset 1 also forms a triangle against each horizontal structural member H. That's a total of eight triangles bracing against these three structural members on this side. Triangles are well known to be strong. The four triangles at the top, and the four at the bottom of the structural members firmly connect and buttress each structural member against any movement as would occur during a seismic event.

The cripple wall in FIG. 3D is now much stronger, and can absorb and transfer stress from seismic action and wind storms without disconnecting. It can withstand up and down, left to right, front to back, and twisting motions.

Figure 3E:
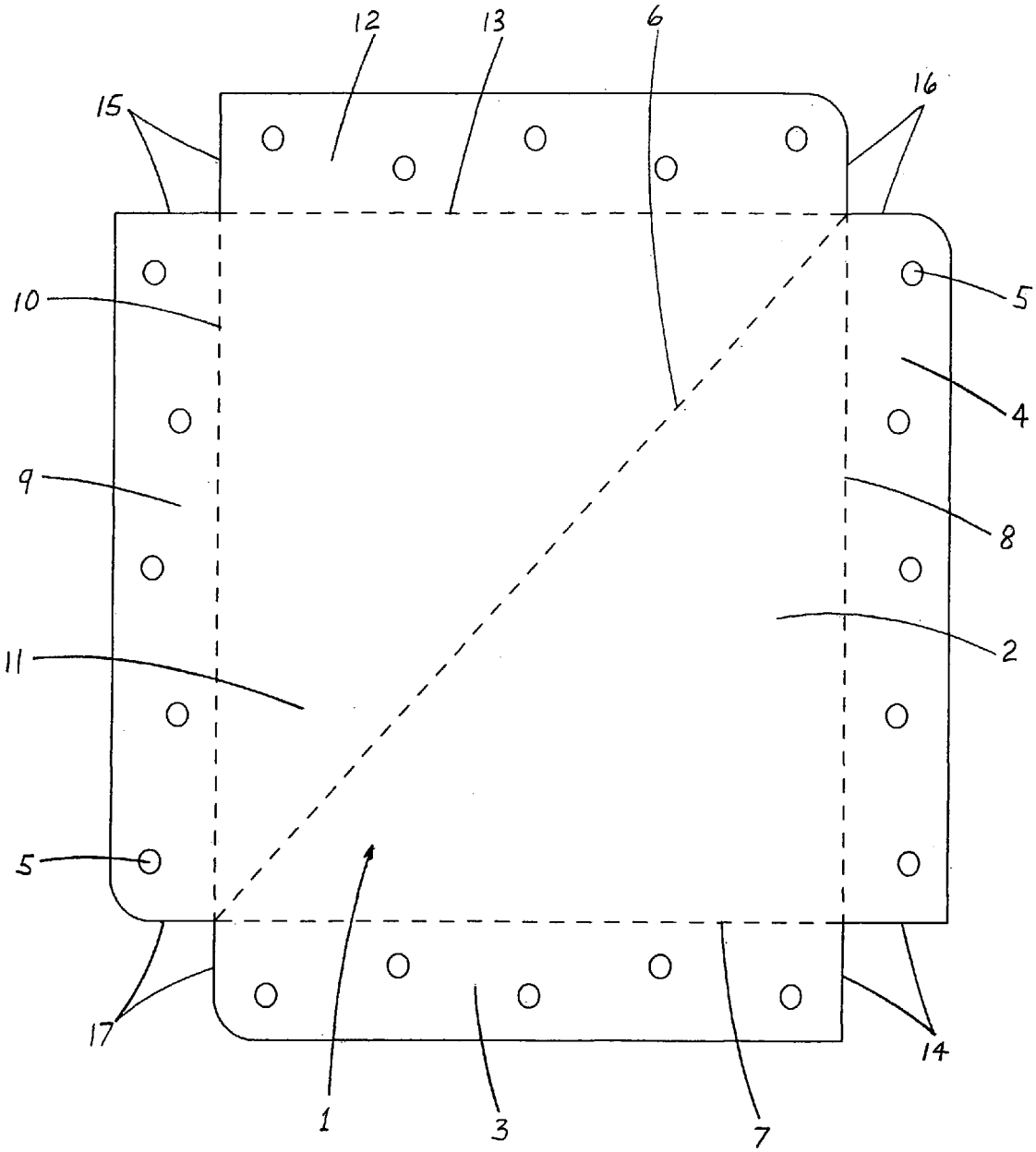
FIG. 3E Flat pattern layout of an multipurpose gusset.

Refer now to FIG. 3E which is a flat pattern layout of how a multipurpose gusset 1 could be made using standard tool and die methods. This shows the gusset 11 before bending along the center bend 6, the lower right bend 7, the upper right bend 8, the lower left bend 10, and the upper left bend 13.

The right cuts 14, left cuts 15, upper cuts 16, and lower cuts 17 have already been made. The layout also shows the relationship of the long sides of the triangles 2 and 11 forming the center bend 6. It also shows how the short sides of the triangles 2 and 11 form the tabs of the lower right web 3, upper right web 4, lower left web 9, and upper left web 12.

Figure 4A:
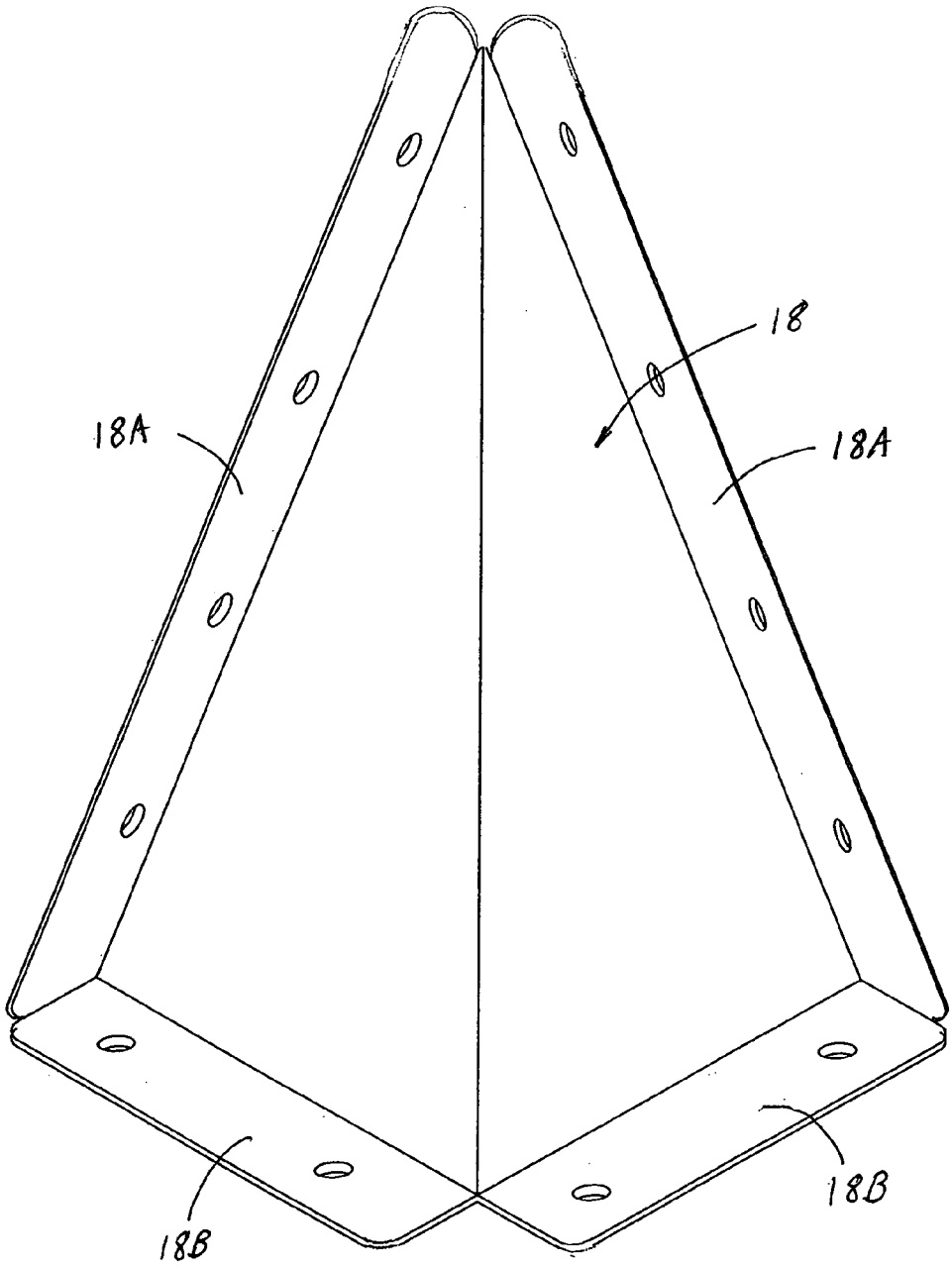
FIG. 4A Front view of a versatile gusset.

Refer now to FIG. 4A which shows a perspective view of a versatile gusset 18. This gusset is similar to a multipurpose gusset 1, except the versatile gusset 18 has unequal sides and tabs. The triangles still have right angles, and the sides and tabs opposite each other are equal, but the sides and tabs adjacent to each other are unequal.

Tabs 18B are shorter than tabs 18A. This allows the versatile gusset 18 to attach the narrow width of a structural beam to the wide width of a structural beam. FIG. 7C shows a similar gusset attaching a wide beam to a narrow beam.

Figure 4B:
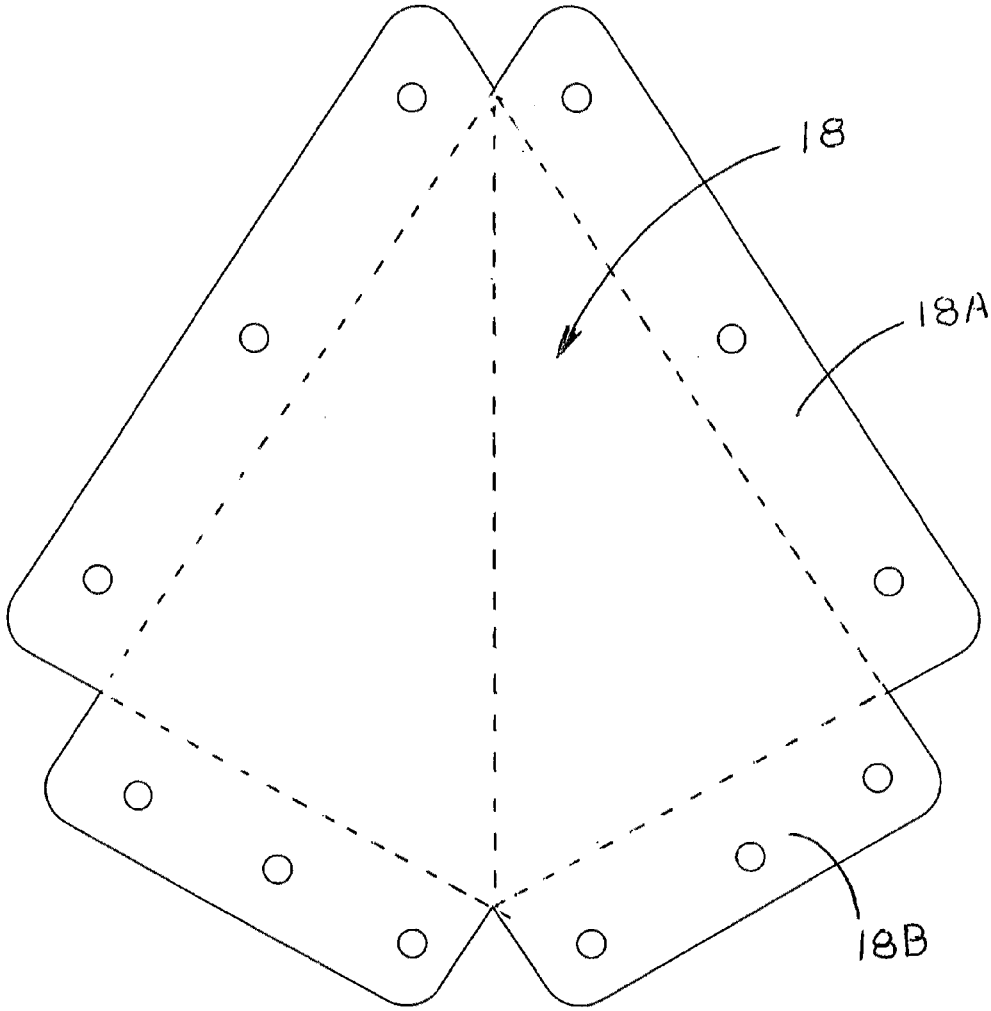
FIG. 4B Flat pattern layout of a versatile gusset.

Refer now to FIG. 4B which shows a flat pattern layout of a versatile gusset 18. Instead of a square shape of a multipurpose gusset 1 shown on FIG. 3E, the versatile gusset 18 has an arrowhead shape before bending.

Figure 5A:
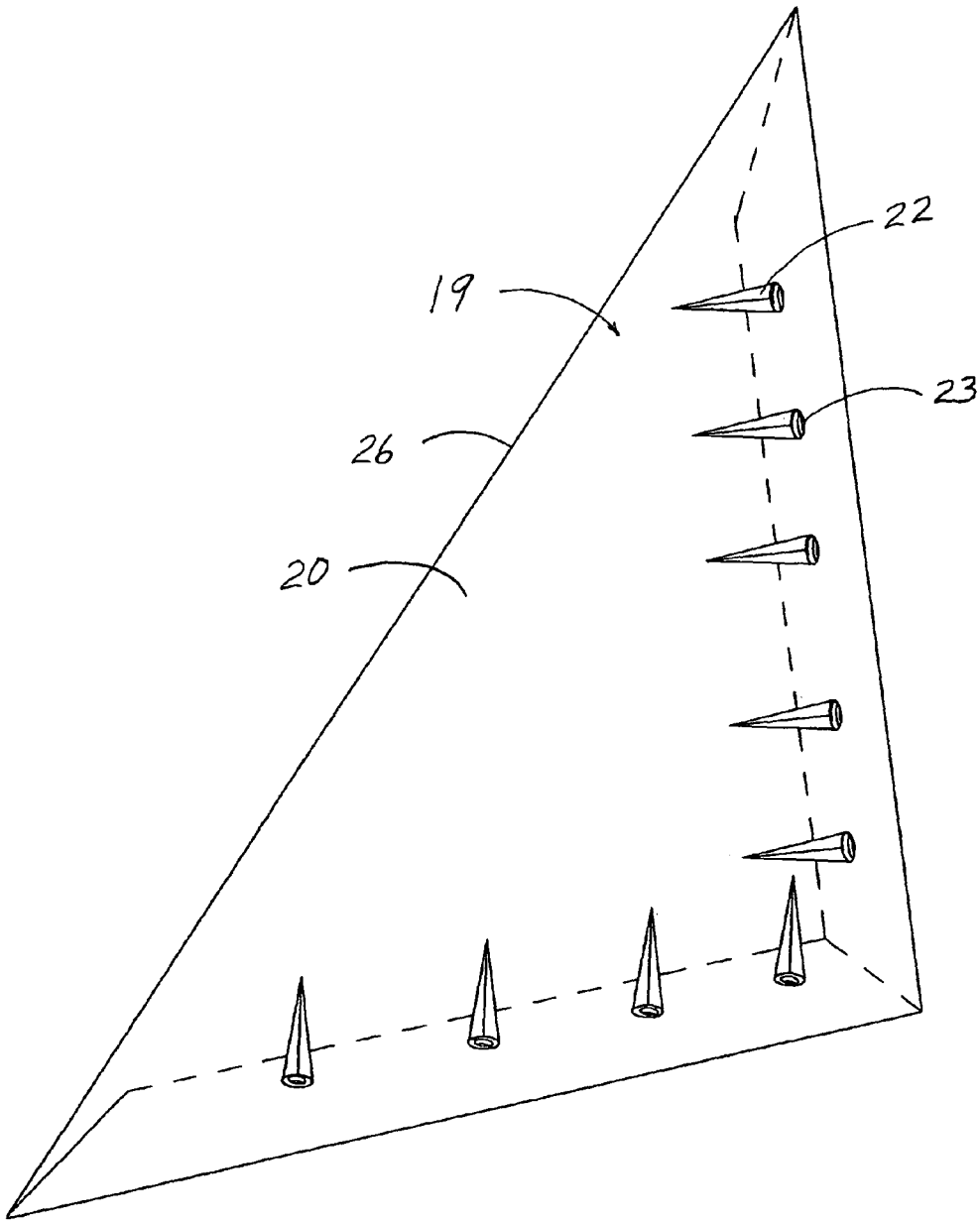
FIG. 5A Perspective view of a channel gusset.

Refer now to FIG. 5A which shows a perspective view of a channel gusset 19. The channel gusset 19 is similar to a multipurpose gusset 1, but the channel gusset 19 has no visible tabs. The tabs are folded underneath the triangles. This allows the triangles to be spread out more than the previous gusset embodiments, since there are no tabs on the outside of the triangles.

To attach the channel gusset 19 to intersecting structural members, the edges of the triangles have channel reliefs 22 angled into them, with nail holes 23 on the bottom. The channel reliefs 22 are perpendicular to the side of the triangle.

Figure 5B:
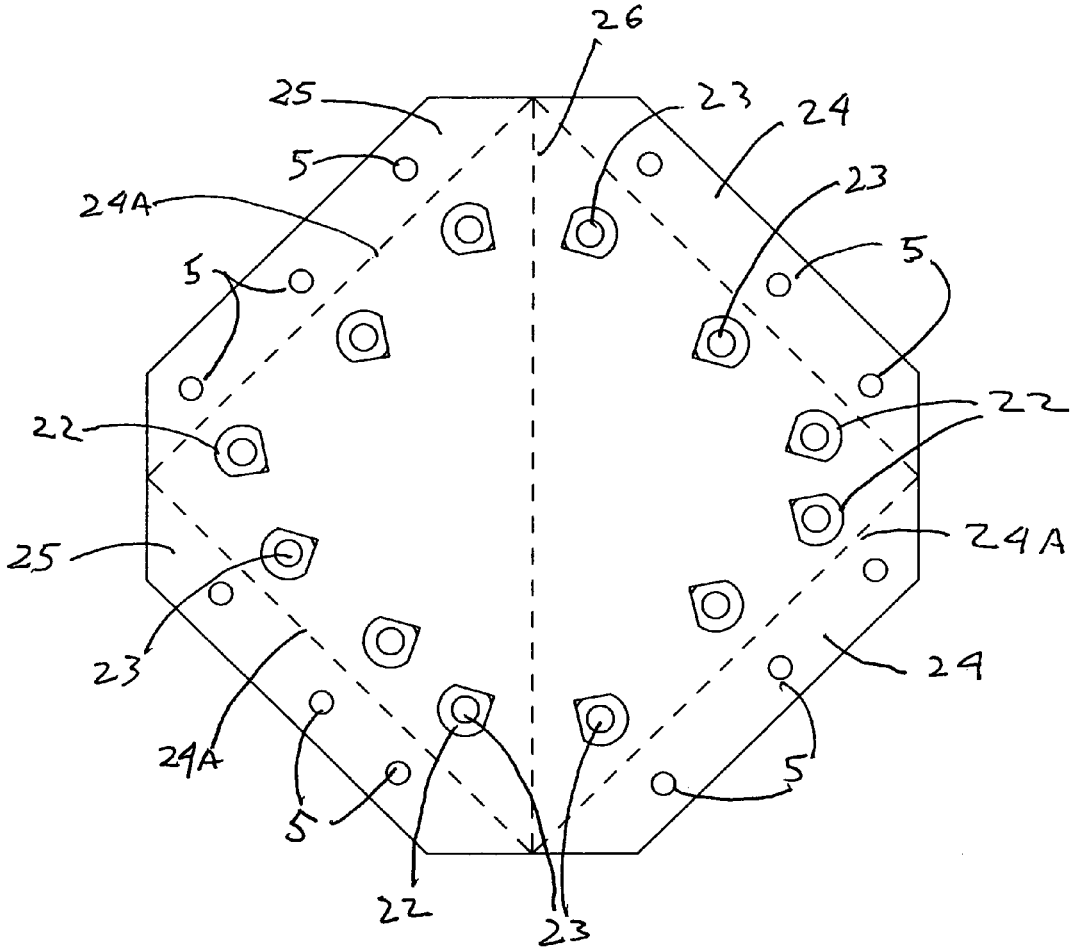
FIG. 5B Flat pattern layout of a channel gusset.

Refer now to FIG. 5B which shows a flat pattern layout of a channel gusset 19. The right inner tabs 24 and left inner tabs 25 are shown before being bent under the triangles 20 and 21 respectively, along the inner tab bends 24A. The nail holes 5, shown on the tabs 24 and 25, line up with the nail holes 23 in the channel reliefs 22. This adds extra strength to the channel gusset 19.

Figure 5C:
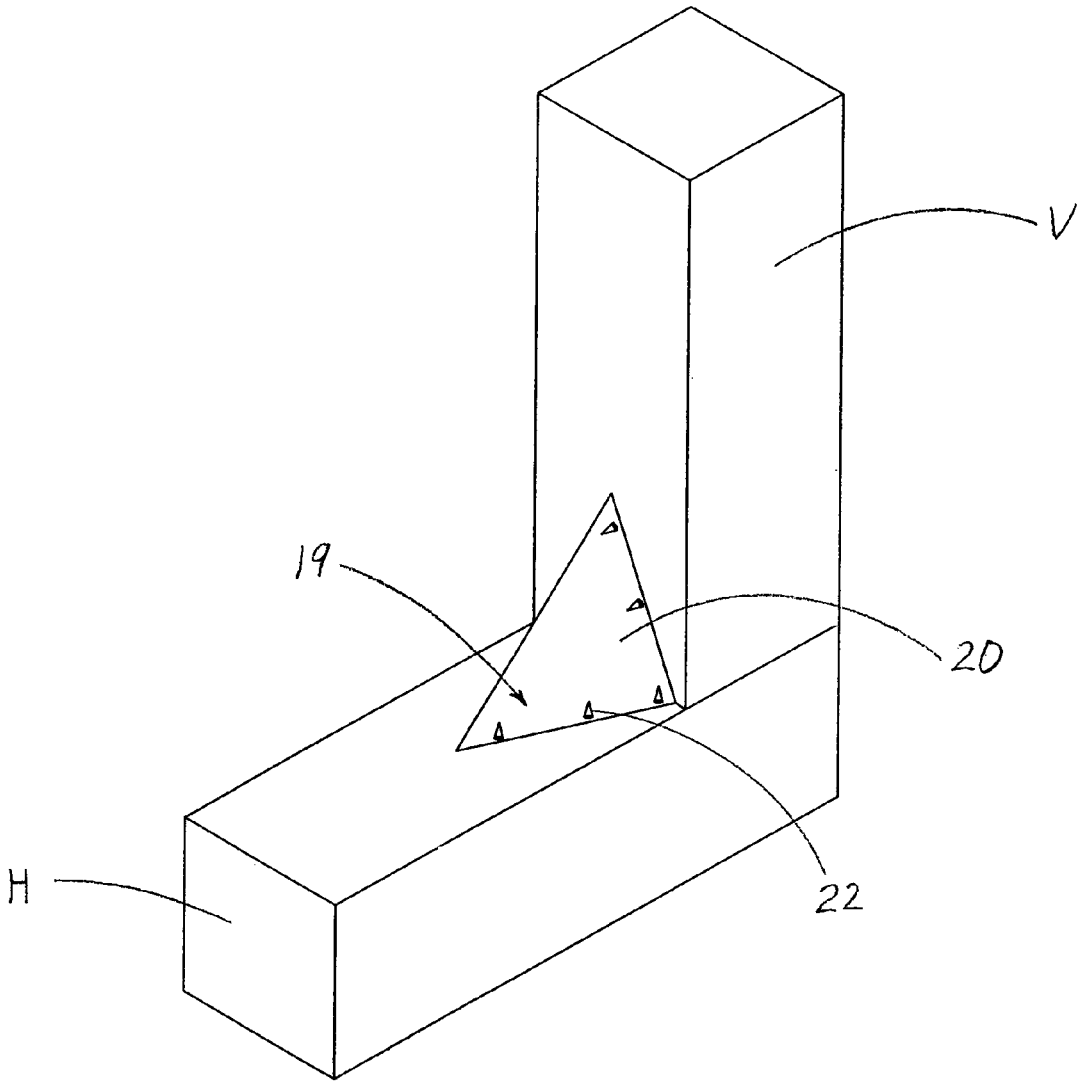
FIG. 5C Perspective view of a channel gusset on intersecting structural members.

Refer now to FIG. 5C which shows a perspective view of a channel gusset 19 attached to two intersecting structural members. The channel gusset 19 is installed so the right angles of the triangles are in the corner where the structural members meet and the gusset is centered on the boards as shown. The triangles 20 and 21 are close to the edge of the structural members because there are no tabs on the outside of the triangles. The channel gusset 19 has the left triangle 21 shown in this view. The left triangle 21 has channel reliefs 22 that look like tunnels. They are perpendicular to the structural members that they face. The channel reliefs 22 have circular clearance for rotation of a screwdriver or powered screw gun. The inner tabs 24 and 25 strengthen the sides of the triangles 20 and 21, and strengthen the bottom of the channel relief 22. A screw will go through the nail hole 23 at the bottom of the channel relief 22 and through the corresponding nail hole on the tab 24 or 25, for attachment to the structural member.

Figure 5E:
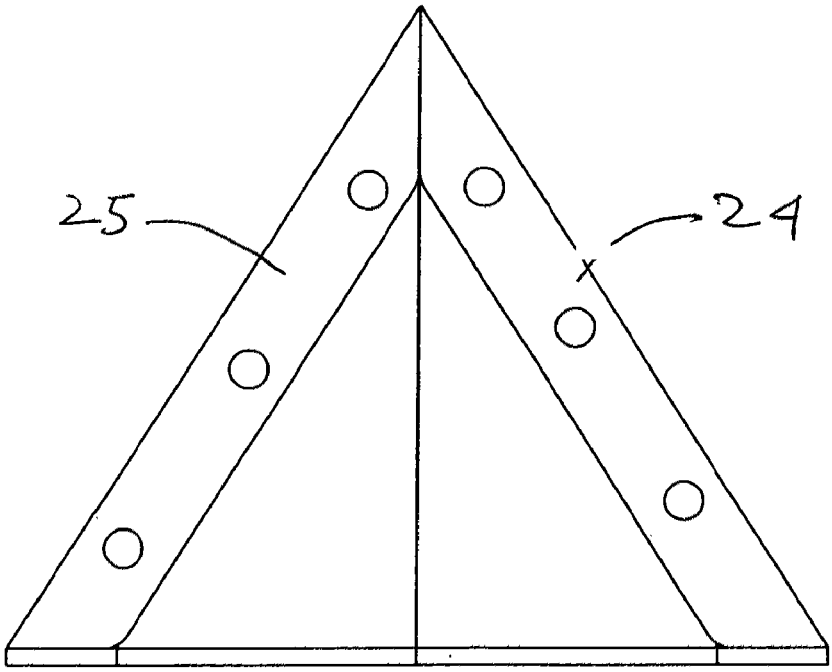
Figure 5D:
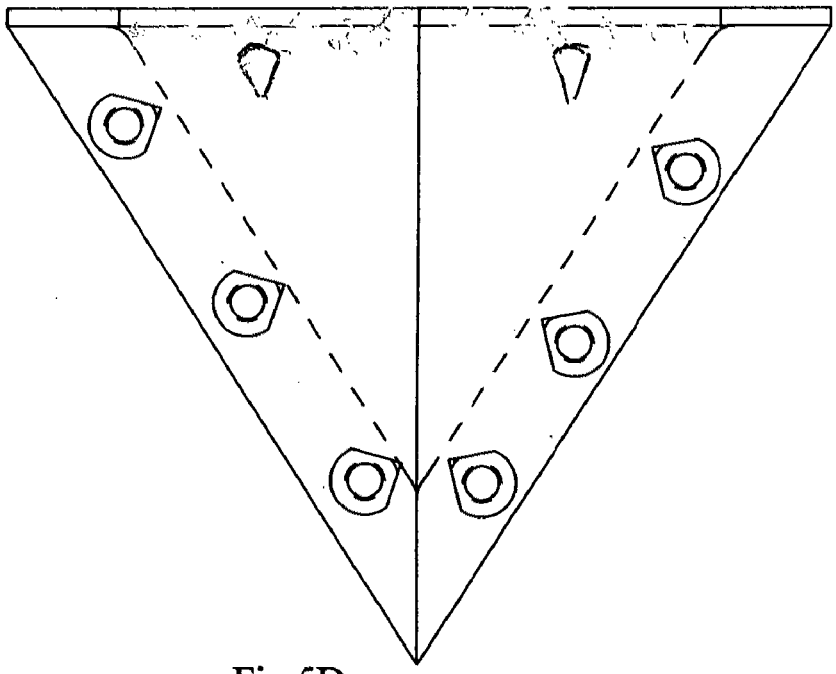

Refer now to FIG. 5D which shows a view looking perpendicular to the middle bend 26 on a channel gusset 19 after the tabs 24 and 25 have been bent under the triangles 20 and 21. This view shows the right triangle 21 and the left triangle 20. This view exaggerates looking down each channel 22 to the nail hole 23 on the bottom, since the tunnel-like channels are generally perpendicular to the flat ends of the sides of the triangles.

Refer now to FIG. 5E which shows a rear view looking into a channel gusset 19. The left inner tab 24 and right inner tab 25 are shown bent under the triangles 20 and 21. The nail holes 23 at the bottom of each channel 22 are shown lined up with the nail holes 5 of the tabs 24 and 25. The underneath of the middle bend 26 is also shown. The triangle shown, from the top of the figure to the edge of the sides, is one of the two triangles that the gusset makes against a vertical structural member. The other triangle that the bottom of the channel gusset 19 makes would be against a horizontal structural member.

Figure 6A:
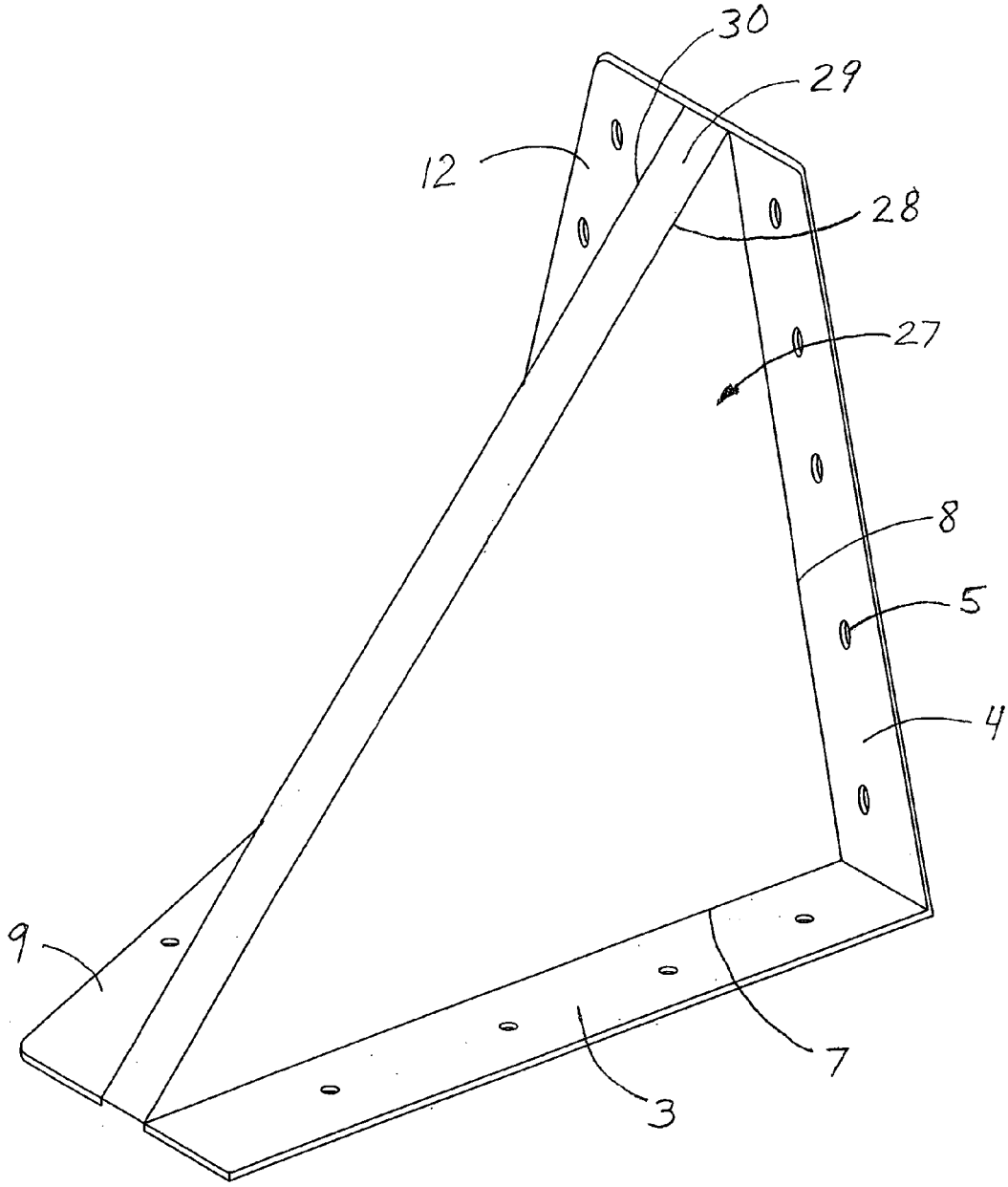
FIG. 6A Perspective view of an adjustable gusset.

Refer now to FIG. 6A which shows a perspective view of an adjustable gusset 27. The adjustable gusset 27 is similar to the multipurpose gusset 1, except the adjustable gusset 27 has two bends and a dividing strip connecting the longest sides of the two triangles. The two bends and the dividing strip between them add extra material along the bend, making it much stronger. This is the preferred embodiment.

The adjustable gusset 27 looks similar, attaches the same way, and attaches to the same intersecting structural members as a multipurpose gusset 1. The two bends 28 and 30 are generally parallel. The dividing strip 29 between the two bends helps prevent stress during forming. The dividing strip 29, first gusset bend 28, second gusset bend 30, right triangle 2, and left triangle 11 form half of a box-section, as viewed from underneath.

The half-box is formed where the dividing strip 29 meets the ends of the upper tabs 4 and 12. That is one corner. The next corner is formed where the dividing strip 29 meets the ends of the lower tabs 3 and 9. The third corner is formed where the upper tabs 4 and 12 meet the lower tabs 3 and 9. The width of the dividing strip 29 forms the width of the half-box shape. This adds great strength to the adjustable gusset 27.

Figure 6B:
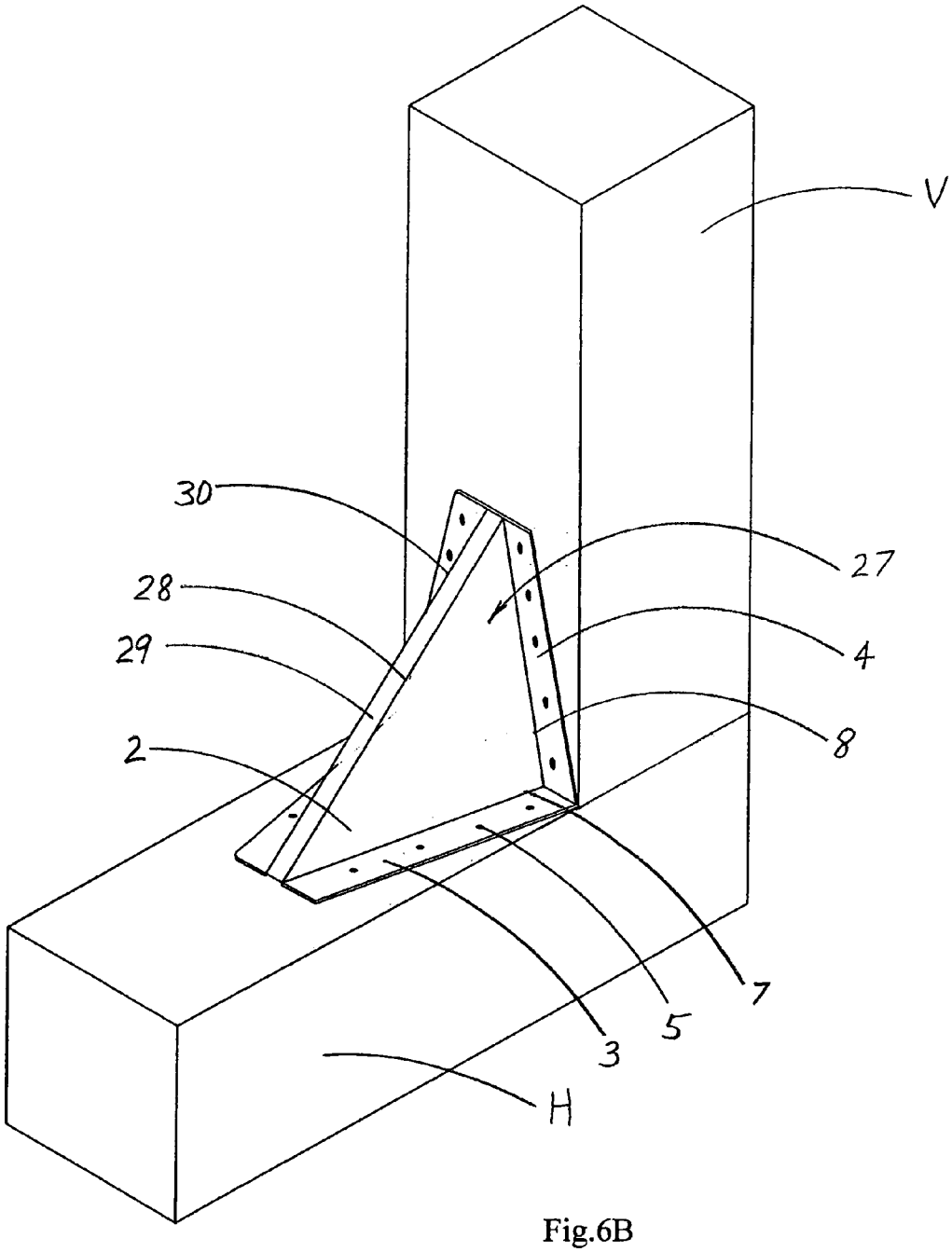
FIG. 6B Perspective view of an adjustable gusset on intersecting structural members.

Refer now to FIG. 6B which shows an adjustable gusset 27 connecting a horizontal structural member H to a vertical structural member V. The triangles 2 and 11 are similar to the multipurpose gusset 1. The tabs formed by the lower right bend 7 and the lower right web 3, and by the upper right bend 8 and upper right web 4 are also similar, and can be seen attached to each structural member by nails or screws through nail holes 5. The tabs on the left side are hidden from view. Connecting the sections of a wall and plate, helps prevent damage to a building from forces acting on a building.

The first gusset bend 28 and second gusset bend 30, and the dividing strip 29 connecting each bend, can be seen along the center of the adjustable gusset 27. The first gusset bend 28 and second gusset bend 30, and the dividing strip 29 form a box-section that is corner-shaped. Any stress, such as forces from a wind storm or seismic event, placed on the adjustable gusset 27 will be absorbed and redirected by the extra material, by the box-shape, and by the dividing strip 29, six bends 7, 8, 10, 13, 28, and 30, four triangles 2, 11, 4-12-intersecting structural members, and 3-9-intersecting structural members, and the attachment at four spaced-apart tabs 3, 4, 9, and 12.

Figure 6C:
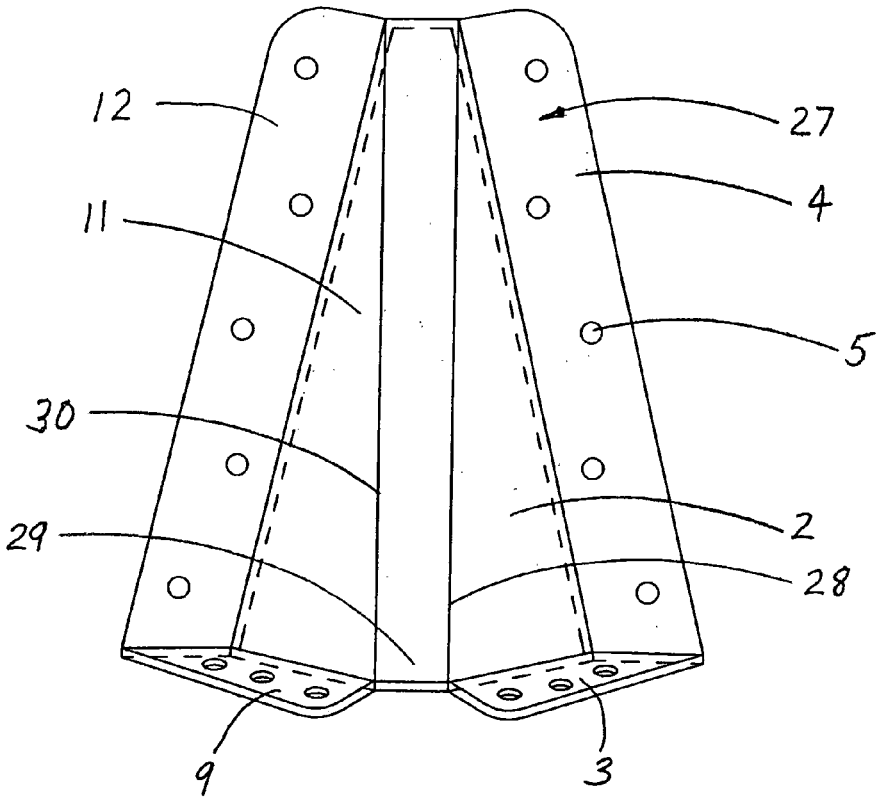
FIG. 6C Front view of an adjustable gusset.

Refer now to FIG. 6C which shows a front view of an adjustable gusset 27. The dividing strip 29 can be seen between the first gusset bend 28 and the second gusset bend 30. This view shows how the dividing strip 29 forms the edge of a box, and the bends 28 and 30 and the triangles 2 and 11 form the corner of the box, providing tremendous strength to the gusset 27. The dividing strip 29, the first gusset bend 28, and the second gusset bend 30 also form very stable triangles 2 and 11 against each attached structural member.

Figure 6D:
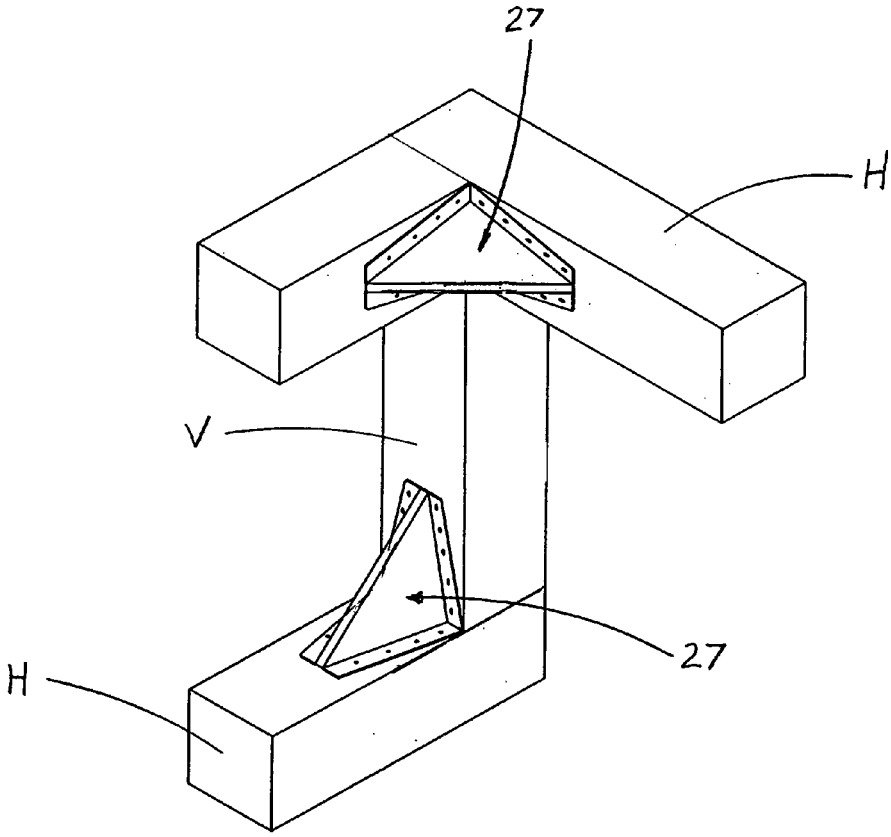
FIG. 6D Perspective view of two adjustable gussets on intersecting structural members.

Refer now to FIG. 6D which shows how an adjustable gusset 27 can be mounted vertically and horizontally. The adjustable gusset 27 is installed with the right angles of the triangles in the corner where the structural members meet. This places all the tabs for nailing into the structural members. Bracing corners of a building helps tie adjacent walls together. This can help turn each wall into a shear wall by helping keep the exterior wall sheathing from detaching due to twisting and movement of the structural beams. If the studs do not move or twist during seismic events, the sheathing may stay connected, helping the wall perform as a shear wall. Tying and bracing the corner, helps the walls absorb and transfer seismic forces to the ground.

Figure 6E:
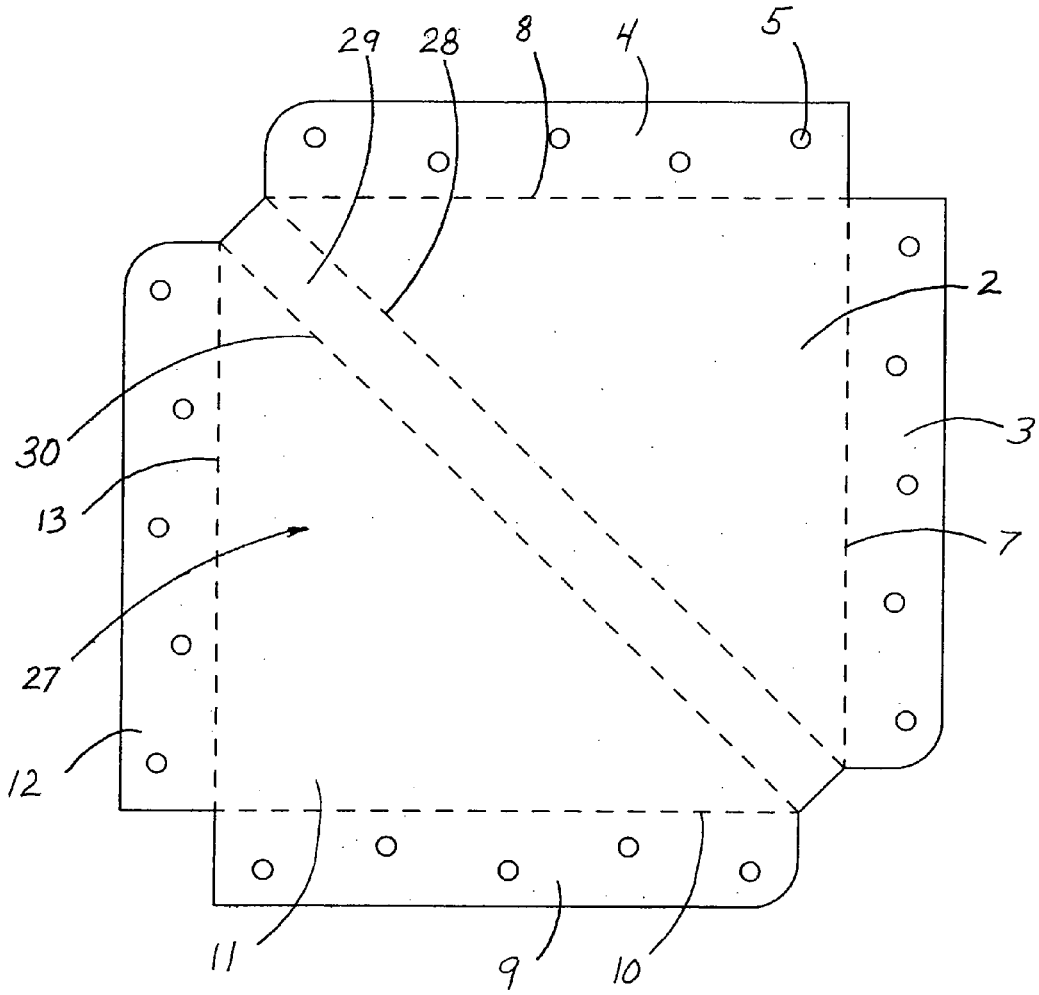
FIG. 6E Flat pattern layout of an adjustable gusset.

Refer now to FIG. 6E which shows a flat pattern layout of how an adjustable gusset 27 could be made using standard tool and die methods. Except for two bends 28 and 30, and the dividing strip 29 between them, the flat pattern layout of the adjustable gusset 27 is similar to the multipurpose gusset 1.

Figure 7A:
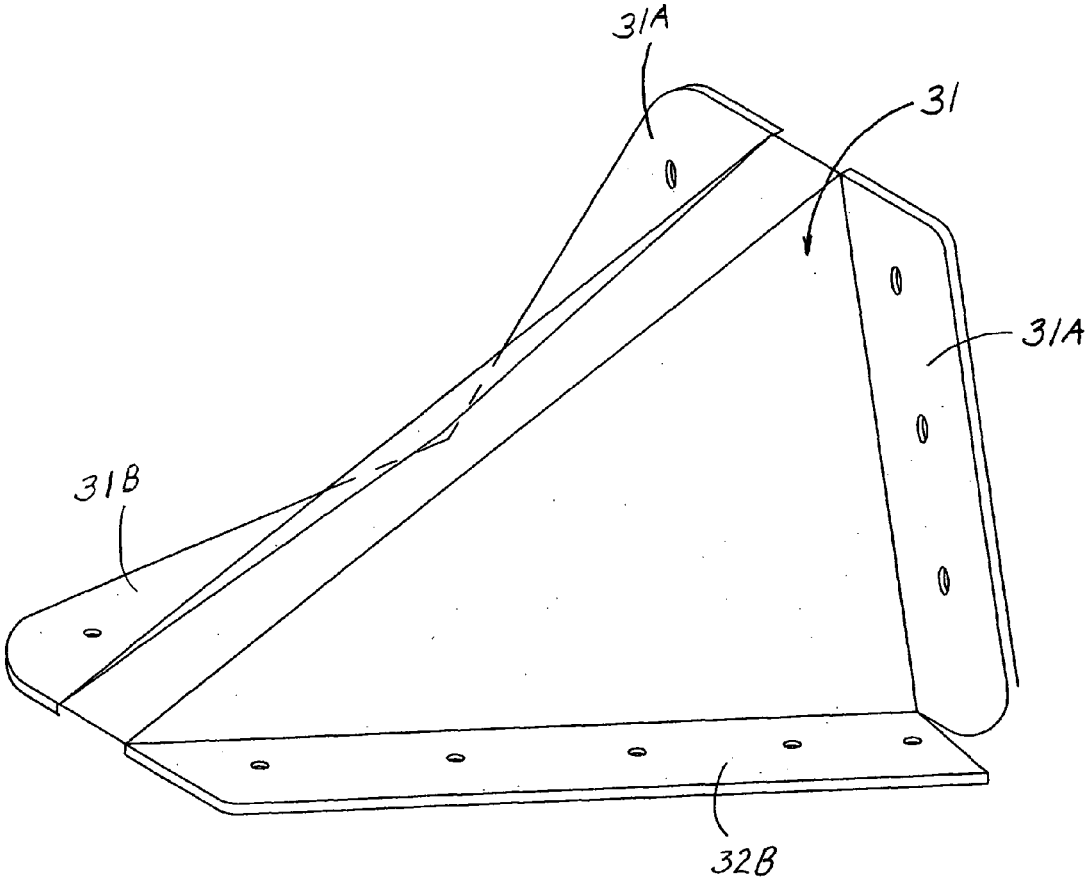
FIG. 7A Perspective view of an unequal gusset.

Refer now to FIG. 7A which is a perspective view of an unequal gusset 31. The unequal gusset 31 is similar to the adjustable gusset 27, except the sides of the triangle and length of the attached tabs 31A and 32A are not equal. The angle between the sides is still a right angle.

Figure 7B:
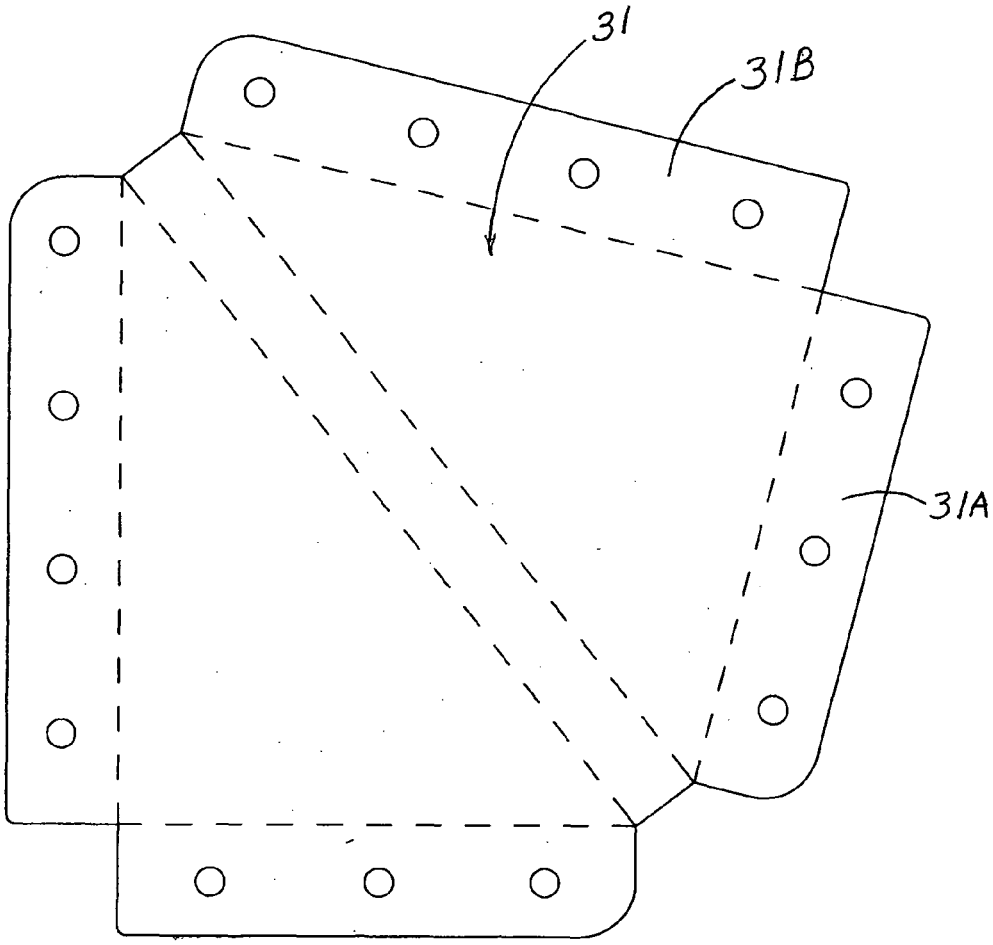
FIG. 7B Flat pattern layout of an unequal gusset.
Figure 7C:
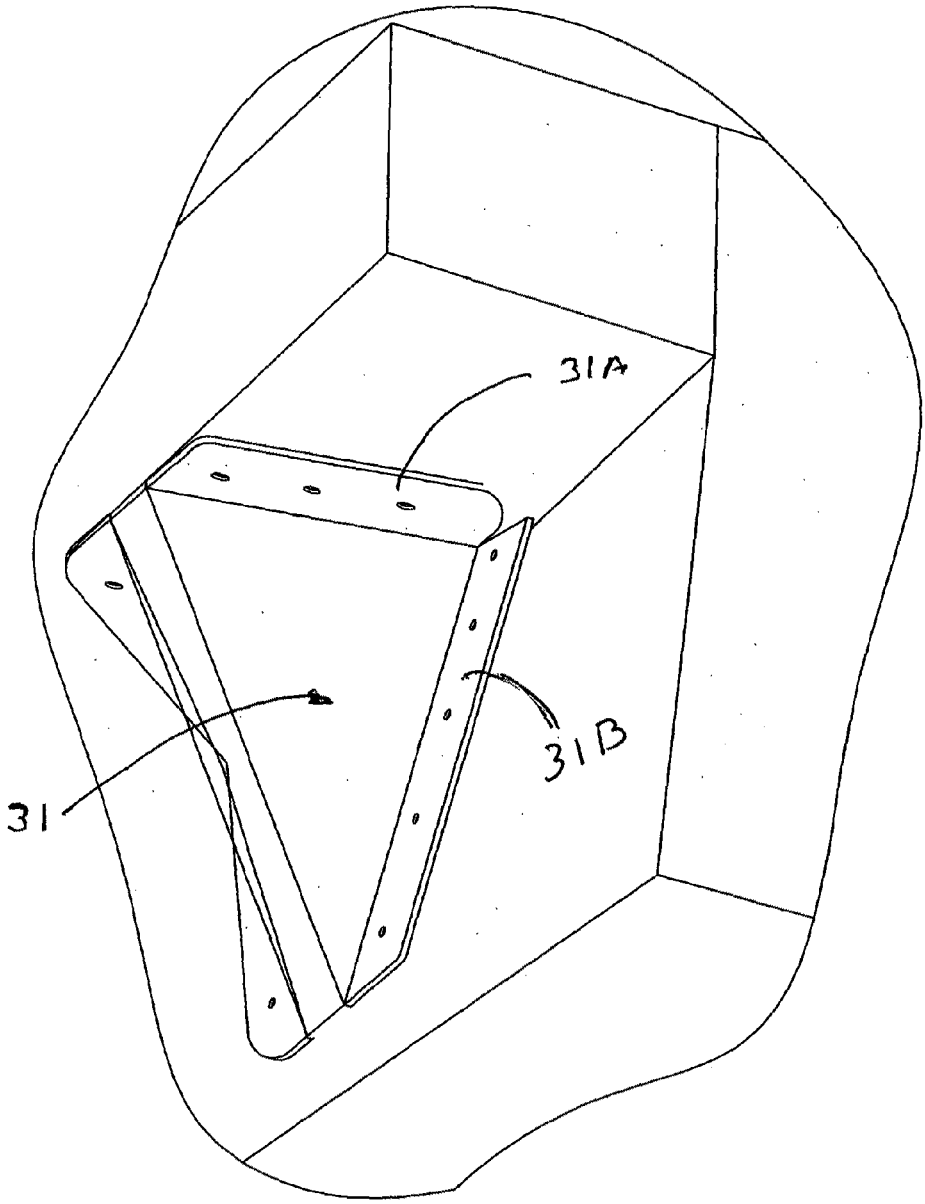
FIG. 7C Perspective view of an unequal gusset on two intersecting structural members.

Refer now to FIG. 7B which is a flat pattern layout of an unequal gusset 31. The unequal length of the triangles and attached tabs 31A and 31B can be seen.

Refer now to FIG. 7C which is a perspective view of an unequal gusset 31 on intersecting structural members. The long tabs 31B of the unequal gusset 31 are attached to the wide dimension of a horizontal member H. The short tabs 31A of the unequal gusset 31 are attached to the thin dimension of a horizontal member H.

Figure 8A:
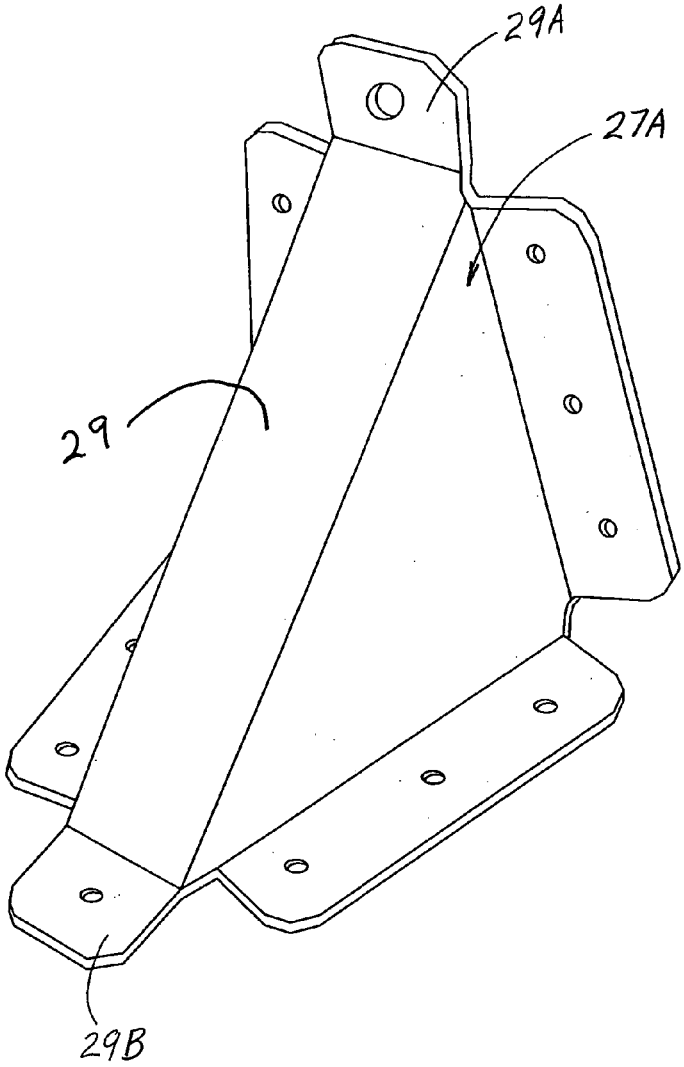
FIG. 8A Perspective view of a value gusset.

Refer now to FIG. 8A which shows a perspective view of a value gusset 27A. The value gusset 27A is similar to an adjustable gusset 27, except the value gusset 27A has tabs 29A and 29B attached to the ends of the dividing strip 29. These two tabs 29A and 29B give added nailing area and added strength to the value gusset 27A. This is the view of a value gusset 27A as it would be attached to vertical and horizontal structural members.

Figure 8B:
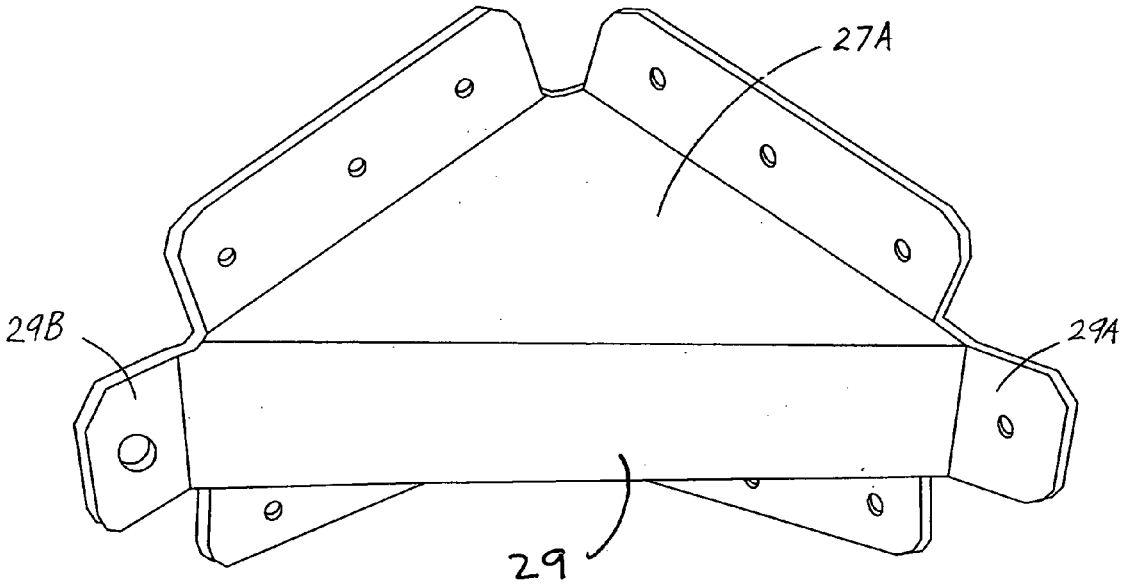
FIG. 8B Perspective view of a value gusset on the side.

Refer now to FIG. 8B which shows a side perspective view of a value gusset 27A. It can be seen that the gusset can be used horizontally and in a corner to tie together horizontal structural members.

Figure 8C:
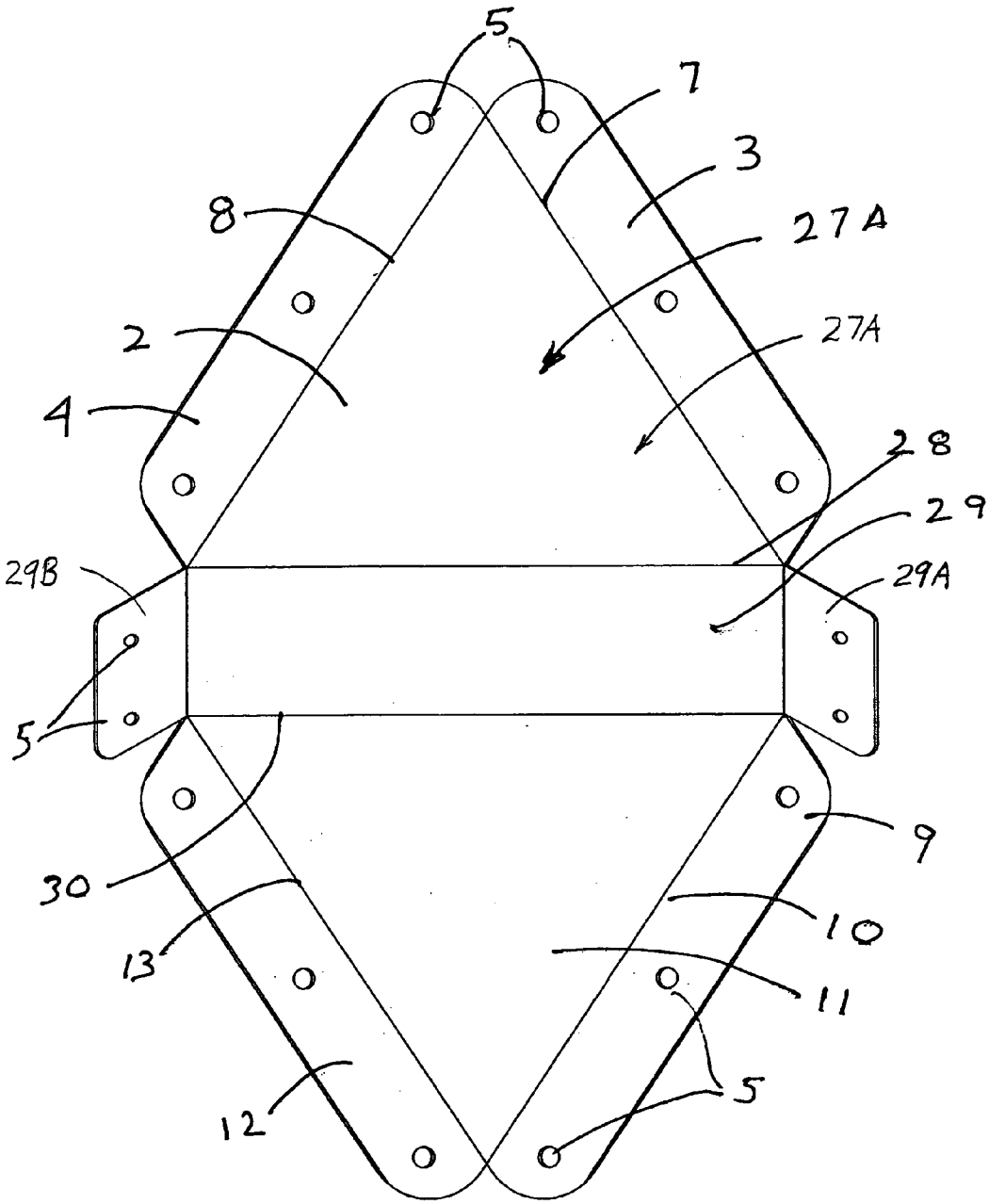
FIG. 8C Perspective view of a value gusset with triangles spread wide.

Refer now to FIG. 8C which shows a perspective view of a value gusset 27A with the triangles 2 and 11 spread apart. The angles at the first and second gusset bends 28 and 30 are obtuse. The obtuse angles allow the triangles 2 and 11 to be spread wide-apart and allow the nail holes 5 on the tabs 3, 4, 9 and 12 to be spread wide-apart on the structural members. The wide-spaced nailing gives added strength to the connection. The obtuse bends 28 and 30 allow the value gusset 27A to attach to wide structural members.

Figure 8D:
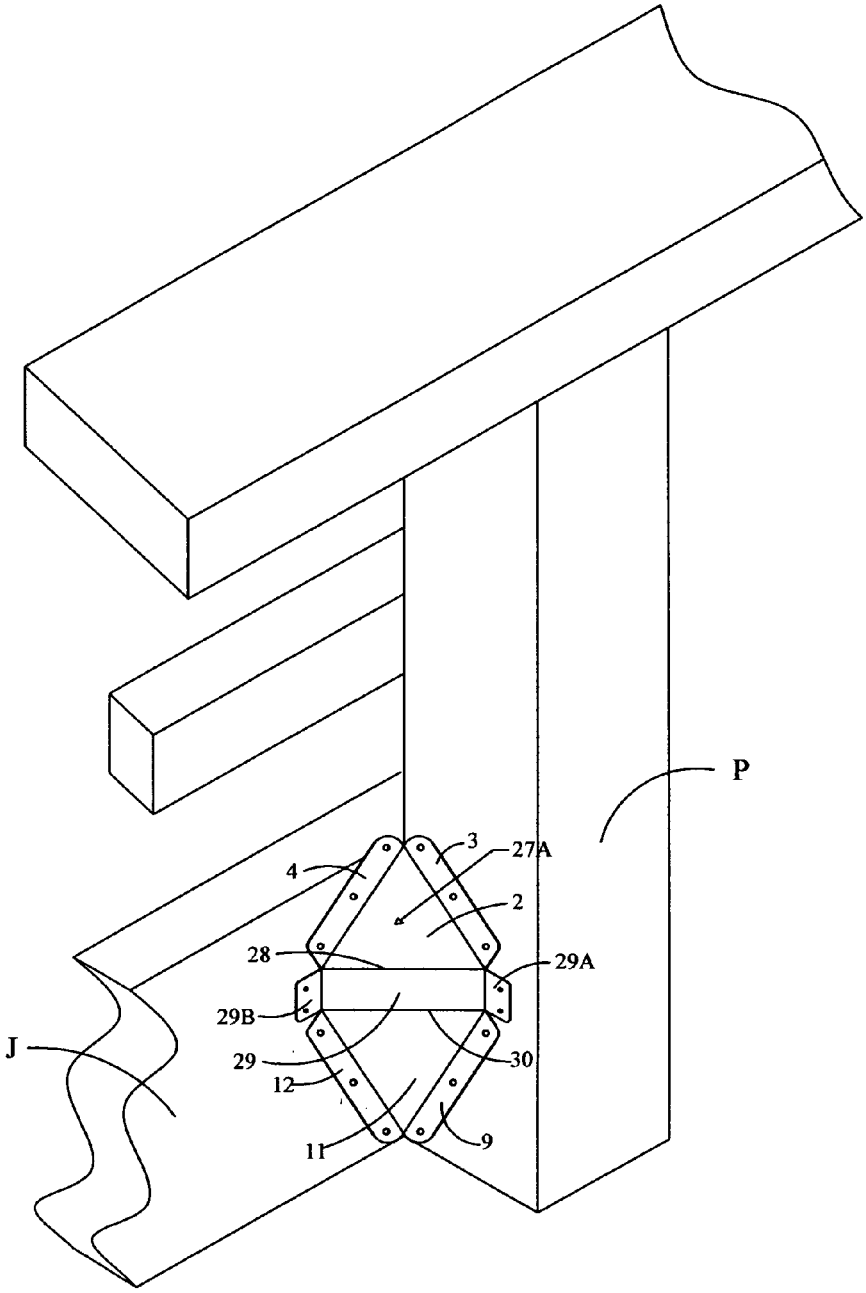
FIG. 8D Perspective view of a value gusset on intersecting structural members.

Refer now to FIG. 8D which shows a perspective view of a value gusset 27A attached to a post P and wide joist J as commonly found on a wood deck. The value gusset 27A is attached by putting the tabs on adjacent sides of adjacent structural members, so the right angle of the triangles is at the intersection of the structural members. Attachment of the posts on a deck has recently been shown to be the one of the weakest and most dangerous connections on a home. The posts are subject to crowds of people leaning and sitting against the post and attached railing. The value gusset 27A can be retrofitted to the sides of the post, railing, and joist.

The obtuse bends 28 and 30, and acute angle bends at the tabs, allow the upper left tab 12, the upper right tab 4, and upper strip tab 29B to all be in the same plane. Also, the lower right tab 3, lower left tab 9, and lower strip tab 29A are all in the same plane. That allows three tabs 12, 2, and 29B on one structural member, and three tabs 9, 3, and 29A on the other.

These three nailed tabs are widely-spaced on each structural member, which give the value gusset 27A and attached structural members high resistance to movement in any direction. The triangles 2 and 11 would have to be compressed or pulled apart under compression or tension, as would the dividing strip 29. The three tabs against each structural member also form two sides of a triangle against the member. Being exposed to the elements, rain or snow would run down the upper triangle 11.

Figure 8E:
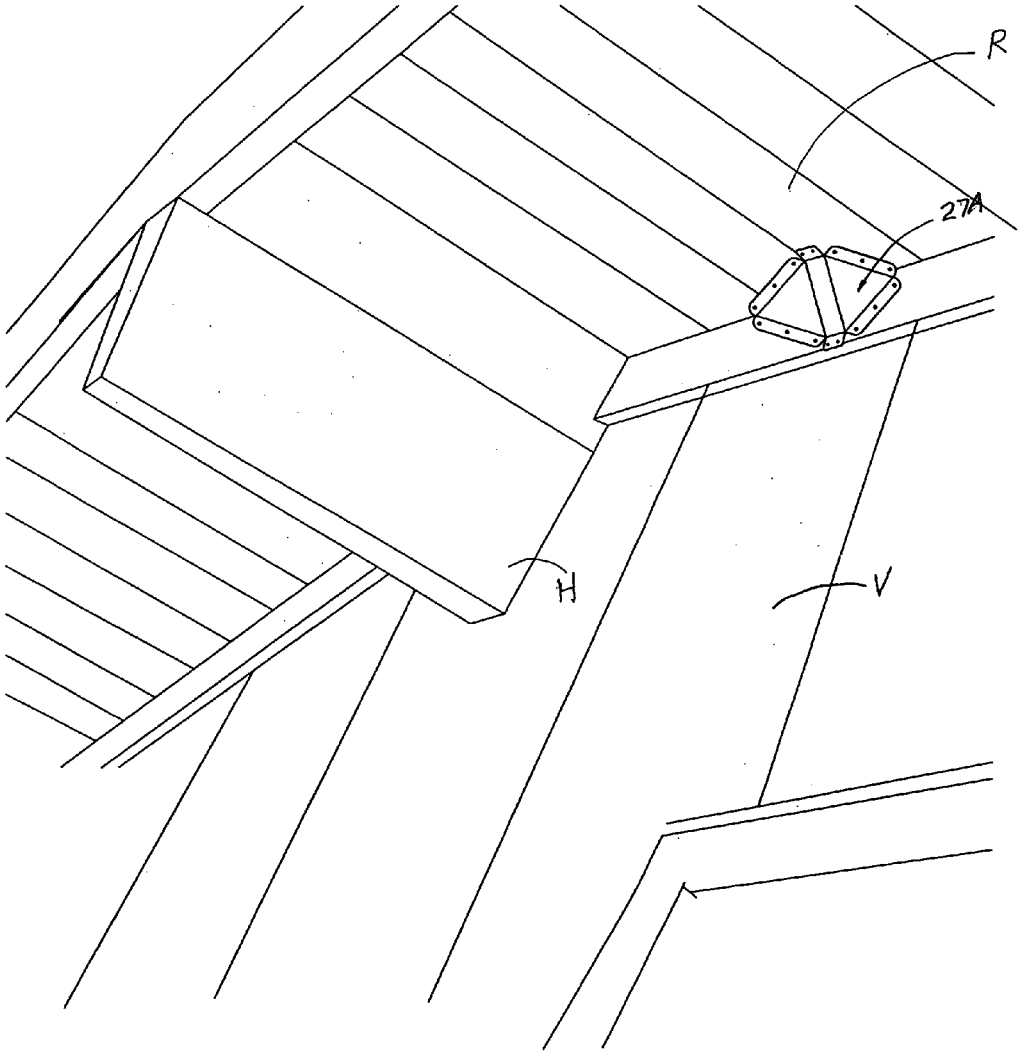
FIG. 8E Perspective view of a value gusset on intersecting structural members.

Refer now to FIG. 8E which shows a perspective view of a value gusset 27A installed on the gable end of a roof. The value gusset 27A is installed along the slope of the roof, so the tabs on one side are against the roof and tabs on the other side are against the gable wall. The value gusset 27A ties the underside of the roof R to the side of the gable wall V. The value gusset 27A prevents the gable end wall from being blown in by strong winds. The value gusset 27A prevents the gable end wall V from being blown out by the suction of strong winds. The value gusset 27A could also be placed against other structural members including the horizontal ridge beam H and vertical gable wall V.

Figure 8F:
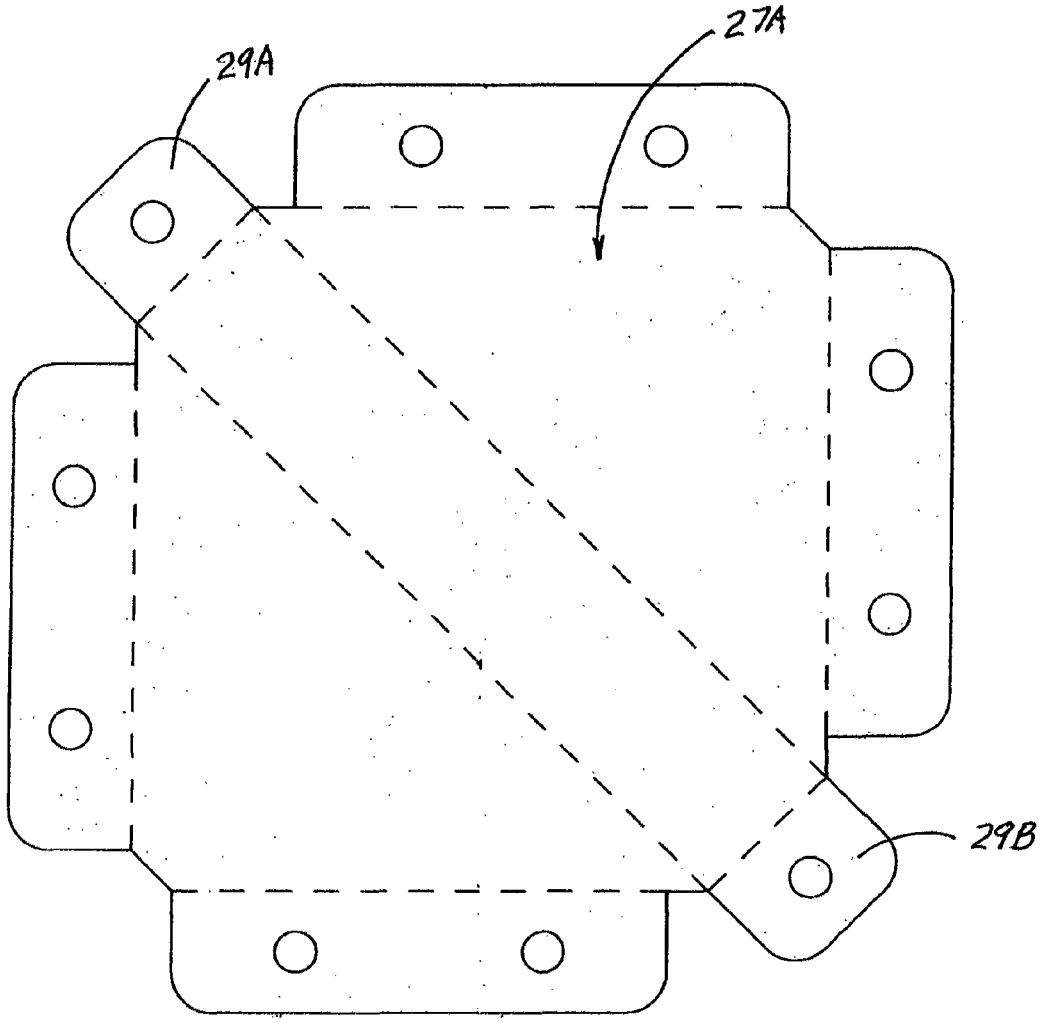
FIG. 8F Flat pattern layout of a value gusset.
Figure 8G:
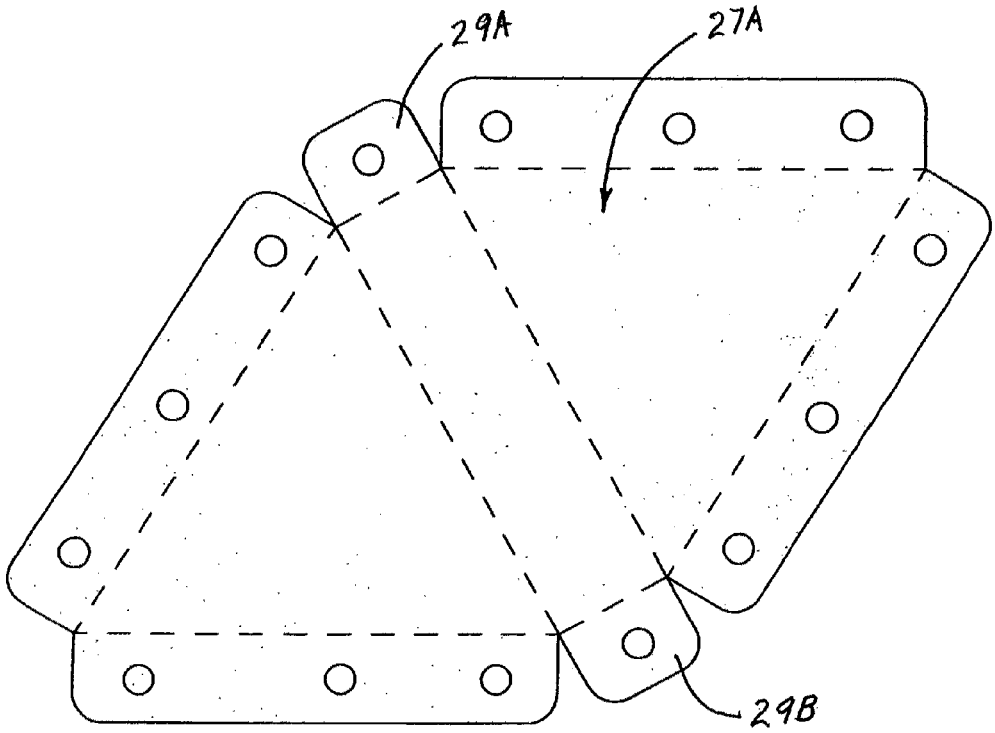
FIG. 8G Flat pattern layout of a value gusset.

FIGS. 8F and 8G show two types of flat pattern layouts for making a value gusset 27A. FIG. 8G uses a right angle in the two triangles 2 and 11, to give a shorter value gusset 27A. FIG. 8F uses acute angles on the triangles 2 and 11 to give a longer value gusset 27A.

Figure 8H:
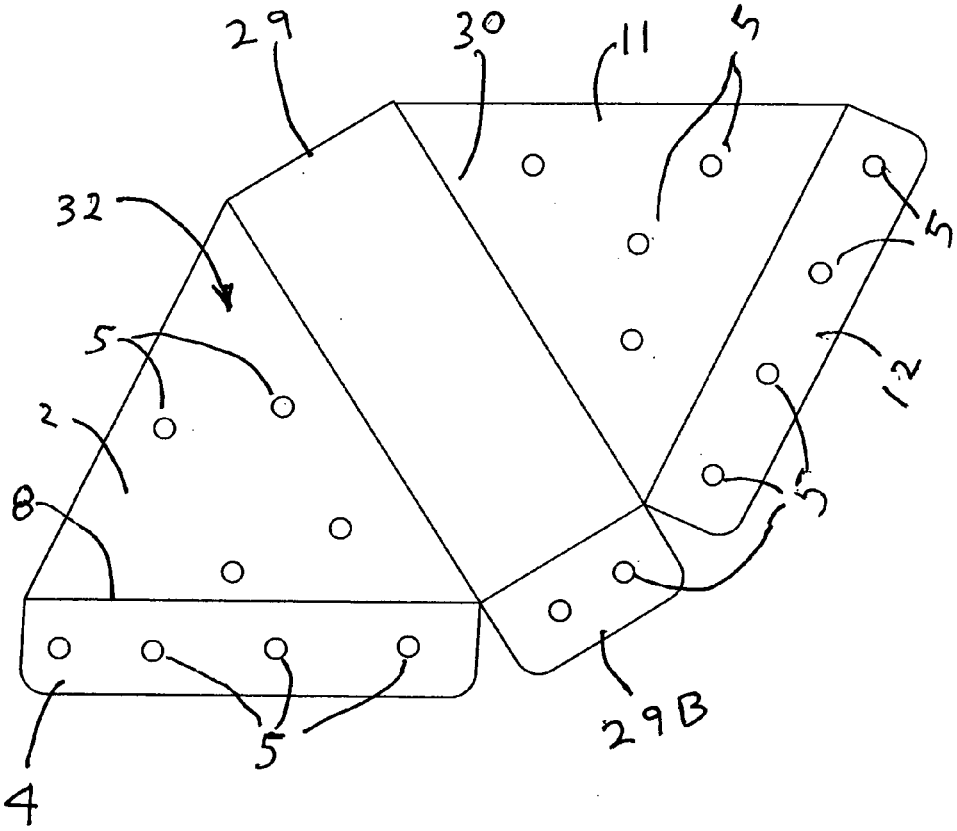
FIG. 8H Flat pattern layout of a knee gusset

Refer now to FIG. 8H which shows a flat pattern layout of a knee gusset 32. The knee gusset 32 is similar to a value gusset 27A, except three tabs are deleted, and four of the bends are right-angles. The lower left tab 9, lower strip tab 29A, and lower right tab 3 are deleted. And the upper left bend 13, upper right bend 8, first gusset bend 28, and second gusset bend 30 are right-angle bends.

By having the triangles 2 and 11 bent at right angles to the dividing strip 29, the triangles are parallel to each other. With the upper right tab 4 and upper left tab 12 bent at right angles to the triangles 2 and 11, the tabs 4 and 12 are perpendicular to the triangles 2 and 11. Upper strip tab 29B is bent at an acute angle so it is in the same plane as tabs 4 and 12. This forms half of an open box. The triangles have nail holes 5.

Figure 8I:
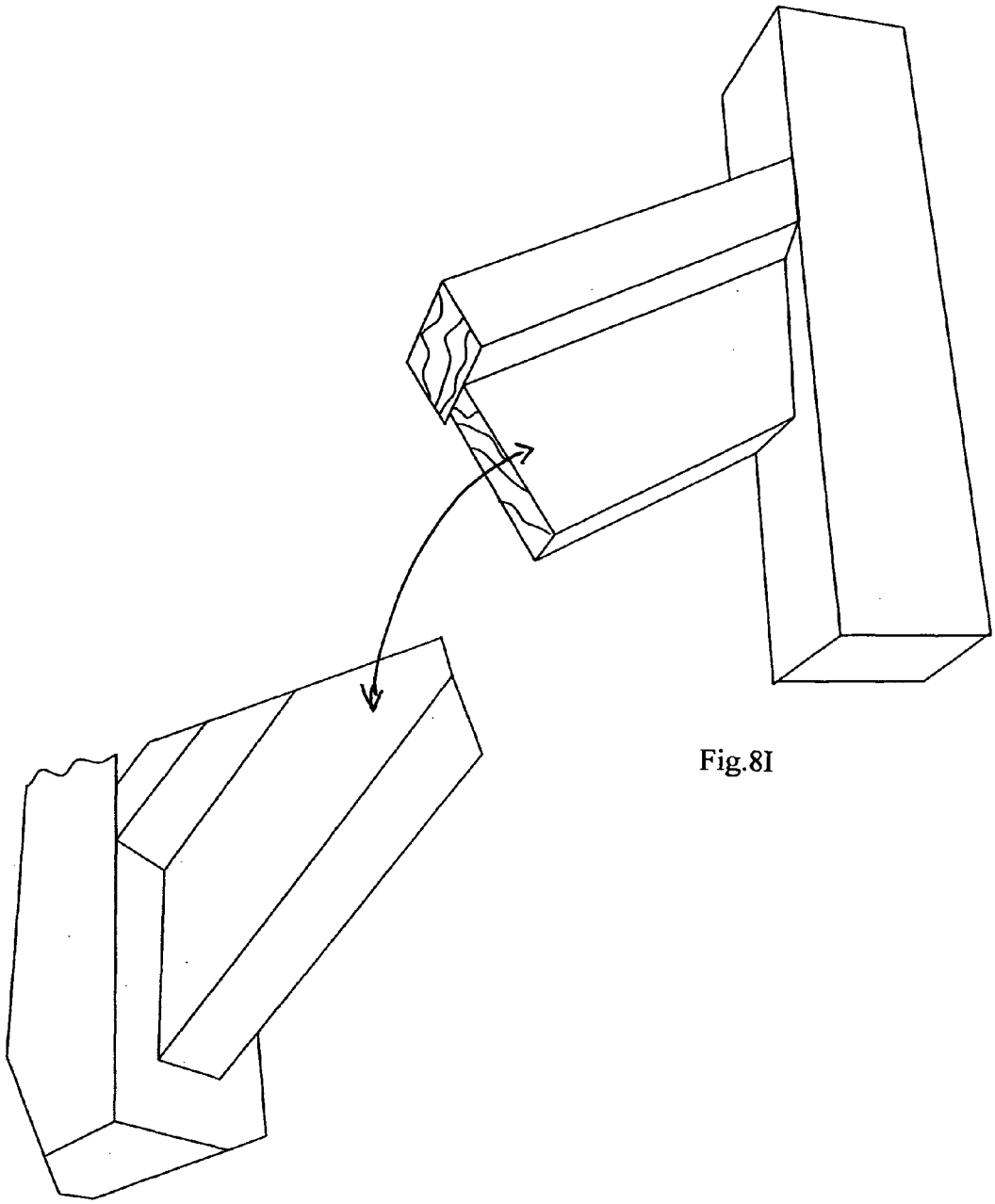
FIG. 8I Perspective view of a post and angled brace.

Refer now to FIG. 8I which shows a perspective view of a vertical post P and brace B. The brace B is diagonally attached to the post P. This is a common method of bracing posts P against movement. The brace 13 is usually a 2×4, cut at an angle, and toe-nailed to the post P. This method of construction is common on elevated decks, and houses that are elevated.

Figure 8J:
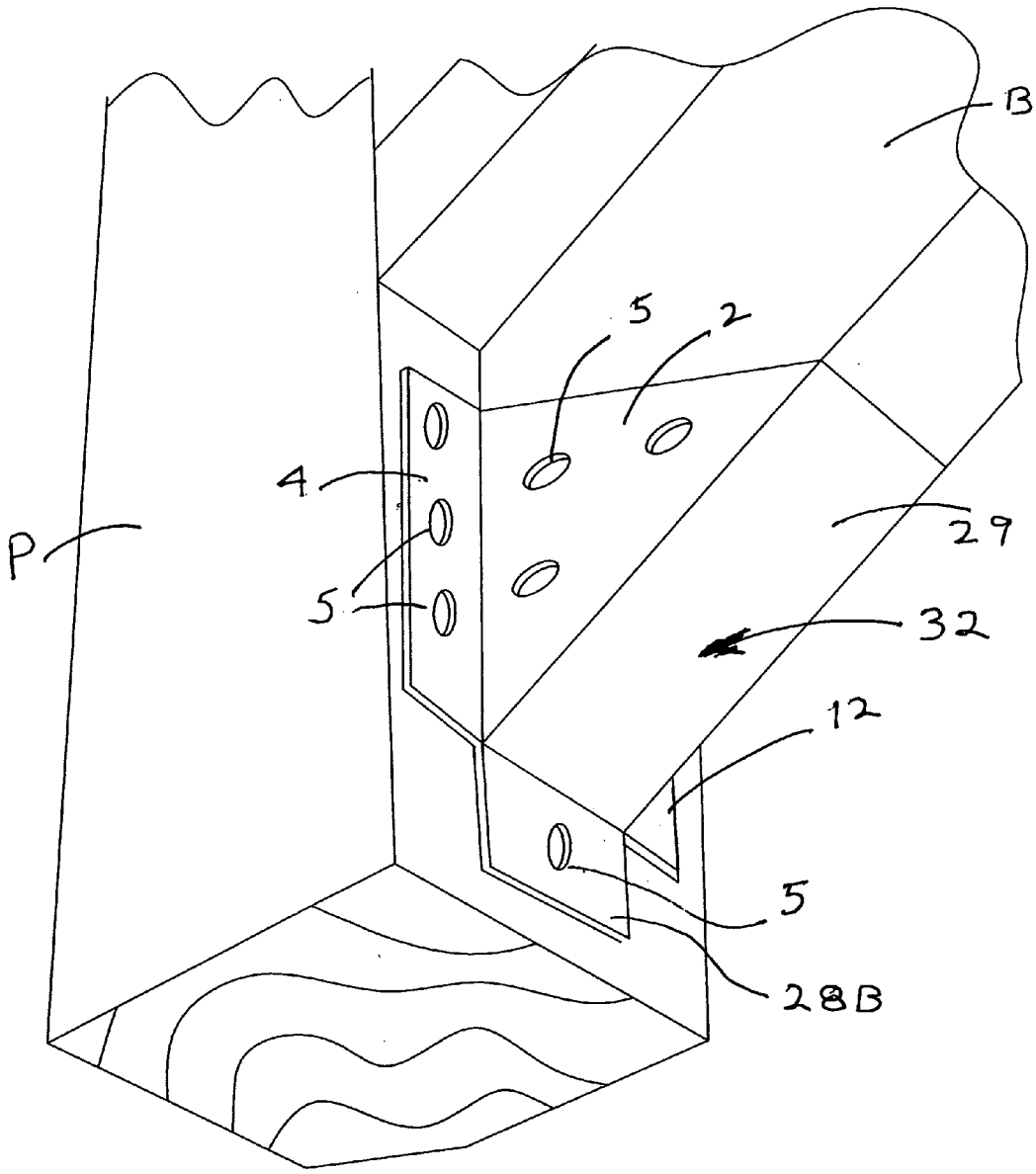
FIG. 8J Perspective view of a knee gusset on a post and angled brace.

Refer now to FIG. 8J which shows a perspective view of a knee gusset 32 attached to a vertical post P and brace B. This view is looking up at the bottom of the knee gusset 32. The knee gusset 32 is attached to the post P and brace B by placing the knee gusset 32 against the brace B so it surrounds it on three sides and is butted against the post P.

The knee gusset 32 is attached to the post P by fasteners through nail holes 5 on the upper right tab 4, upper strip tab 29B, and upper left tab 12. The knee gusset 32 is attached to the brace B by fasteners through nail holes 5 on the right triangle 2, and the left triangle 11 (hidden). The knee gusset 32 is held to the post P at three tabs 4, 28B, and 12, and is wrapped around three sides of the brace B by triangles 2 and 11, and by the dividing strip 29.

Having three attaching areas on the post, and wrapping around three sides of the brace, the knee gusset 32 provides added strength to the connection. With three areas of attachment on the post, wood splitting, pulling out by the fasteners, and twisting of the brace are prevented. With two sides of attachment and three sides of the brace encased, wood splitting, pulling out by the fasteners, and twisting of the brace are prevented. Another knee gusset 32 could be placed at the other end of the brace B. This can be seen by turning FIG. 8J upside-down. The knee gusset 32 would help prevent damage from forces produced by wind or seismic events.

Figure 8K:
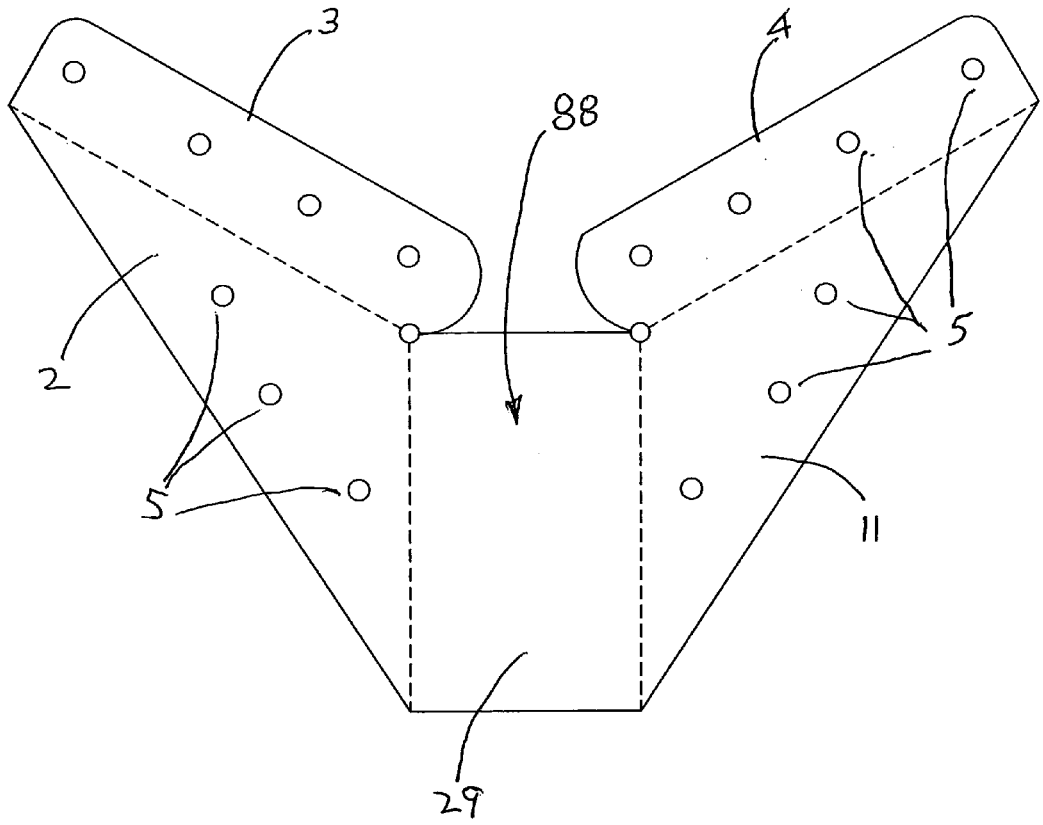
FIG. 8K Flat pattern layout of a brace gusset.

Refer now to FIG. 8K which shows a flat pattern layout of a brace gusset 88 before bending. The brace gusset 88 is similar to previous gussets except the triangles 2 and 11 are obtuse triangles. That places the lower right tab 3 and lower left tab 11 at an acute angle to the center dividing strip 29.

Figure 8L:
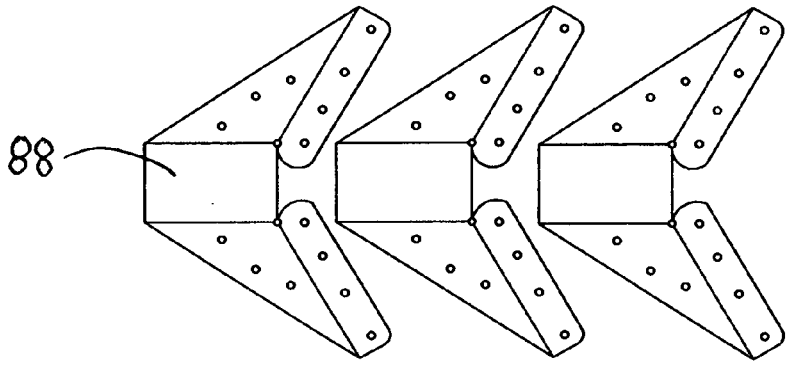
FIG. 8L Flat pattern layout of a brace gusset showing nesting.
Figure 8L:
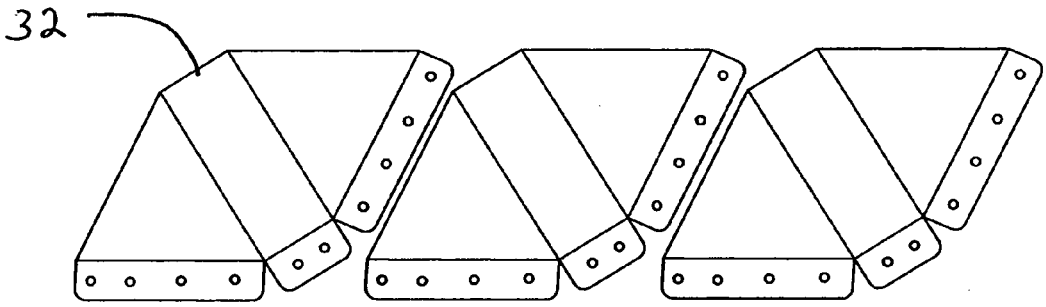

Refer now to FIG. 8L which shows how the flat pattern layout of a brace gusset 88 can nest during manufacture and avoid wasted material.

Figure 8M:
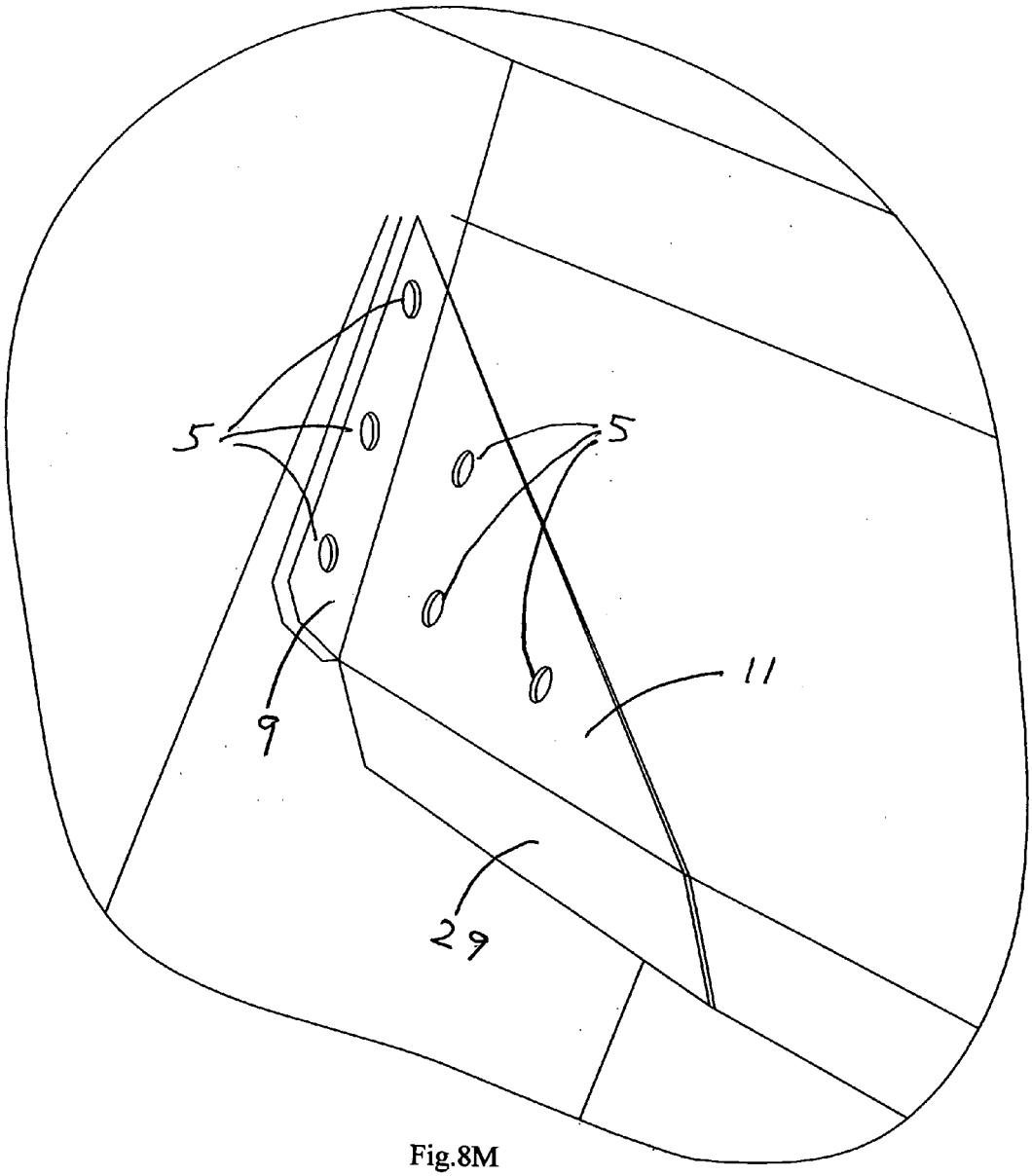
FIG. 8M Perspective view of a brace gusset on a brace and post.

Refer now to FIG. 8M which shows a perspective view of a brace gusset 88 installed on the upper part of a brace B on a house. This brace is the upper attachment of the brace shown in FIG. 8J. The brace B extends down from the post P of the house at a similar angle as the brace B extends up from the knee gusset 32. The brace gusset 88 is retrofitted to the house by placing the triangles 2 and 11 on either side of the brace B and sliding the brace gusset 88 until the lower tabs 9 and 3 contact the post P and the dividing strip 29 is against the bottom of the brace B.

Fasteners through the nail holes 5 on the triangles 2 and 11 secure the brace gusset 88 to the top part of the brace B. The brace B is supported on three sides by two triangles 2 and 11, and on the bottom by the dividing strip 29. Fasteners through the nail holes 5 on the two tabs 9 and 3 secure the brace gusset 88 to the post P.

The brace gusset 88 can be installed on the top of each angled brace of a house and would help tie the brace B securely to the post P. This would prevent the post P from moving during a seismic event or strong winds. It also helps prevent the brace B from twisting, splitting, lifting, and moving laterally due to wind or seismic forces.

Figure 9A:
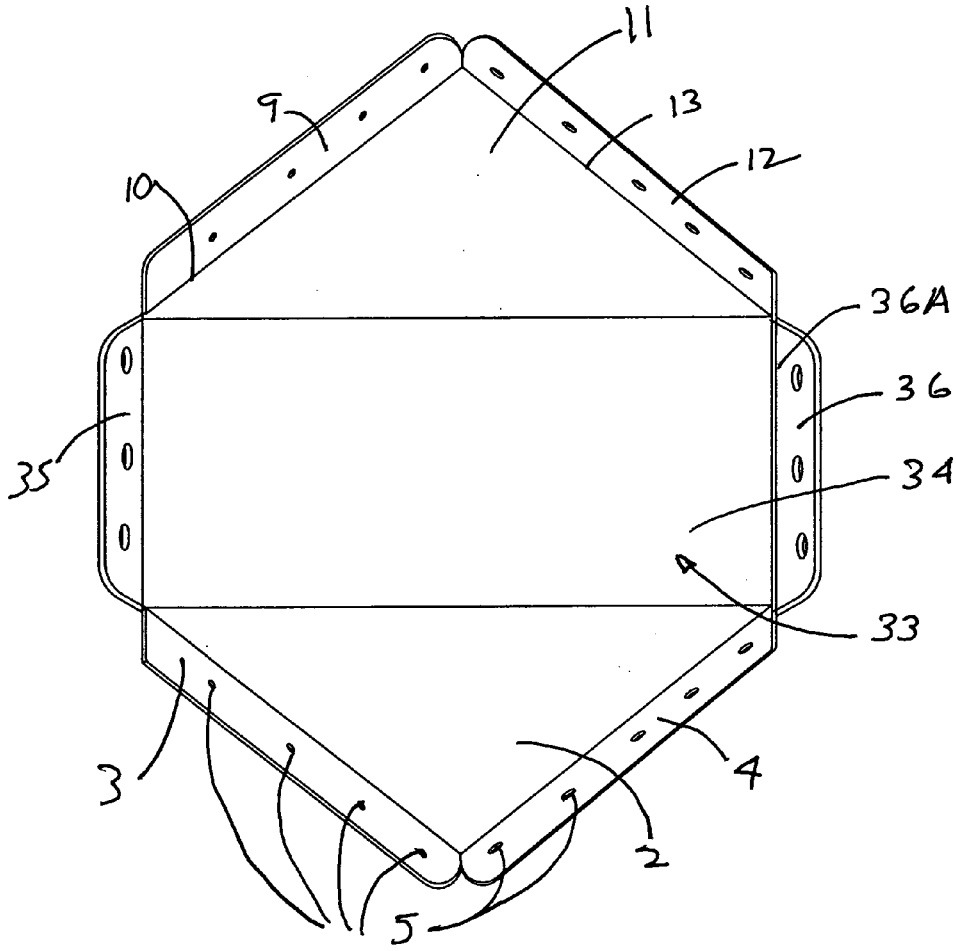
FIG. 9A Perspective view of a post gusset.

Refer now to FIG. 9A which shows a perspective view of a post gusset 33. The post gusset 33 is similar to a value gusset 27A, except the post gusset 33 has a wide dividing strip 34. The wide dividing strip 34 places the two triangles 2 and 11 far apart and makes nailing through the nail holes 5 of the tabs 3, 4, 9, and 12 wide apart. The wide dividing strip 34 also allows more nails onto the wide top and bottom tabs 36 and 35.

Figure 9B:
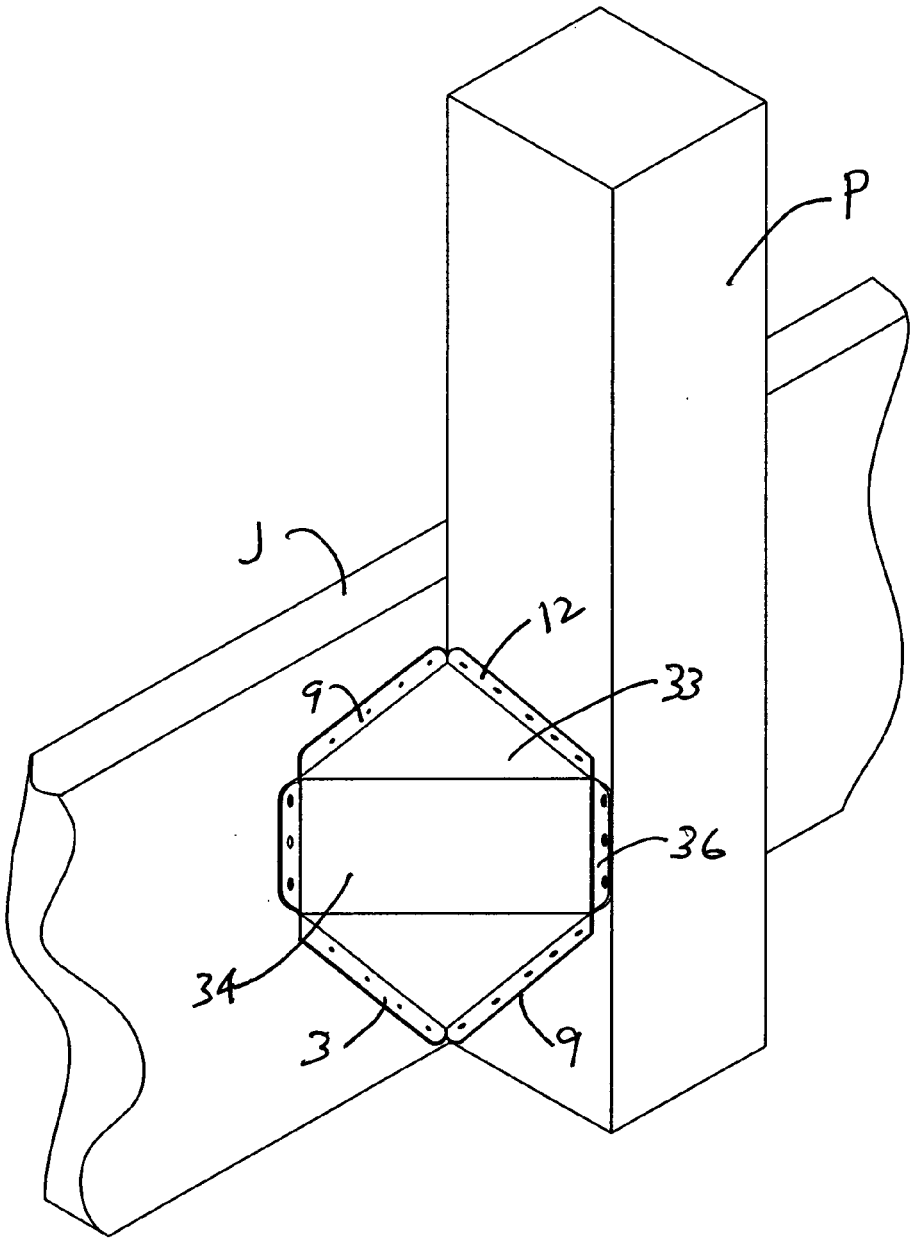
FIG. 9B Perspective view of a post gusset on wide structural member and post.

Refer now to FIG. 9B which shows a perspective view of a post gusset 33 attached to a vertical post P and horizontal joist J. Many wooden decks across the US have posts and railings that may not be strong enough to keep one or more people from leaning on and having the post disconnect from the joist of the deck flooring.

FIG. 9B shows a post gusset 33 mounted horizontally to a horizontal joist J and vertical post P. The right angles of the triangles 2 and 11 are placed in the right angle between the joist J and post P. The right triangle 2 and tabs are mounted to the lower part of the joist J and post P, and the left triangle 11 and tabs are mounted to the upper part of the joist J and post P.

The wide dividing strip 34 has the bottom tab 35 mounted to the joist J and the upper tab 36 mounted to the adjacent side of the post P. This puts three tabs onto the joist in two planes. It also puts a large triangular, box-section against the joist and the post. If another post gusset 33 is mounted on the right side of the post, the connection will be doubly strong. Previously, large holes had to be drilled through the joist to attach large bolts and heavy connectors. Large holes weakened the joist and many homeowners do not have a large drill or large bits to install the previous type of connectors.

The post gusset 33 is a strong connector that does not need large drills or bits. It strengthens the wood and the connection of intersecting structural members against thrusting, twisting, and pushing.

Figure 9C:
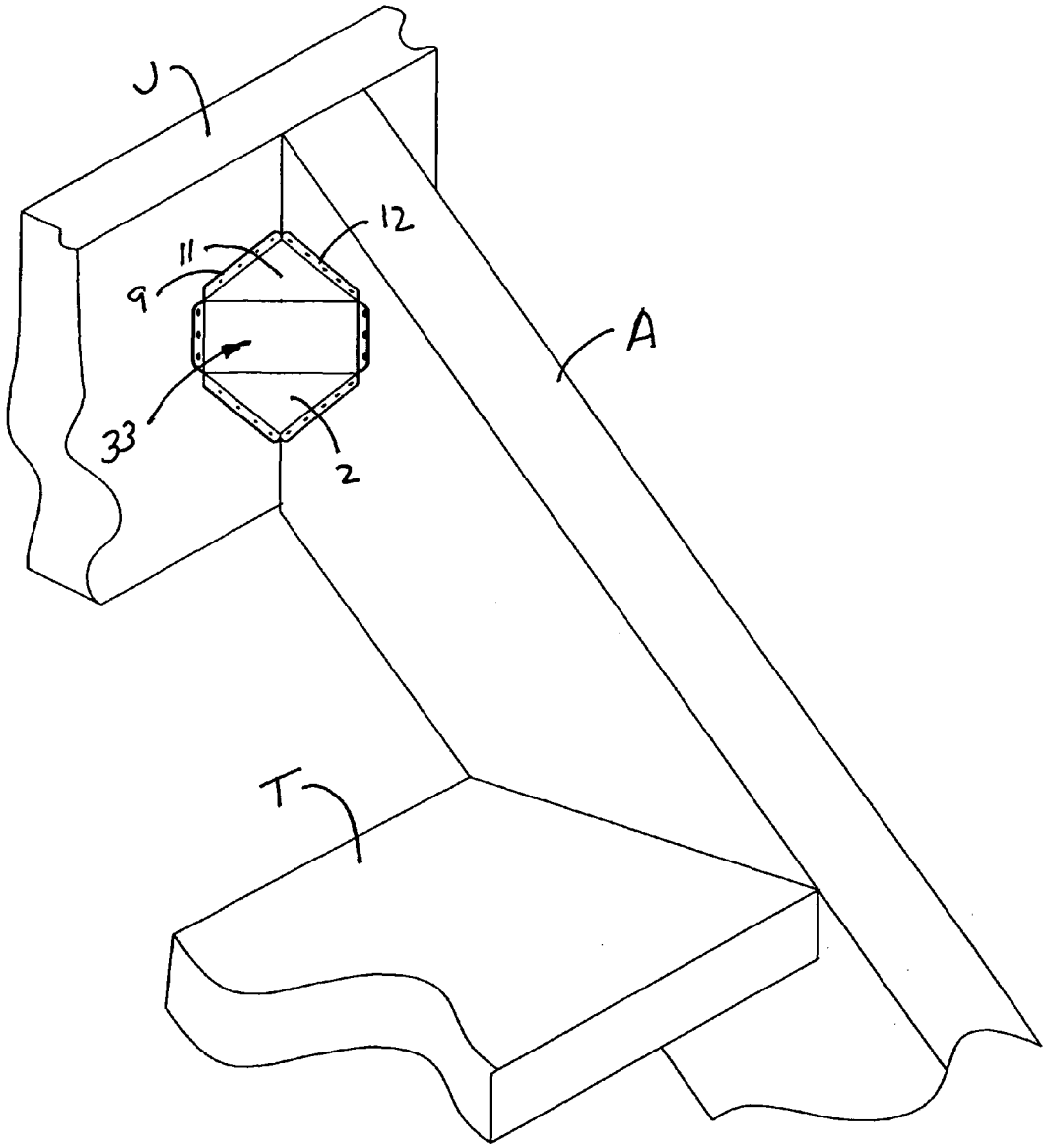
FIG. 9C Perspective view of a post gusset on an angled structural member.

Refer now to FIG. 9C which shows a perspective view of a post gusset 33 installed on a sloping stair stringer A and horizontal joist J. The post gusset 33 is installed above the stair thread T, for easy viewing, but would actually be installed on the hidden side of the stringer A. The post gusset 33 prevents the stringer A from twisting, pulling away from the joist, and falling down.

Intersecting structural members were often toe-nailed together. This weak method of nailing was usually a nail driven at an angle into an edge of one member into an adjacent one. A post gusset 33 installed onto intersecting structural members can strengthen a previously toe-nailed connection.

Figure 9D:
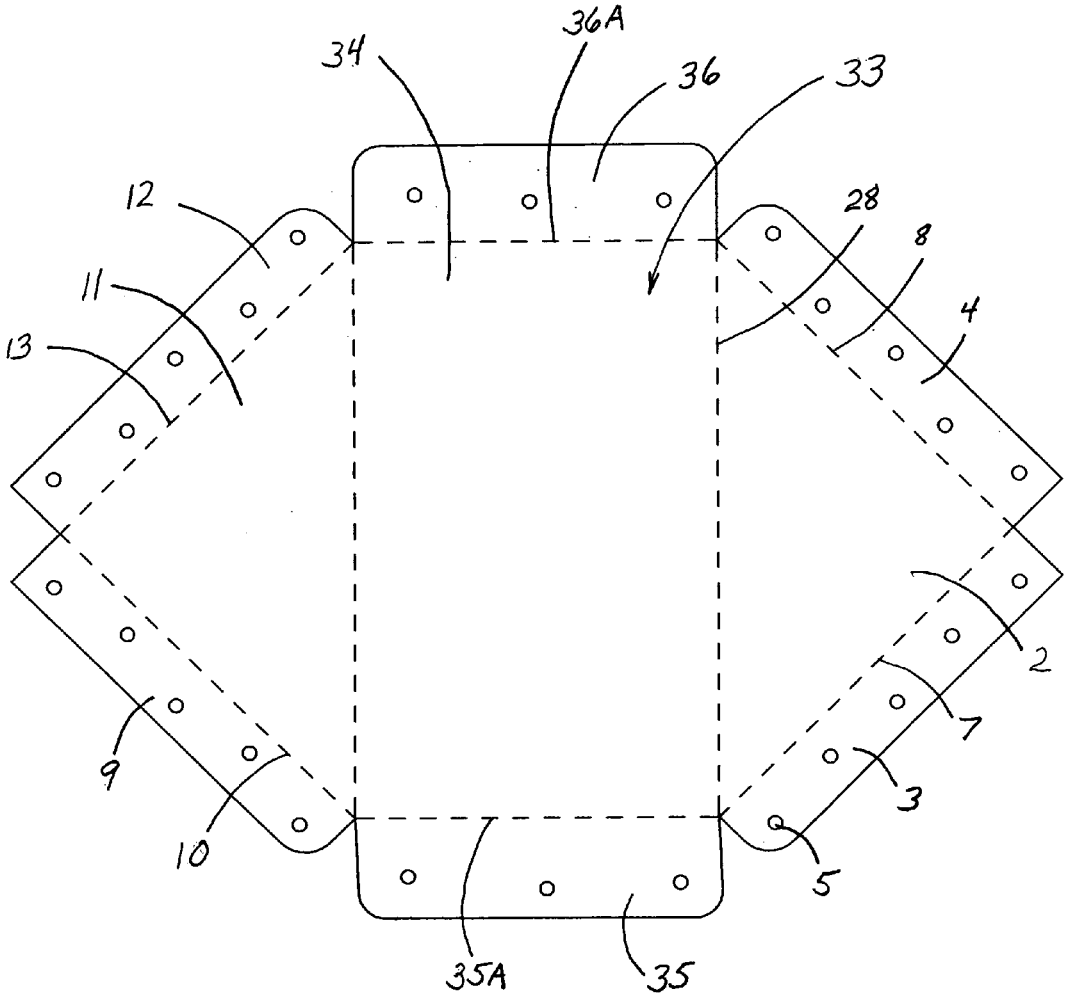
FIG. 9D Flat pattern layout of a post gusset.

Refer now to FIG. 9D which shows a flat pattern layout of a post gusset 33 before bending along the dashed lines.

Figure 10A:
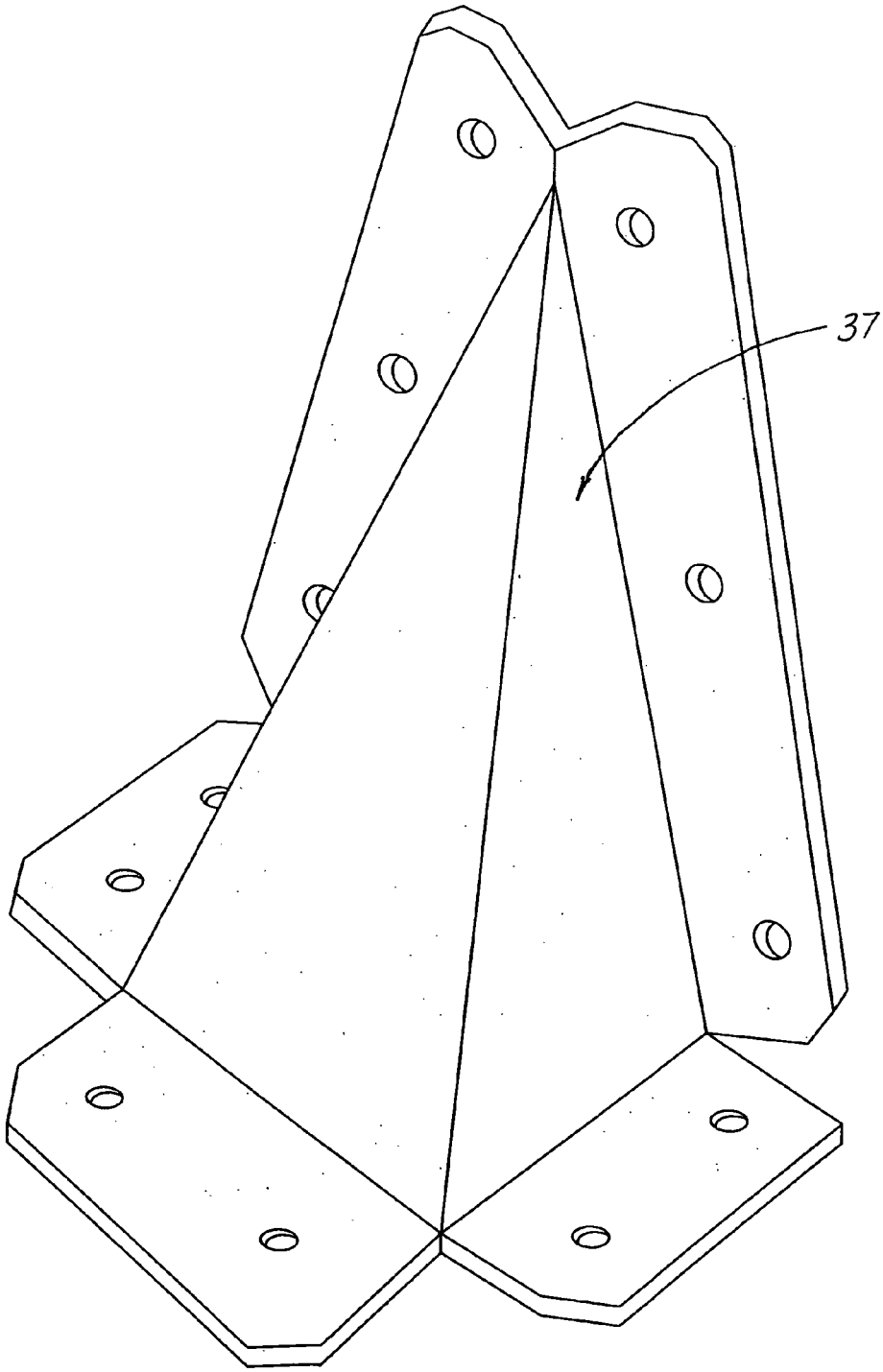
FIG. 10A Perspective view of a pyramid gusset.

Refer now to FIG. 10A which shows a perspective view of a pyramid gusset 37. The pyramid gusset 37 is similar to an unequal gusset 31, except for the dividing strip between triangles. On the unequal gusset 31, the diving strip 29 between triangles is rectangular. The dividing strip between triangles on the pyramid gusset 37 is also a triangle.

Figure 10B:
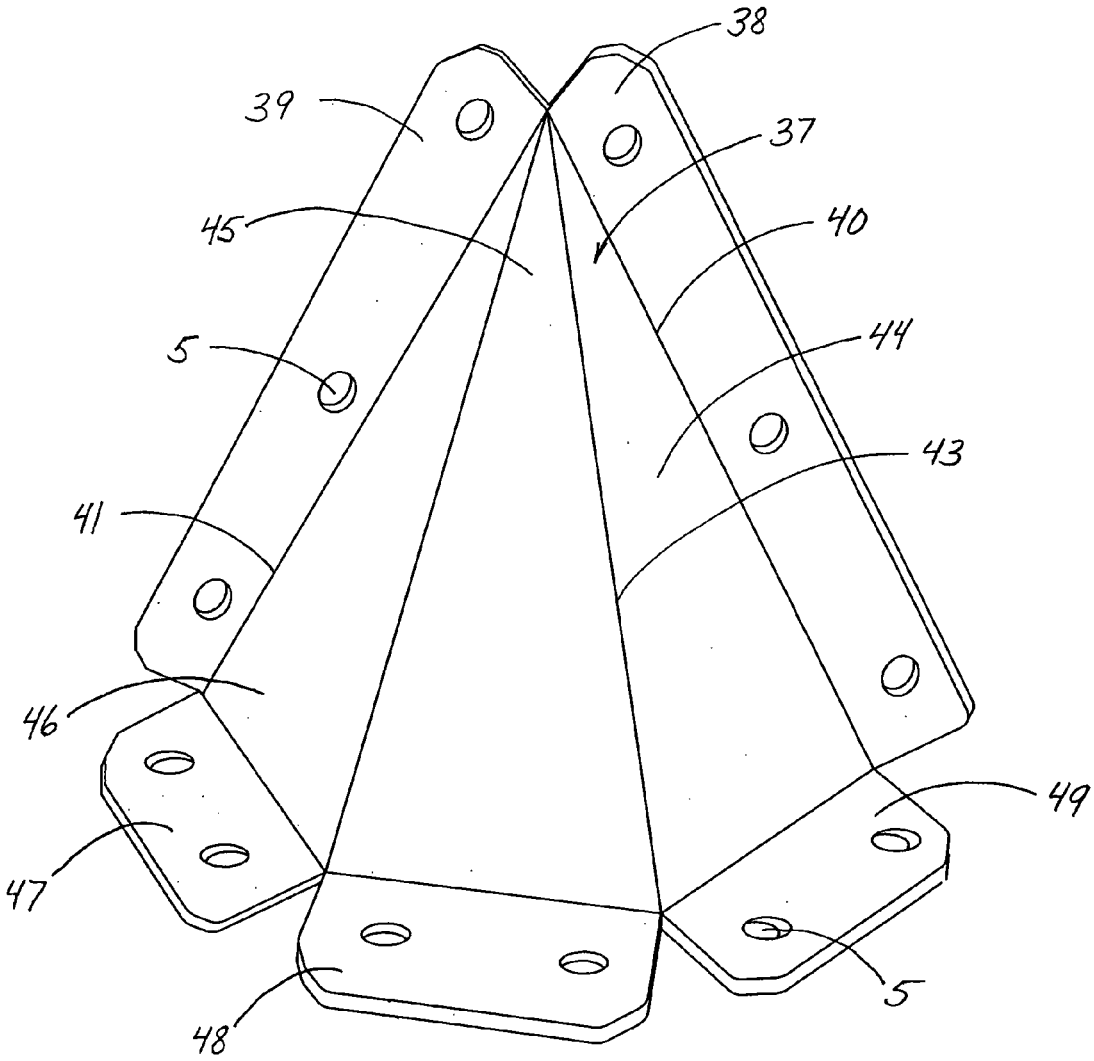
FIG. 10B Front view of a pyramid gusset.
Figure 10C:
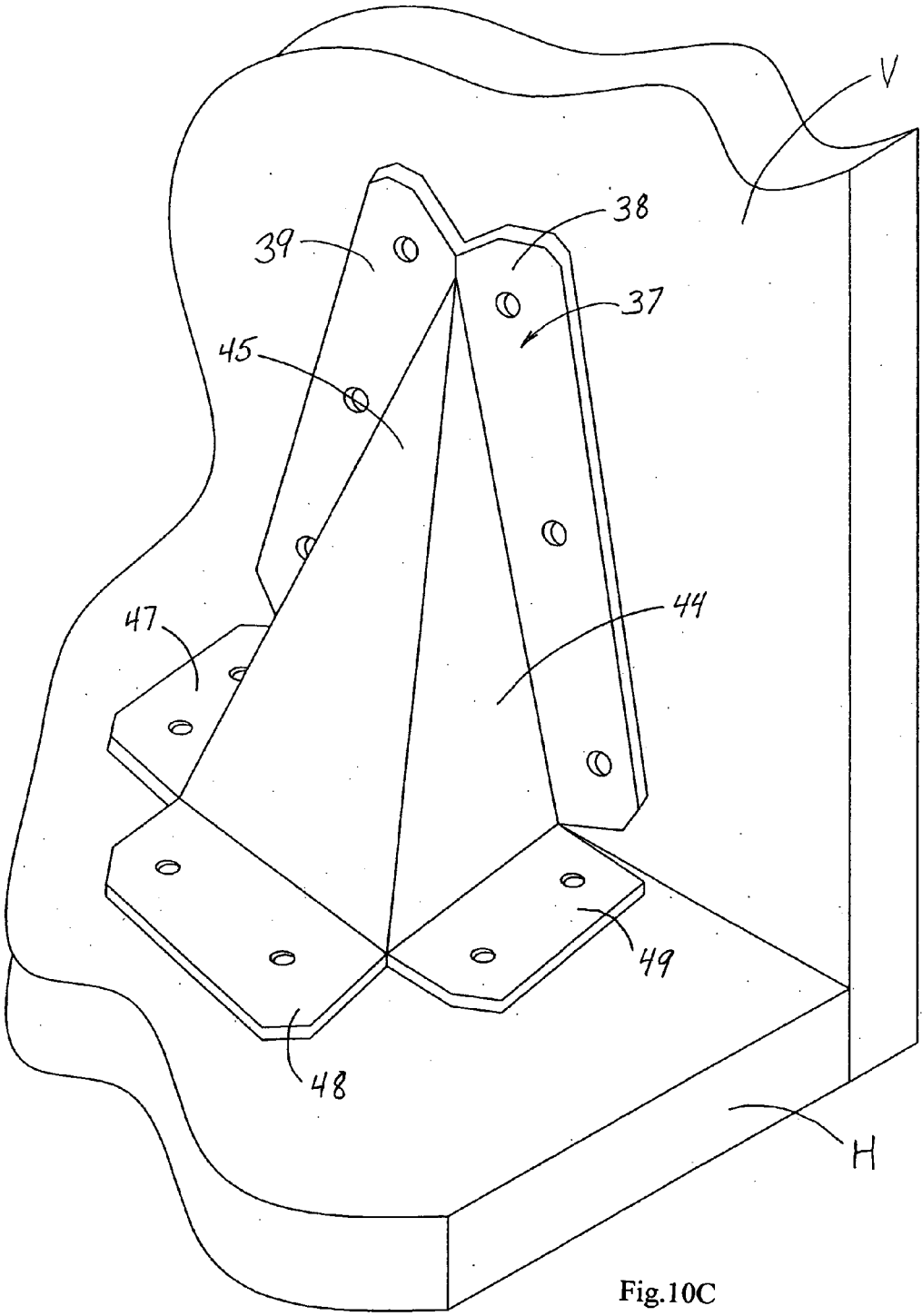
FIG. 10C Perspective view of a pyramid gusset on intersecting structural members.

Refer now to FIG. 10B which shows a front view of a pyramid gusset 37. The left upper tab 39 and right upper tab 38 are parallel and planer. The left lower tab 47, middle tab 48, and right lower tab 49 are parallel and planer. The left triangle 46, middle triangle 45, and right triangle 44 are bent at acute angles to each other.

Refer now to FIG. 10 C which shows a perspective view of a pyramid gusset 37 attached to a vertical structural member V and horizontal structural member H. The upper left and right tabs 39 and 38 are attached to the vertical member V, and the lower left, middle and right tabs 47, 48, and 49 are attached to the horizontal member H.

The upper tabs 38 and 39 form two sides of a triangle against the vertical member V. The lower tabs 47, 48, and 49 form three sides of an open box against the horizontal member H. The three triangles 44, 45, and 46 for three sides of a pyramid. Fasteners hold the pyramid gusset 37 firmly against the vertical and horizontal members. That helps form the closed end of the triangle, box, and pyramid. This forms a very strong connection against uplift, twisting, racking, and disconnection between the two members.

Figure 10D:
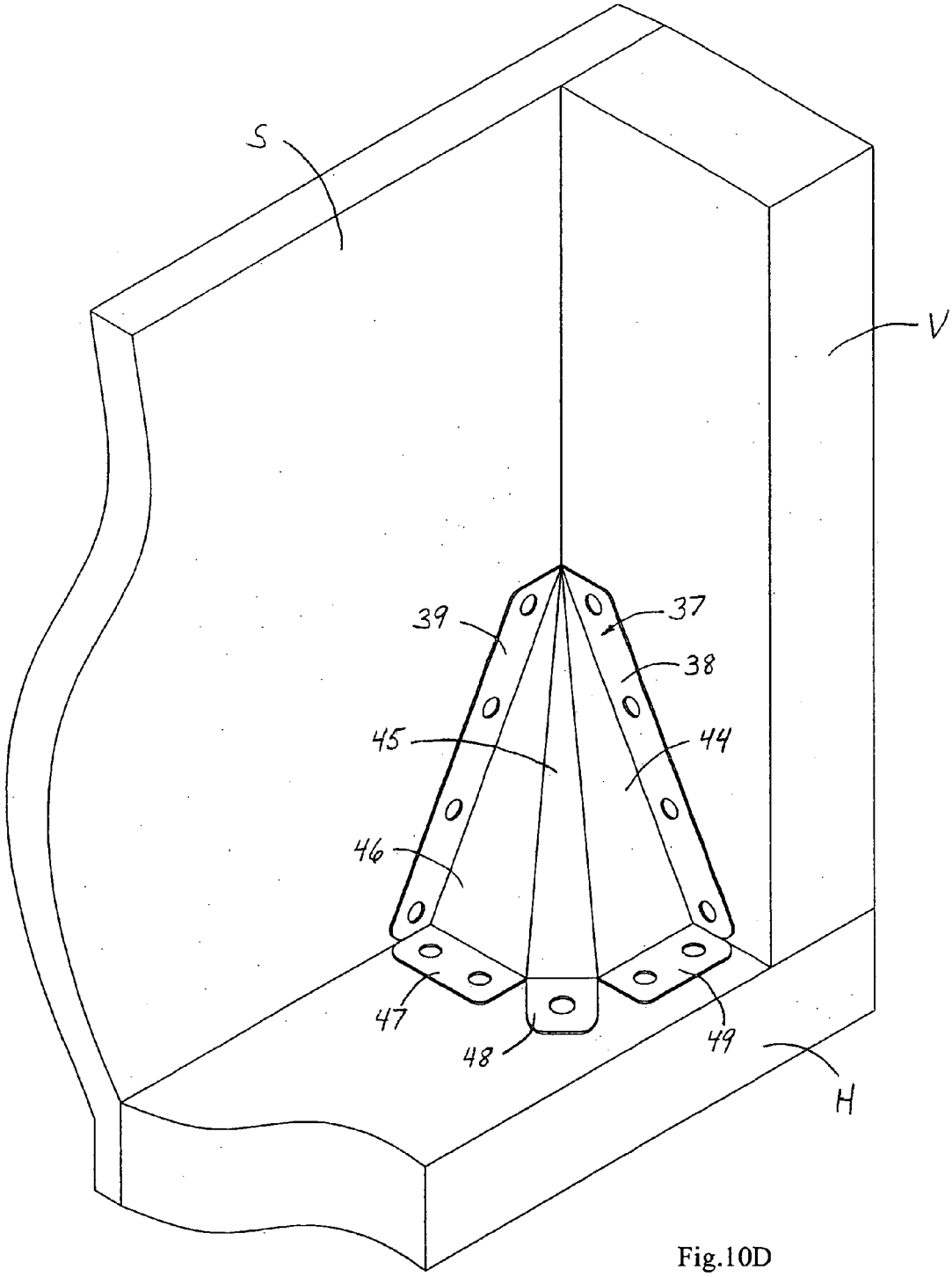
FIG. 10D Perspective view of a pyramid gusset on intersecting structural members.

Refer now to FIG. 10D which shows a perspective view of a pyramid gusset 37 attached to three intersecting structural members. Here, the upper left tab 39 and upper right tab 38 have been bent at a right angle to each other. This allows the top part of the pyramid gusset 37 to attach to two structural members that are at right angles to each other. The upper left tab 39 is fastened against the sheathing S, and the upper right tab 38 is fastened against the vertical stud V. The lower tabs 47, 48, and 49 are attached to the horizontal plate H. This prevents the three structural members from disconnecting due to forces from wind or a seismic event.

Figure 10E:
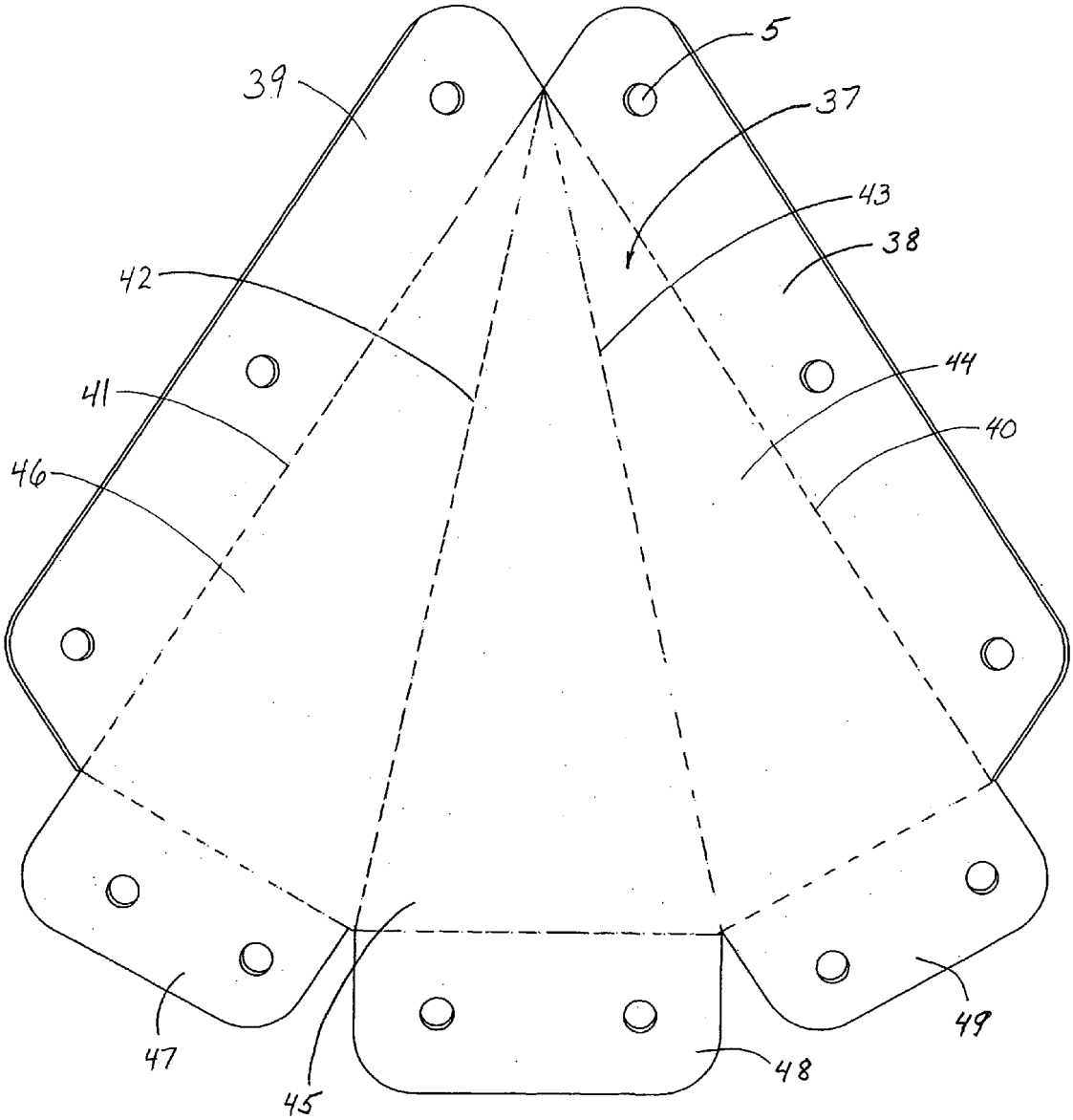
FIG. 10E Flat pattern layout of a pyramid gusset.

Refer now to FIG. 10E which shows a flat pattern layout of a pyramid gusset 37 before bending.

Figure 11A:
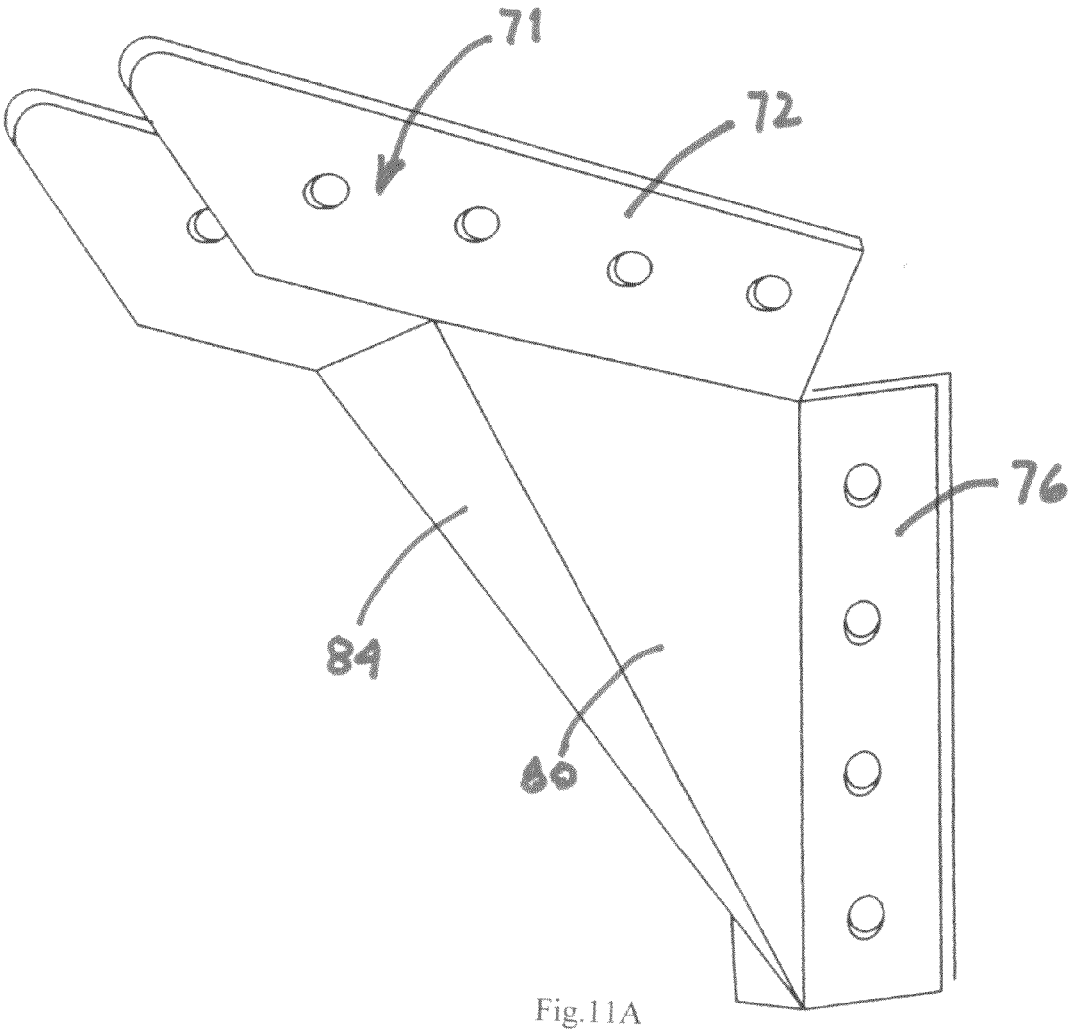
FIG. 11A Perspective view of a truss gusset.

Refer now to FIG. 11A which shows a perspective view of a truss gusset 71. The truss gusset 71 is similar to the pyramid gusset 37, except the middle tab 48 is cut and the left lower tab 47 and right lower tab 49 are bent so they are parallel to each other. This forms a right top tab 72, and left top tab 73 that are longer, since they use material from the middle tab.

Figure 11B:
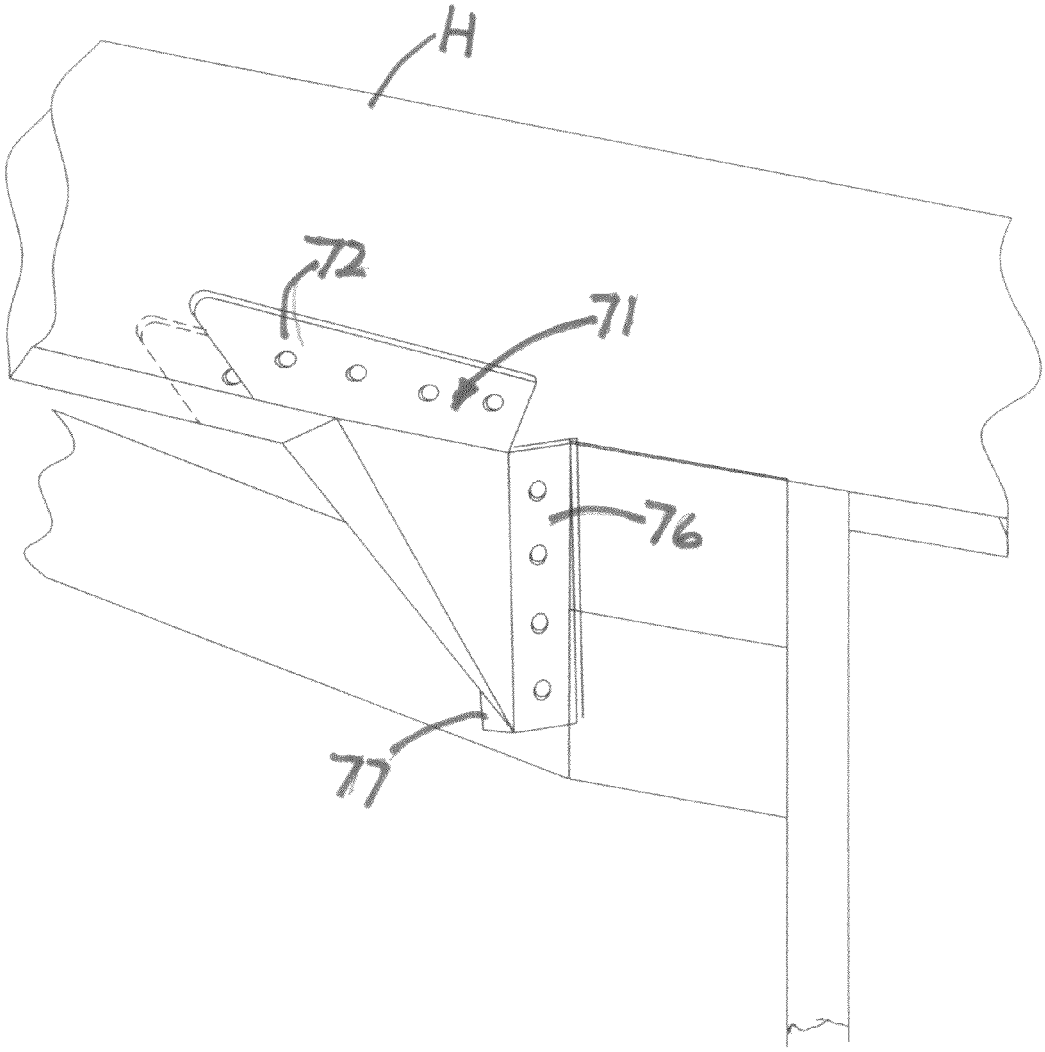
FIG. 11B Perspective view of a truss gusset on structural members.

Refer now to FIG. 11B which shows a perspective view of a truss gusset 71 attached to a roof truss H and an outside wall V. Houses built with roof trusses often have the truss extend out from the wall. The truss would be horizontal instead of angled like a roof rafter. The truss gusset 71 can be used where any horizontal beam meets a vertical beam.

The truss gusset 71 is installed as a retrofit on a house where the right top tab 72 and left top tab 73 cradle a truss beam H on either side and is lifted up until the edge of the middle triangle 84 is against the truss H. Fasteners through nail holes 5 on the tabs 72 and 73 secure the truss gusset to the truss H The truss H is now supported on three sides. The bottom right tab 76 and bottom left tab 77 are secured through nail holes 5 to the outside wall V and underlying top plate.

The upper tabs 72 and 73, bottom edge of the middle triangle 84, form a horse shoe-shape around the horizontal truss H. Triangles 80, 81, and 84 form three sides of a pyramid, and the lower tabs 76 and 77, extend it to the sides against the vertical wall V. This forms a very strong connection against uplift, twisting, racking, and disconnection between the two members.

The truss gusset 71 can also be used inside a house, on rafters that are angled to the wall. The hollow inside the truss gusset 77, between the three triangles can accommodate the bottom part of an angled rafter. The rafter rests on the edge of the middle saddle 84 and slopes inside the truss gusset 77. The upper tabs 72 and 73, and edge of the middle saddle cradle the rafter R, and the lower tabs 76 and 77 attach to the inside wall V and to the underlying top plate.

Figure 11C:
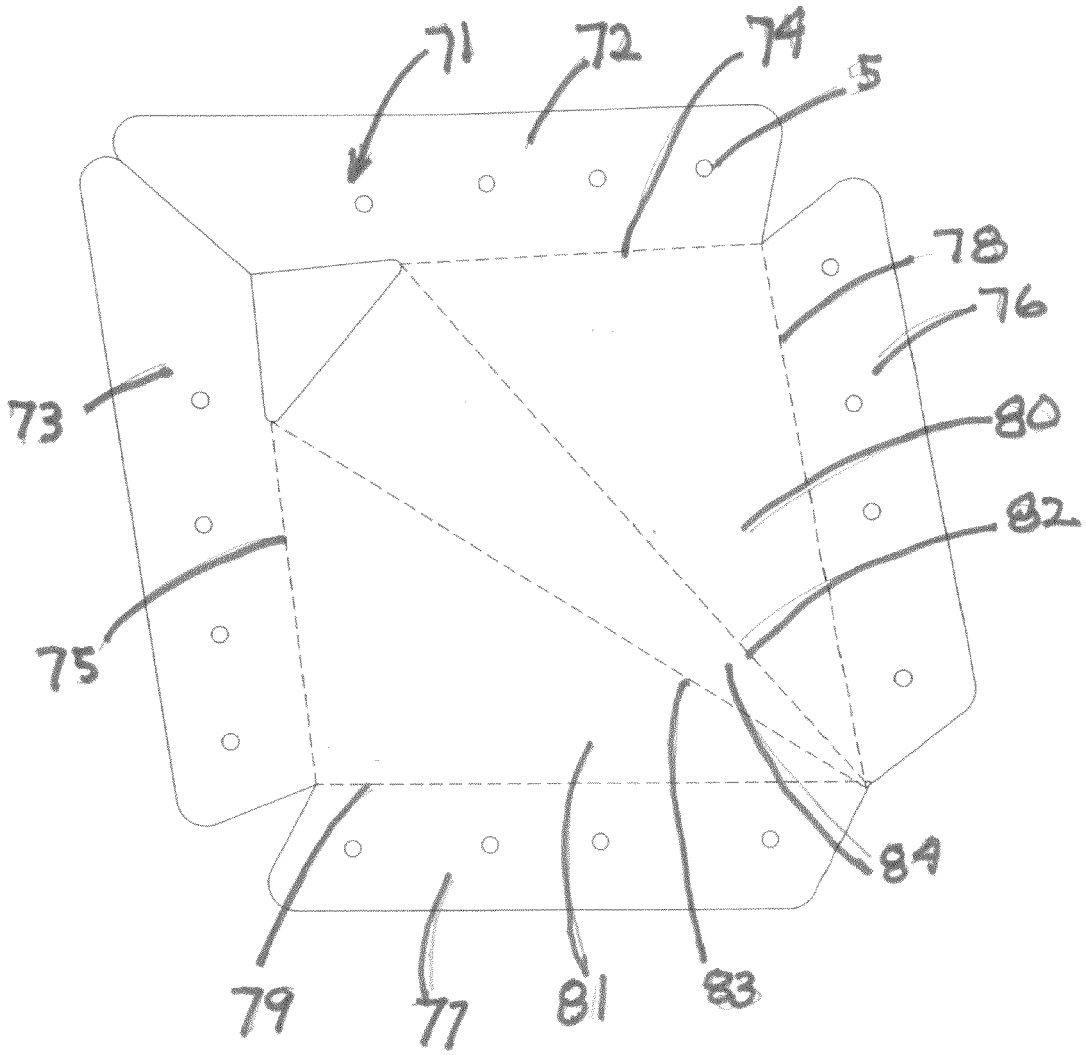
FIG. 11C Flat pattern layout of a truss gusset.

Refer now to FIG. 11C which shows a flat pattern layout of a truss gusset 71 before bending.

Figure 11D:
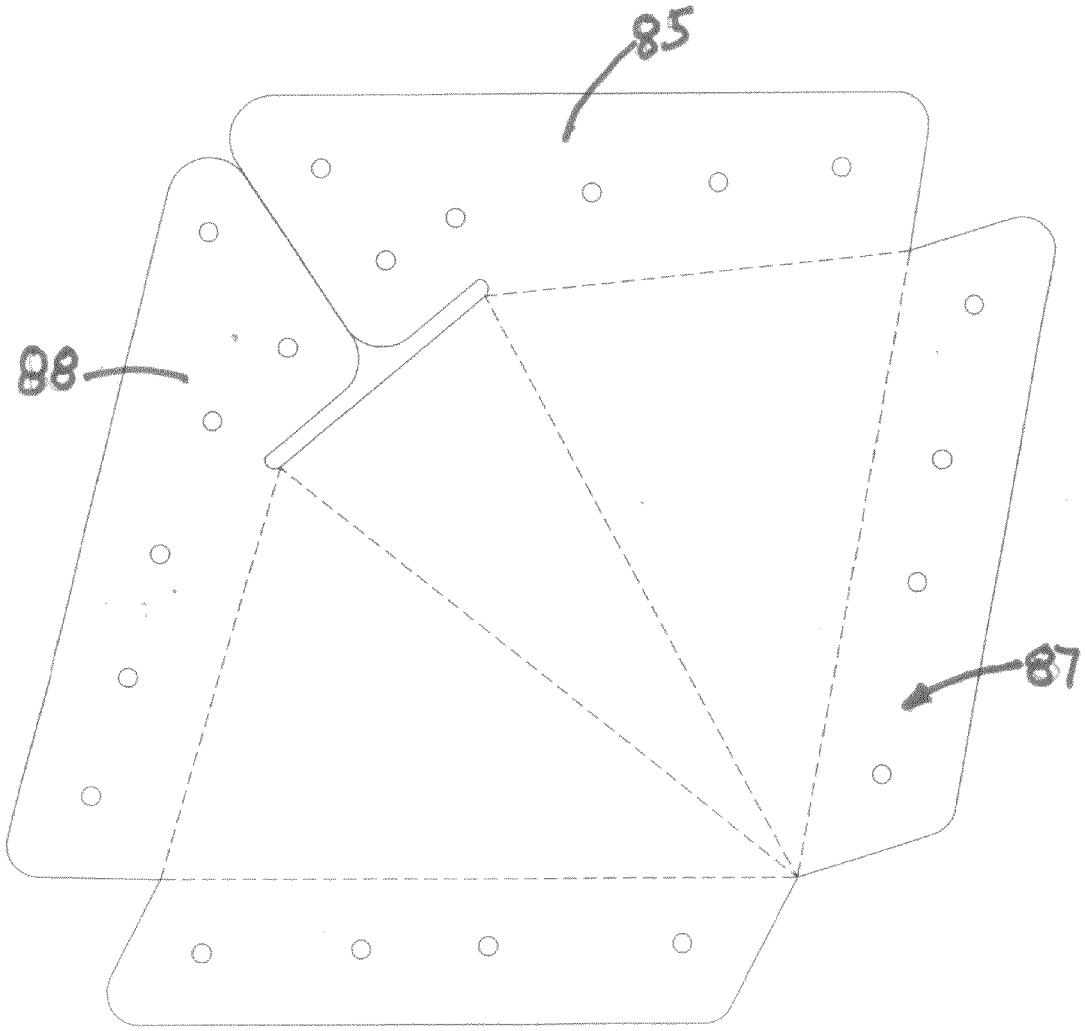
FIG. 11D Flat pattern layout of a roof gusset.

Refer now to FIG. 11D which shows a flat pattern layout of a roof gusset 87. The roof gusset 87 is similar to a truss gusset 88 except the side triangles 80 and 81 are wider.

Figure 11E:
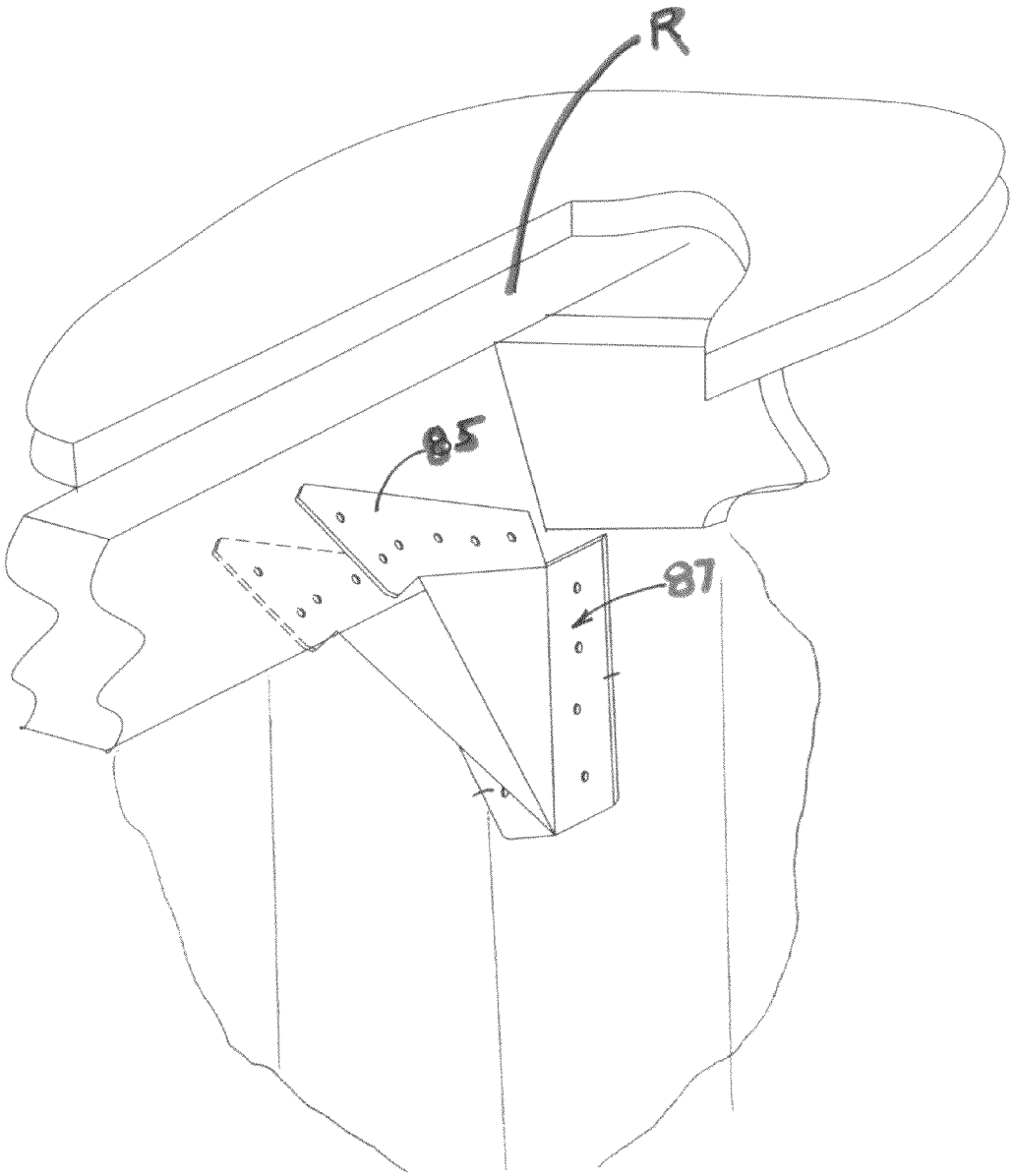
FIG. 11E Side view of a roof gusset on structural members.

Refer now to FIG. 11E which shows a side view of a roof gusset 87 attached to a sloping roof rafter R on the outside of a house. The roof gusset 87 is attached similar to a truss gusset 88.

Figure 12A:
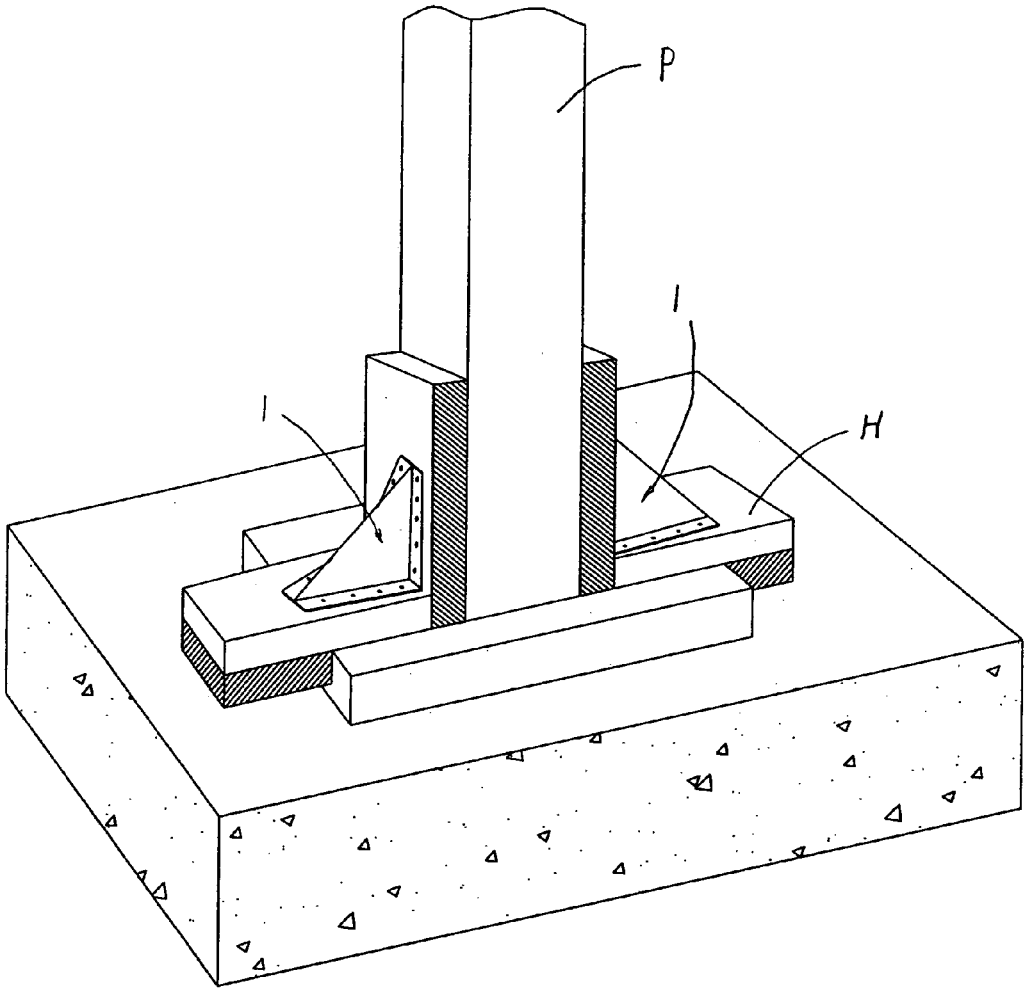
FIG. 12 A Perspective view of gussets on intersecting structural members.
FIG. 12B Perspective view of gussets on intersecting structural members.
FIG. 12C Perspective view of gussets on intersecting structural members.
FIG. 12D Perspective view of gussets on intersecting structural members.
FIG. 12E Perspective view of toe-nailing.

Refer now to FIG. 12A which shows two multipurpose gussets 1 attached to a post P and sill plate H. The post P is prevented from moving by the attachment of the gussets. Other gussets 19, 27, 27A, 31, 33, could also be used here.

Figure 12B:
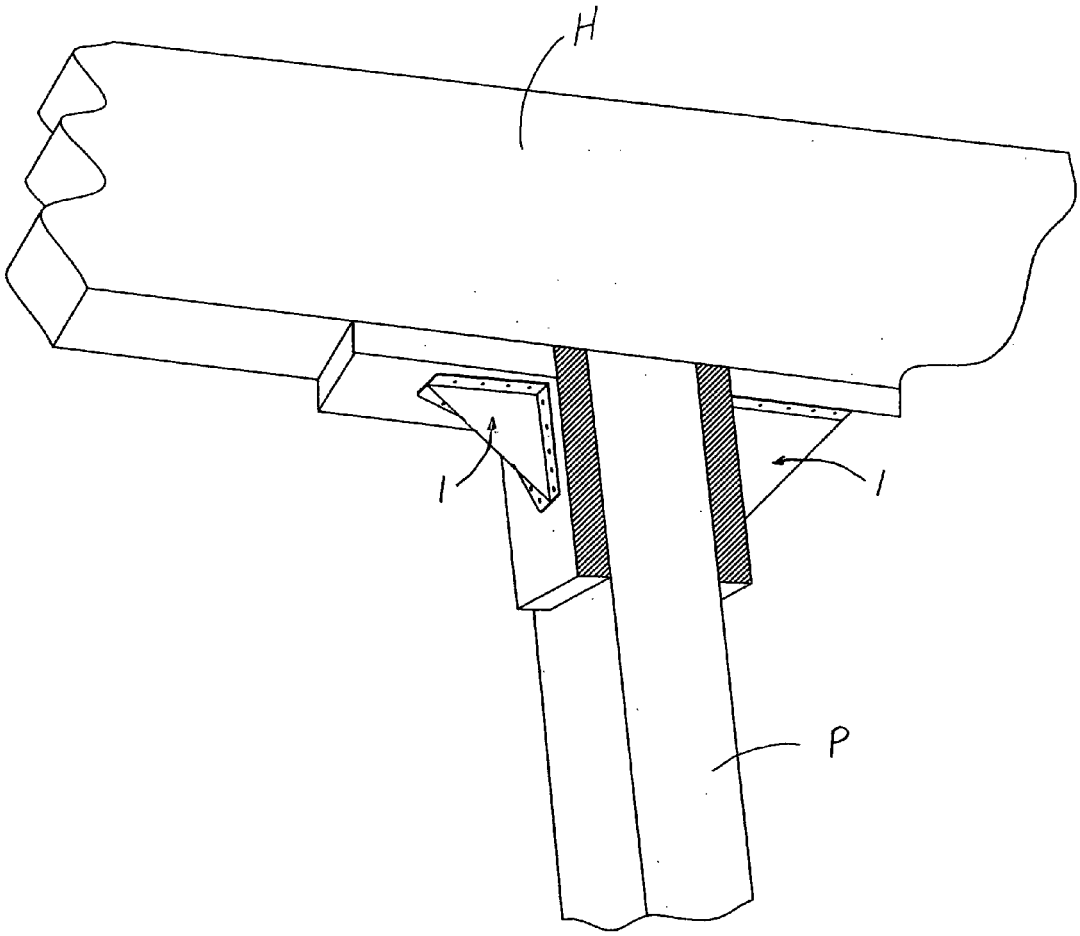

Refer now to FIG. 12B which shows two multipurpose gussets 1 attached to a post P and top plate H. The post P is prevented from moving by the attachment of the gussets. Other gussets 19, 27, 27A, 31, 33, could also be used here.

Figure 12C:
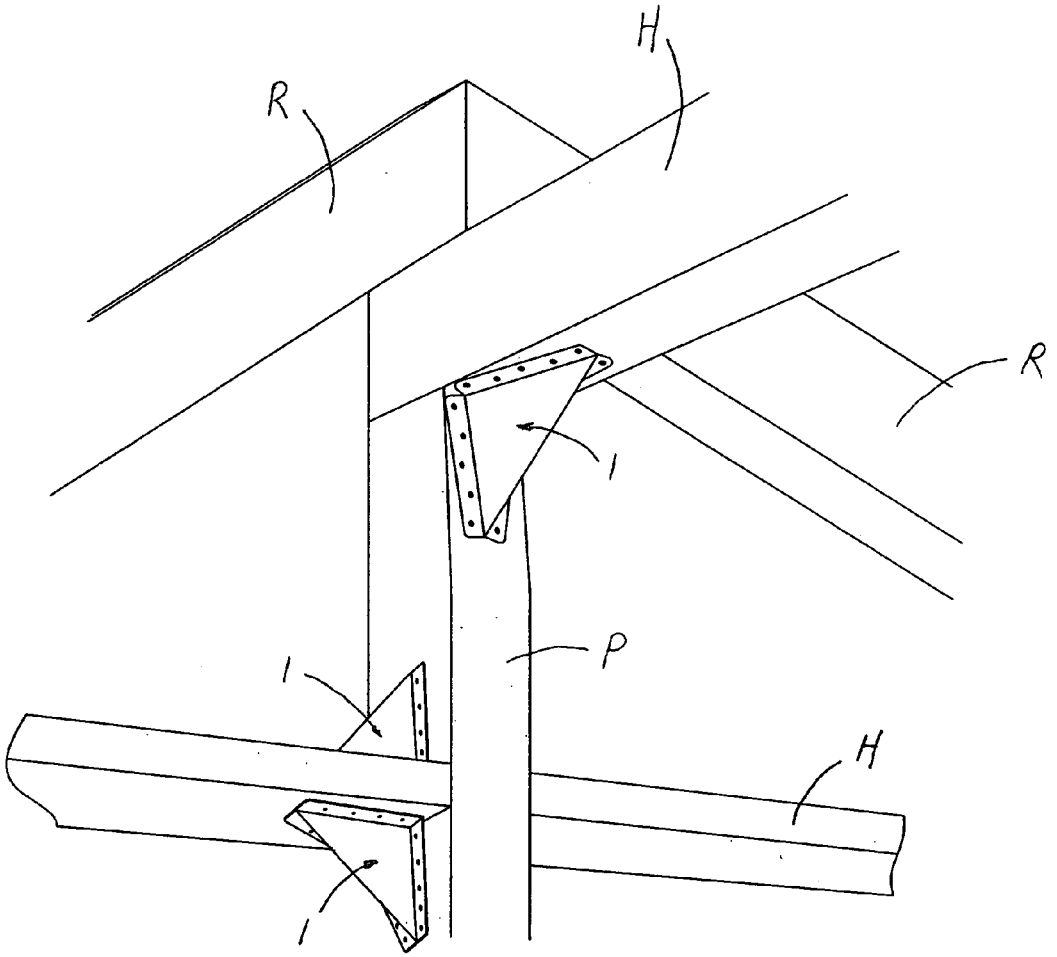

Refer now to FIG. 12C which shows three multipurpose gussets 1 attached to beams on the gable end of a wall. The upper gusset is attached to the roof beam H and post P on the gable wall. The lower gussets are attached to the post P and horizontal beam H. This shows that many different intersecting beams can be secured together.

Figure 12D:
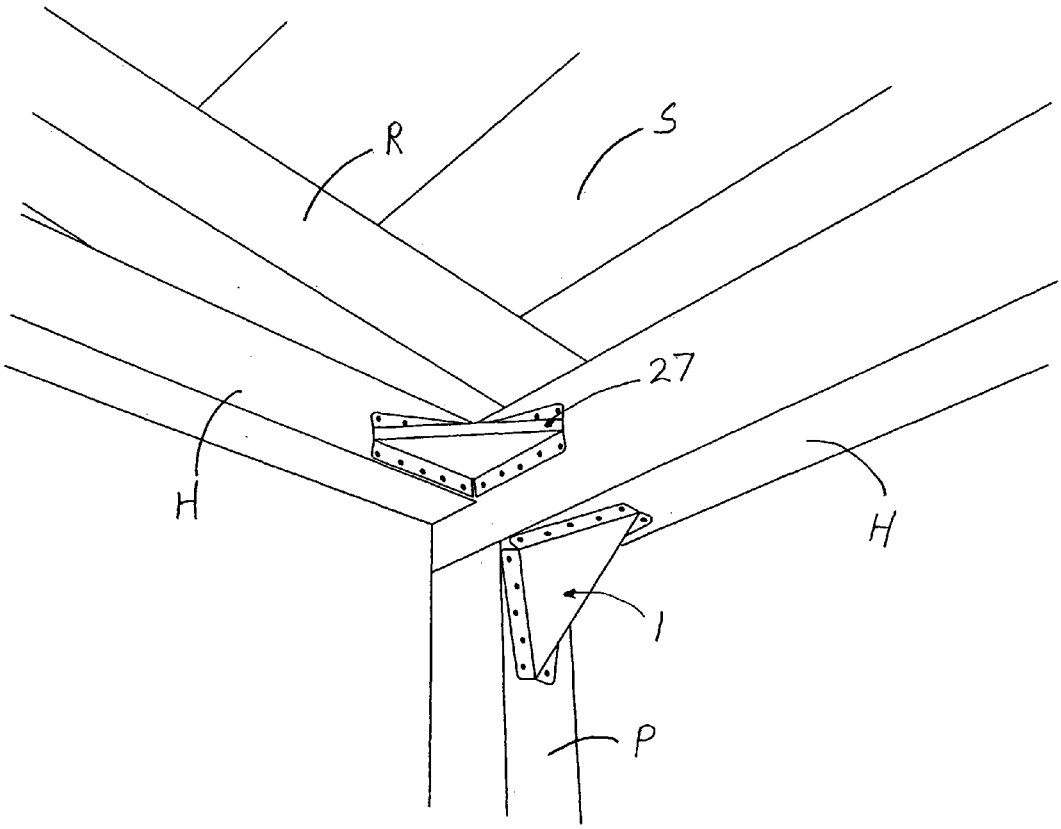

Refer now to FIG. 12D which shows an adjustable gusset 27 and multipurpose gusset 1 attached to the post P and beams H on a post-and-beam house.

Figure 12E:
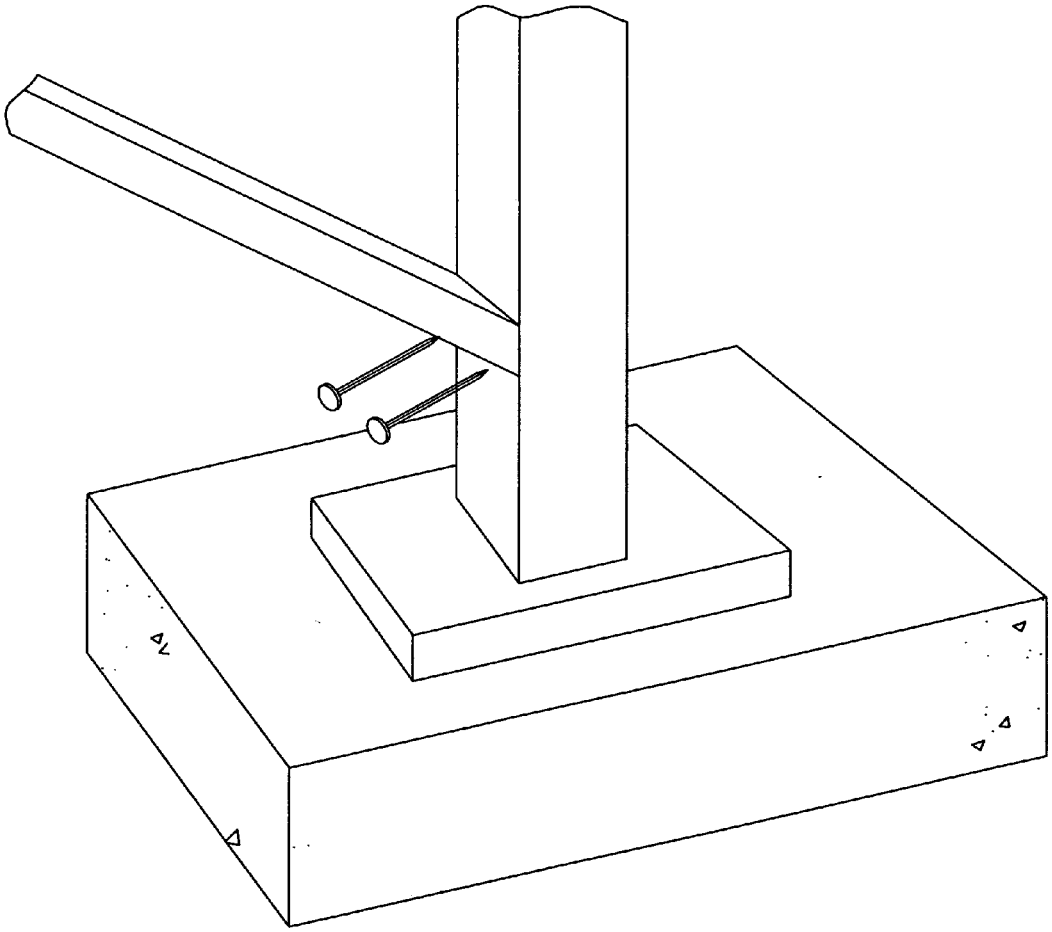

Refer now to FIG. 12E which shows toe-nailing. To attach angled beams together, angled nails are driven into the two beams Only a small section of the angled beam is secured by the nail, and the nail is driven at an angle into the other beam. The nail only catches a small section of wood in each beam, and is a weak connection. Gusset connectors can secure this weak connection more securely.

ADVANTAGES

From the description above, a number of advantages of my triangular gussets become evident:

(a) The gussets helps secure the walls of a building to make the building a solid unit and thus prevent it from being destroyed by earthquakes and wind storms.

(b) The gussets form multiple triangles against intersecting structural members. The triangles are intersecting and connected together.

(c) The gussets are adjustable, making several variations from one basic design. It can fit on different types of structural members that are generally at right angles to each other.

(d) The gussets help prevent the wall studs from twisting during earthquakes and strong winds, thereby preventing detaching and collapse of the walls. It stiffens the wall, helping to transfer lateral, uplift, twisting and turning loads into the foundation.

(e) The gussets help prevent the wall sheathing of a building from detaching from the wall studs during an earthquake. It helps make the wall into a stable shear-wall, transferring shear forces into the foundation and ground.

(f) Mounted on the wall stud and sill, my gussets resist uplift, the most destructive force during an earthquake and wind storm. Mounted on the floor plate and wall stud, my invention prevents the wall from twisting and moving. Mounted on each structural member, they help absorb and transfer loads.

(g) Another advantage is the half-box shape that the gussets form. This adds strength to the gusset and to the structural members that it attaches to.

(h) Another advantage of the gussets is the large surface area the gusset contains. This area provides more strength in the connecting or hold-down process. The angled triangles brace and support each other, adding more strength to the connection.

(i) The gussets are strong, attractive, permanent, functional, uncomplicated, simple to manufacture, easy to install, and economical. All of the embodiments can be made with slight modifications and without any welding.

(j) As a retrofit, a handy homeowner can install this invention, or have it installed.

CONCLUSION, RAMIFICATION AND SCOPE

Accordingly, the reader will see that having triangles with multiple bend and tabs makes a strong connector between intersecting structural members. The gusset connector can resist loads from different angles, absorb them and deflect them without disconnecting.

The flat pattern layouts show how easy a gusset could be manufactured with little wasted material. They also showed that small changes to the design could make different embodiments.

The gussets can be easily attached to structural members on an existing building. Even if an existing wall is to one side of a structural member, this gusset does not have to wrap around a member like previous connectors. It can be mounted on a single side, away from a wall.

Sheet metal connectors have been proven to perform better than nailed connections under stresses of strong winds and earth tremors. This invention is easily installed on a pre-existing house without disassembly or destruction of the house. Once installed, the house is much stronger than just nailed connections and more sturdy than prior art connectors that are installed during construction of a building. The gussets can be mounted to wood, metal or masonry, using nails, screws, or epoxy.

Thus the reader can see that the retrofit gusset connectors of this invention are unique, strong, permanent, functional, and necessary. They are also simple and economical to make, requiring simple tool and dies and no welding.

This invention solves the problem of retro-fitting houses to minimize high wind and seismic dangers by using an ingenious and practical connector. Many homeowners stay in their house during hurricanes, because they do not want to be caught in traffic jams trying to escape the fury, they live on a small island, or they are caught unaware.

While my above description contains many specificities, these should not be construed as limitations on the scope of the invention, but rather as an exemplification of one preferred embodiment thereof. Many other variations are possible.

For example, the thickness of the connector can be altered slightly, or have beveled edges or chamfer.

Rubber, plastic, foam, or resilient pads could be inserted between the connector and the intersecting structural members. This would help absorb the earthquake forces without cracking, and deaden the shocks, and after-shocks.

The invention could use different manufacturing techniques including manipulated sheet metal, casting, forging, extrusion, and plastic molds or injection. There can also be minor variations in color, size, and materials.

This invention was over-designed in order to exceed building codes in force or any that can be anticipated. Many areas have no codes for retrofit's because, prior to this invention, there were no workable gussets that could be retrofit to most buildings. Lag bolts, nails, screws, or bolts and washers could be used to fasten the connectors to the house.

I claim:

1. In combination, a connector and intersecting perpendicular structural building members, the combination comprising:

the connector comprising two rigid substantially parallel isosceles right triangles, each triangle having two legs and a hypotenuse, each leg having an adjacent planar rectangular tab, each tab bent at a substantially right angle to the adjacent triangle, each tab having a plurality of aligned fastener holes, the triangles joined together at their hypotenuses by an elongated rectangular dividing strip separating each hypotenuse, thereby adding rigidity and strength to the connector, the connector formed from a stamped steel sheet;

the intersecting perpendicular structural building members comprising intersecting elongated perpendicular structural building framing members forming the framing of a building, the members having transverse cross sectional dimensions of either 1½×3½ or 3½×3½ (inches); and mechanical fasteners extending through the fastener holes and into the structural building members, the back face of the tabs contacting the faces of the building framing members, the triangles forming gussets between the structural building framing members, thereby preventing movement of the structural building framing members and of the building due to wind and seismic events.

* * * * *